US007345682B2

(12) United States Patent
Honda et al.

(10) Patent No.: US 7,345,682 B2
(45) Date of Patent: Mar. 18, 2008

(54) DISPLAY PANEL DRIVER HAVING MULTI-GRAYSCALE PROCESSING FUNCTION

(75) Inventors: Hirofumi Honda, Yamanashi-ken (JP); Tetsuya Shigeta, Yamanashi-ken (JP); Tetsuro Nagakubo, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 529 days.

(21) Appl. No.: 10/781,722

(22) Filed: Feb. 20, 2004

(65) Prior Publication Data

US 2004/0165002 A1 Aug. 26, 2004

(30) Foreign Application Priority Data

Feb. 20, 2003 (JP) ..... 2003-042810

(51) Int. Cl.
*G09G 5/00* (2006.01)

(52) U.S. Cl. ..... 345/204; 345/214

(58) Field of Classification Search ..... 345/60–63, 345/204, 66–68, 214, 690–692, 596, 545, 345/76, 211, 3.1; 315/169.1–169.4; 445/24; 348/699, 671, 207.99; 381/98, 97; 382/132
See application file for complete search history.

(56) References Cited

U.S. PATENT DOCUMENTS 5,005,011 A * 4/1991 Perlman et al. ..... 345/540
5,475,402 A * 12/1995 Hijikata ..... 345/211
5,663,772 A * 9/1997 Uehara et al. ..... 348/671
6,243,073 B1 * 6/2001 Kawamura et al. ..... 345/690
6,404,909 B2 * 6/2002 Turek et al. ..... 382/132
6,473,061 B1 * 10/2002 Lim et al. ..... 345/60
6,507,327 B1 * 1/2003 Atherton et al. ..... 345/68
6,593,903 B2 * 7/2003 Nakamura et al. ..... 345/60
6,614,413 B2 * 9/2003 Tokunaga et al. ..... 345/63
6,661,470 B1 * 12/2003 Kawakami et al. ..... 348/699
7,170,471 B2 * 1/2007 Hashimoto et al. ..... 345/60
7,193,637 B2 * 3/2007 Kudo et al. ..... 345/690
2002/0054000 A1 * 5/2002 Tokunaga et al. ..... 345/60
2002/0135553 A1 * 9/2002 Nagai et al. ..... 345/89
2002/0149606 A1 * 10/2002 Kubota et al. ..... 345/690
2003/0006994 A1 * 1/2003 Suzuki ..... 345/596
2003/0210257 A1 * 11/2003 Hudson et al. ..... 345/692
2004/0038615 A1 * 2/2004 Oniki et al. ..... 445/24

(Continued)

FOREIGN PATENT DOCUMENTS

EP 1 262 947 12/2002

(Continued)

*Primary Examiner*—Prabodh Dharia
(74) *Attorney, Agent, or Firm*—Sughrue Mion, PLLC

(57) ABSTRACT

A display panel drive suppresses dither patterns in a displayed image. Each of the display lines of the panel is divided into M display line groups including a group of [M≅(k−1)+1]th display lines (where M is a natural number, and k is a natural number of n/M or smaller), a group of [M≅(k−1)+2]th display lines, . . . and a group of [M≅(k−1)+M]th display lines. A different offset value is added to pixel data corresponding to each display line group to derive multi-grayscale pixel data. Then, a lighting or extinction mode setting is done based on the pixel data with respect to each pixel cell belonging to the display line groups, each different in at least M subsubfields among subfields constituting a video signal field. In one example, the luminance levels represented by the pixel cells vertically adjacent to one another in a screen are varied.

19 Claims, 30 Drawing Sheets

U.S. PATENT DOCUMENTS

2005/0024350 A1* 2/2005 Kamiyamaguchi et al. . 345/204
2005/0057657 A1* 3/2005 Yamada et al. ..... 348/207.99
2005/0078060 A1* 4/2005 Shigeta et al. ..... 345/63

FOREIGN PATENT DOCUMENTS

JP 10-98662 4/1998
JP 2000-227778 A 8/2000

* cited by examiner

FIG. 2

PRIOR ART

SELECTIVE ERASURE

| Ds | HD 1 | 2 | 3 | 4 | 5 | 6 | 7 | 8 | 9 | 10 | 11 | 12 | 13 | 14 | LIGHT EMISSION DRIVING PATTERN IN A FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT EMISSION INTENSITY |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK DOT: SELECTIVE ERASURE
WHITE DOT: LIGHT EMISSION

FIG. 4

CONVERSION TABLE

| MD | GD 1 2 3 4 5 | DRIVING DISPLAY LINE | LIGHT EMISSION PATTERN SF 1₁ | SF 1₂ | SF 1₃ | SF 1₄ | SF 2₁ | SF 2₂ | SF 2₃ | SF 2₄ | SF 3₁ | SF 3₂ | SF 3₃ | SF 3₄ | SF 4₁ | SF 4₂ | SF 4₃ | SF 4₄ | LUMINANCE |
|---|---|---|---|---|---|---|---|---|---|---|---|---|---|---|---|---|---|---|---|
| 000 | 1 0 0 0 0 | 4N-3 | ● | | | | | | | | | | | | | | | | 0 |
| | | 4N-2 | ● | | | | | | | | | | | | | | | | 0 |
| | | 4N-1 | ● | | | | | | | | | | | | | | | | 0 |
| | | 4N | ● | | | | | | | | | | | | | | | | 0 |
| 001 | 0 1 0 0 0 | 4N-3 | ○ | ● | | | | | | | | | | | | | | | 2 |
| | | 4N-2 | ○ | ○ | ● | | | | | | | | | | | | | | 4 |
| | | 4N-1 | ○ | ○ | ○ | ● | | | | | | | | | | | | | 6 |
| | | 4N | ○ | ○ | ○ | ○ | ● | | | | | | | | | | | | 8 |
| 010 | 0 0 1 0 0 | 4N-3 | ○ | ○ | ○ | ○ | ○ | ● | | | | | | | | | | | 10 |
| | | 4N-2 | ○ | ○ | ○ | ○ | ○ | ○ | ● | | | | | | | | | | 12 |
| | | 4N-1 | ○ | ○ | ○ | ○ | ○ | ○ | ○ | ● | | | | | | | | | 14 |
| | | 4N | ○ | ○ | ○ | ○ | ○ | ○ | ○ | ○ | ● | | | | | | | | 16 |
| 011 | 0 0 0 1 0 | 4N-3 | ○ | ○ | ○ | ○ | ○ | ○ | ○ | ○ | ○ | ● | | | | | | | 18 |
| | | 4N-2 | ○ | ○ | ○ | ○ | ○ | ○ | ○ | ○ | ○ | ○ | ● | | | | | | 20 |
| | | 4N-1 | ○ | ○ | ○ | ○ | ○ | ○ | ○ | ○ | ○ | ○ | ○ | ● | | | | | 22 |
| | | 4N | ○ | ○ | ○ | ○ | ○ | ○ | ○ | ○ | ○ | ○ | ○ | ○ | ● | | | | 24 |
| 100 | 0 0 0 0 1 | 4N-3 | ○ | ○ | ○ | ○ | ○ | ○ | ○ | ○ | ○ | ○ | ○ | ○ | ○ | ● | | | 26 |
| | | 4N-2 | ○ | ○ | ○ | ○ | ○ | ○ | ○ | ○ | ○ | ○ | ○ | ○ | ○ | ○ | ● | | 28 |
| | | 4N-1 | ○ | ○ | ○ | ○ | ○ | ○ | ○ | ○ | ○ | ○ | ○ | ○ | ○ | ○ | ○ | ● | 30 |
| | | 4N | ○ | ○ | ○ | ○ | ○ | ○ | ○ | ○ | ○ | ○ | ○ | ○ | ○ | ○ | ○ | ○ | 32 |

●:ERASURE ADDRESSING DISCHARGE
○:SUSTAIN DISCHARGE LIGHT EMISSION

FIG. 16

CONVERSION TABLE

DRIVING DISPLAY LINE

LUMINANCE

| MD | GD 1 2 3 4 5 | | LIGHT EMISSION PATTERN SF $1_1$ | SF $1_2$ | SF $1_3$ | SF $1_4$ | SF $2_1$ | SF $2_2$ | SF $2_3$ | SF $2_4$ | SF $3_1$ | SF $3_2$ | SF $3_3$ | SF $3_4$ | SF $4_1$ | SF $4_2$ | SF $4_3$ | SF $4_4$ | |
|---|---|---|---|---|---|---|---|---|---|---|---|---|---|---|---|---|---|---|---|
| 000 | 1 0 0 0 0 | 4N-3 | ● | | | | | | | | | | | | | | | | 0 |
| | | 4N-2 | ● | | | | | | | | | | | | | | | | 0 |
| | | 4N-1 | ● | | | | | | | | | | | | | | | | 0 |
| | | 4N | ● | | | | | | | | | | | | | | | | 0 |
| 001 | 0 1 0 0 0 | 4N-3 | ○ | ● | | | | | | | | | | | | | | | 6 |
| | | 4N-2 | ○ | ○ | ● | | | | | | | | | | | | | | 10 |
| | | 4N-1 | ○ | ○ | ○ | ● | | | | | | | | | | | | | 14 |
| | | 4N | ○ | ○ | ○ | ○ | ● | | | | | | | | | | | | 18 |
| 010 | 0 0 1 0 0 | 4N-3 | ○ | ○ | ○ | ○ | ○ | ● | | | | | | | | | | | 22 |
| | | 4N-2 | ○ | ○ | ○ | ○ | ○ | ○ | ● | | | | | | | | | | 26 |
| | | 4N-1 | ○ | ○ | ○ | ○ | ○ | ○ | ○ | ● | | | | | | | | | 30 |
| | | 4N | ○ | ○ | ○ | ○ | ○ | ○ | ○ | ○ | ● | | | | | | | | 34 |
| 011 | 0 0 0 1 0 | 4N-3 | ○ | ○ | ○ | ○ | ○ | ○ | ○ | ○ | ○ | ● | | | | | | | 38 |
| | | 4N-2 | ○ | ○ | ○ | ○ | ○ | ○ | ○ | ○ | ○ | ○ | ● | | | | | | 42 |
| | | 4N-1 | ○ | ○ | ○ | ○ | ○ | ○ | ○ | ○ | ○ | ○ | ○ | ● | | | | | 46 |
| | | 4N | ○ | ○ | ○ | ○ | ○ | ○ | ○ | ○ | ○ | ○ | ○ | ○ | ● | | | | 50 |
| 100 | 0 0 0 0 1 | 4N-3 | ○ | ○ | ○ | ○ | ○ | ○ | ○ | ○ | ○ | ○ | ○ | ○ | ○ | ● | | | 54 |
| | | 4N-2 | ○ | ○ | ○ | ○ | ○ | ○ | ○ | ○ | ○ | ○ | ○ | ○ | ○ | ○ | ● | | 58 |
| | | 4N-1 | ○ | ○ | ○ | ○ | ○ | ○ | ○ | ○ | ○ | ○ | ○ | ○ | ○ | ○ | ○ | ● | 62 |
| | | 4N | ○ | ○ | ○ | ○ | ○ | ○ | ○ | ○ | ○ | ○ | ○ | ○ | ○ | ○ | ○ | ○ | 66 |

●:ERASURE ADDRESSING DISCHARGE
○:SUSTAIN DISCHARGE LIGHT EMISSION

FIG.24

CONVERSION TABLE

| MD | CD 1 2 3 4 | DRIVING DISPLAY LINE | LIGHT EMISSION PATTERN SF $4_1$ | SF $4_2$ | SF $4_3$ | SF $4_4$ | SF $3_1$ | SF $3_2$ | SF $3_3$ | SF $3_4$ | SF $2_1$ | SF $2_2$ | SF $2_3$ | SF $2_4$ | SF $1_1$ | SF $1_2$ | SF $1_3$ | SF $1_4$ | LUMINANCE |
|---|---|---|---|---|---|---|---|---|---|---|---|---|---|---|---|---|---|---|---|
| 100 | 1 0 0 0 | 4N-3 | ◎ | ○ | ○ | ○ | ○ | ○ | ○ | ○ | ○ | ○ | ○ | ○ | ○ | ○ | ○ | ○ | 66 |
| | | 4N-2 | | ◎ | ○ | ○ | ○ | ○ | ○ | ○ | ○ | ○ | ○ | ○ | ○ | ○ | ○ | ○ | 62 |
| | | 4N-1 | | | ◎ | ○ | ○ | ○ | ○ | ○ | ○ | ○ | ○ | ○ | ○ | ○ | ○ | ○ | 58 |
| | | 4N | | | | ◎ | ○ | ○ | ○ | ○ | ○ | ○ | ○ | ○ | ○ | ○ | ○ | ○ | 54 |
| 011 | 0 1 0 0 | 4N-3 | | | | | ◎ | ○ | ○ | ○ | ○ | ○ | ○ | ○ | ○ | ○ | ○ | ○ | 50 |
| | | 4N-2 | | | | | | ◎ | ○ | ○ | ○ | ○ | ○ | ○ | ○ | ○ | ○ | ○ | 46 |
| | | 4N-1 | | | | | | | ◎ | ○ | ○ | ○ | ○ | ○ | ○ | ○ | ○ | ○ | 42 |
| | | 4N | | | | | | | | ◎ | ○ | ○ | ○ | ○ | ○ | ○ | ○ | ○ | 38 |
| 010 | 0 0 1 0 | 4N-3 | | | | | | | | | ◎ | ○ | ○ | ○ | ○ | ○ | ○ | ○ | 34 |
| | | 4N-2 | | | | | | | | | | ◎ | ○ | ○ | ○ | ○ | ○ | ○ | 30 |
| | | 4N-1 | | | | | | | | | | | ◎ | ○ | ○ | ○ | ○ | ○ | 26 |
| | | 4N | | | | | | | | | | | | ◎ | ○ | ○ | ○ | ○ | 22 |
| 001 | 0 0 0 1 | 4N-3 | | | | | | | | | | | | | ◎ | ○ | ○ | ○ | 18 |
| | | 4N-2 | | | | | | | | | | | | | | ◎ | ○ | ○ | 14 |
| | | 4N-1 | | | | | | | | | | | | | | | ◎ | ○ | 10 |
| | | 4N | | | | | | | | | | | | | | | | ◎ | 6 |
| 000 | 0 0 0 0 | 4N-3 | | | | | | | | | | | | | | | | | 0 |
| | | 4N-2 | | | | | | | | | | | | | | | | | 0 |
| | | 4N-1 | | | | | | | | | | | | | | | | | 0 |
| | | 4N | | | | | | | | | | | | | | | | | 0 |

◎:WRITING ADDRESSING DISCHARGE
○:SUSTAIN DISCHARGE LIGHT EMISSION

FIG. 27

CONVERSION TABLE

| MD | GD 1 2 3 4 | DRIVING DISPLAY LINE | LIGHT EMISSION PATTERN SF 1₁ | SF 1₂ | SF 1₃ | SF 1₄ | SF 2₁ | SF 2₂ | SF 2₃ | SF 2₄ | SF 3₁ | SF 3₂ | SF 3₃ | SF 3₄ | SF 4₁ | SF 4₂ | SF 4₃ | SF 4₄ | LUMINANCE |
|---|---|---|---|---|---|---|---|---|---|---|---|---|---|---|---|---|---|---|---|
| 000 | 0 0 0 0 | 4N-3 | | | | | | | | | | | | | | | | | 0 |
| | | 4N-2 | | | | | | | | | | | | | | | | | 0 |
| | | 4N-1 | | | | | | | | | | | | | | | | | 0 |
| | | 4N | | | | | | | | | | | | | | | | | 0 |
| 001 | 1 1 0 0 | 4N-3 | | | | ◎ | ● | | | | | | | | | | | | 6 |
| | | 4N-2 | | | ◎ | ○ | ○ | ● | | | | | | | | | | | 10 |
| | | 4N-1 | | ◎ | ○ | ○ | ○ | ○ | ● | | | | | | | | | | 14 |
| | | 4N | ◎ | ○ | ○ | ○ | ○ | ○ | ○ | ● | | | | | | | | | 18 |
| 010 | 1 0 1 0 | 4N-3 | | | | ◎ | ○ | ○ | ○ | ○ | ● | | | | | | | | 22 |
| | | 4N-2 | | | ◎ | ○ | ○ | ○ | ○ | ○ | ○ | ● | | | | | | | 26 |
| | | 4N-1 | | ◎ | ○ | ○ | ○ | ○ | ○ | ○ | ○ | ○ | ● | | | | | | 30 |
| | | 4N | ◎ | ○ | ○ | ○ | ○ | ○ | ○ | ○ | ○ | ○ | ○ | ● | | | | | 34 |
| 011 | 1 0 0 1 | 4N-3 | | | | ◎ | ○ | ○ | ○ | ○ | ○ | ○ | ○ | ○ | ● | | | | 38 |
| | | 4N-2 | | | ◎ | ○ | ○ | ○ | ○ | ○ | ○ | ○ | ○ | ○ | ○ | ● | | | 42 |
| | | 4N-1 | | ◎ | ○ | ○ | ○ | ○ | ○ | ○ | ○ | ○ | ○ | ○ | ○ | ○ | ● | | 46 |
| | | 4N | ◎ | ○ | ○ | ○ | ○ | ○ | ○ | ○ | ○ | ○ | ○ | ○ | ○ | ○ | ○ | ● | 50 |
| 100 | 1 0 0 0 | 4N-3 | | | | ◎ | ○ | ○ | ○ | ○ | ○ | ○ | ○ | ○ | ○ | ○ | ○ | ○ | 54 |
| | | 4N-2 | | | ◎ | ○ | ○ | ○ | ○ | ○ | ○ | ○ | ○ | ○ | ○ | ○ | ○ | ○ | 56 |
| | | 4N-1 | | ◎ | ○ | ○ | ○ | ○ | ○ | ○ | ○ | ○ | ○ | ○ | ○ | ○ | ○ | ○ | 58 |
| | | 4N | ◎ | ○ | ○ | ○ | ○ | ○ | ○ | ○ | ○ | ○ | ○ | ○ | ○ | ○ | ○ | ○ | 60 |

◎ : WRITING ADDRESSING DISCHARGE
●:ERASURE ADDRESSING DISCHARGE
○:SUSTAIN DISCHARGE LIGHT EMISSION

| | |
|---|---|
| (8N-7)TH DISPLAY LINE | 0 |
| (8N-6)TH DISPLAY LINE | 4 |
| (8N-5)TH DISPLAY LINE | 8 |
| (8N-4)TH DISPLAY LINE | 12 |
| (8N-3)TH DISPLAY LINE | 16 |
| (8N-2)TH DISPLAY LINE | 20 |
| (8N-1)TH DISPLAY LINE | 24 |
| (8N)TH DISPLAY LINE | 28 |

DISPLAY PANEL DRIVER HAVING MULTI-GRAYSCALE PROCESSING FUNCTION

BACKGROUND OF THE INVENTION

1. Field of the Invention

The present invention relates to a display device including a multi-grayscale processing circuit for subjecting an input video signal to a multi-grayscale process.

2. Description of the Related Art

In recent years, as a two-dimensional image display panel, a plasma display panel (hereinafter, referred to as PDP) having a plurality of discharge cells arranged in matrix has been receiving attention. For displaying any image corresponding to an input video signal on such a PDP, a subfield method is known as a driving method. With the subfield method, the display period of a field is divided into a plurality of subfields, and on the resulting subfield basis, the discharge cells are each selectively discharged for light emission depending on the luminance level of the input video signal. This allows perception of intermediate luminance corresponding to the total duration of light emission in a field period.

FIG. 1 is a diagram showing an exemplary light emission driving sequence based on such a subfield method (refer to FIG. 14 of Japanese Patent Kokai No.2000-227778 (Patent Document 1) as an example).

In the light emission driving sequence of FIG. 1, a field period is divided into fourteen subfields of SF1 to SF14. Only in the subfield SF1 locating first of those SF1 to SF14, all of the discharge cells of a PDP are initiated to be in a lighting mode (Rc). On the basis of each subfield SF1 to SF14, an input video signal is referred to set the corresponding discharge cells to an extinction mode (Wc), and only the discharge cells in the lighting mode are discharged for light emission for the duration allocated to the subfield (Ic).

FIG. 2 is a diagram showing an exemplary light emission driving pattern in a subfield period of each discharge cells to be driven based on such an light emission driving sequence (refer to FIG. 27 of Patent Document 1, for example).

In the light emission.pattern of FIG. 2, the discharge cells initiated to be in the lighting mode in the first subfield SF1 are set to the extinction mode as shown by black dots in any one of the subfields SF1 to Sf14. Once set as such, those are not put back to the lighting mode again. Thus, the discharge cells continuously discharge for light emission in the subfields as shown by white dots until set to the extinction mode. At this time, the fifteen light emission patterns of FIG. 2 vary in total light emission duration in a field period, representing fifteen intermediate luminance levels. That is, achieved thereby is intermediate luminance display of (N+1) tones (where N is the number of subfields).

The problem with such a driving method is that the subfields as a result of field division are limited in number, causing shortage of the number of tones. Thus, to make up for the tone shortage, the input video signal is subjected to a multi-grayscale process such as error diffusion and dithering.

First, in the error diffusion process, an input video signal is converted into pixel data on a pixel basis, for example pixel data of eight bits. Out of the resulting data, six significant bits are regarded as display data, and the remaining two less-significant bits as error data. Then, the error data of the pixel data derived for each pixel in a close range is assigned weights and added together, and the result derived thereby is reflected to the display data. Through such an operation, as to one original pixel, the luminance of the less-significant two bits is represented in a pseudo manner by other pixels therearound, enabling representation of luminance tone equivalent to pixel data of eight bits using display data of only six bits. Then, the error-diffused pixel data of six bits derived by such an error diffusion process is subjected to dithering. At dithering, a plurality of adjacent pixels are regarded as a pixel unit, and to the error-diffused pixel data corresponding to each pixel in the pixel unit, a dither coefficient is assigned. The dither coefficients vary in value, and after such assignment, the dither coefficients are added together. Through such addition of dither coefficients, in view of a pixel unit, luminance representation so far required eight bits can be achieved only by four significant bits of the dither-added pixel data. Accordingly, four significant bits of the dither-added pixel data are extracted, and the extraction result is assigned to 15 light emission patterns of FIG. 2 as multi-grayscale pixel data PDs.

Here, another problem of image quality degradation arises if addition of dither coefficient to pixel data is done regularly by dithering, for example. This is because pseudo patterns irrelevant to an input video signal, so-called dither patterns, may be perceived thereby.

The present invention is proposed for solving the above problems, and an object thereof is to provide a display panel drive capable of satisfactory image display with dither patterns suppressed.

SUMMARY OF THE INVENTION

A first aspect of the present invention is directed to a display panel drive for tone-driving, responding to pixel data based on a video signal, a display panel in which a field display period of the video signal is constituted by a plurality of subfields, and pixel cells each carrying a pixel for n (where n is a natural number) display lines are arranged, the display panel drive comprising: a multi-grayscale component for deriving multi-grayscale pixel data by adding each different offset value to the pixel data corresponding to a display line group including [M·(k−1)+1]th display lines (where M is a natural number, and k is a natural number of n/M or smaller) of the display panel, a display line group including [M·(k−1)+2]th display lines thereof, a display line group including [M·(k−1)+3]th display lines thereof, . . . , a display line group including [M·(k−1)+M]th display lines thereof; and an address component for performing a lighting mode setting or an extinction mode setting based on the multi-grayscale pixel data with respect to each of the pixel cells belonging to the corresponding display line group each different in at least M of the subfields.

A second aspect of the present invention is directed to a display panel drive for tone-driving, responding to pixel data based on a video signal, a display panel in which pixel cells each carrying a pixel for a plurality of display lines are arranged, the display panel drive comprising: a multi-grayscale component for deriving multi-grayscale pixel data by adding each different offset value to the pixel data each corresponding to m display lines belonging to a display line group including m (where m is a natural number of 2 or larger) display lines adjacent to one another; and an light emission driving component for emitting the pixel cells depending on the multi-grayscale pixel data by weighing the display line groups each differently in luminance.

BRIEF DESCRIPTION OF THE DRAWINGS

FIG. 2 is a diagram showing an exemplary light emission driving pattern in a field period of each discharge cell to be driven based on the light emission driving sequence of FIG. 1;

FIG. 4 is a diagram showing a data conversion table to be used in a driving data conversion circuit 3 of FIG. 3, and an light emission driving pattern in a field period;

FIG. 16 is a diagram showing a data conversion table to be used in a driving data conversion circuit 30 of FIG. 13, and an light emission driving pattern in a field period;

FIG. 24 is a diagram showing a data conversion table to be used in the driving data conversion circuit 30 of FIG. 13, and an light emission driving pattern in a field period when the selective writing address method is adopted;

FIG. 27 is a diagram showing a data conversion table to be used in the driving data conversion circuit 30 at the time of driving the PDP 100 in accordance with the light emission driving sequence of FIG. 26, and an light emission driving pattern in a field period;

DETAILED DESCRIPTION OF THE INVENTION

In the below, embodiments of the present invention are described by referring to the accompanying drawings.

Figure 1:
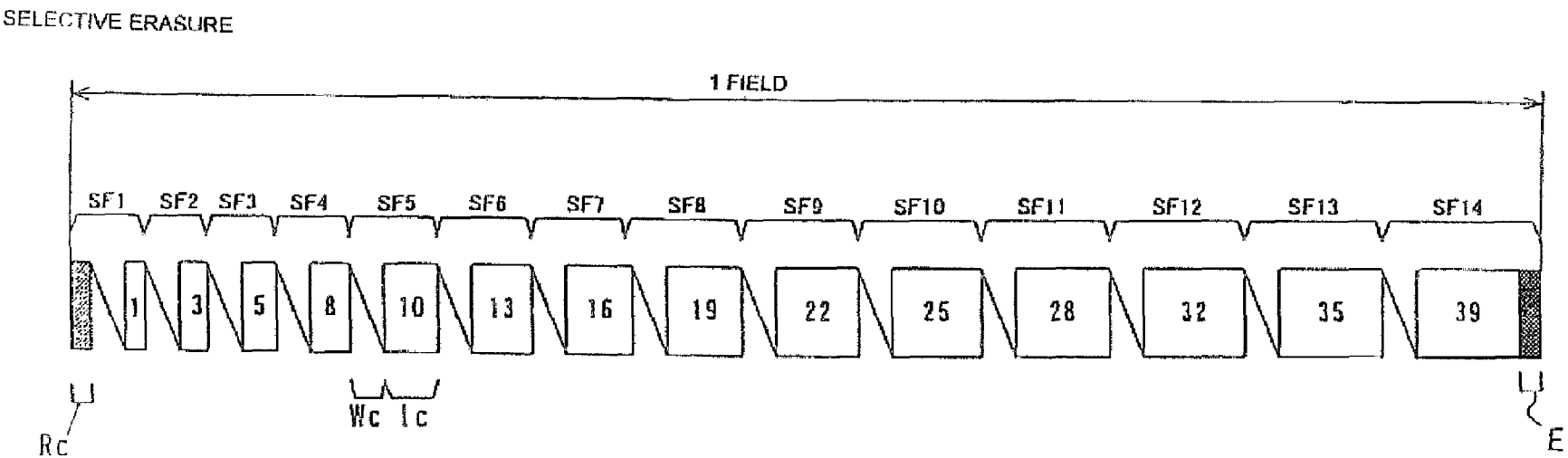
FIG. 1 PRIOR ART
FIG. 1 is a diagram showing an exemplary light emission driving sequence based on a subfield method.
Figure 3:
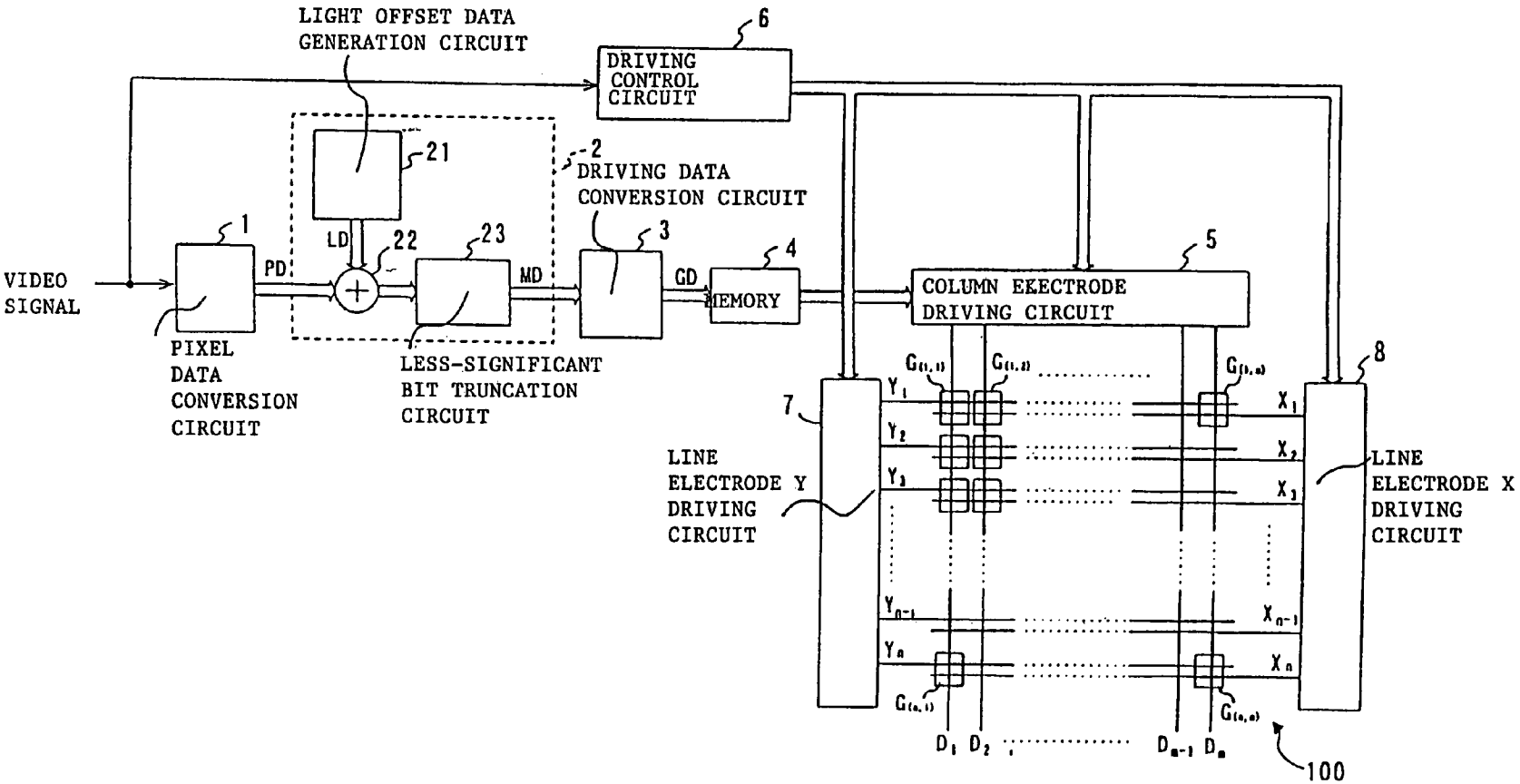
FIG. 3 is a diagram showing the structure of a plasma display device as a display device of the present invention.

FIG. 3 is a diagram showing the schematic structure of a plasma display device as a display device of the present invention.

In FIG. 3, a PDP 100 being a plasma display panel includes a front substrate (not shown) serving as a display plane and a rear substrate (not shown) opposing to the front substrate with a discharge-gas-filled discharge space therebetween. The front substrate is formed with strip-shaped row electrodes $X_1$ to $X_n$ and $Y_1$ to $Y_n$ arranged alternately and parallel with one another. Formed on the rear substrate are strip-shaped column electrodes $D_1$ to $D_m$ intersected on the row electrodes $X_1$ to $X_n$ and $Y_1$ to $Y_n$. Herein, as to the row electrodes $X_1$ to $X_n$ and $Y_1$ to $Y_n$, each pair of row electrodes X and Y serves as a display line of the PDP 100, from the 1st line to the nth line. At an intersection part (discharge space included) of a pair of row electrode and column electrode, formed is a discharge cell G serving as a pixel. That is, the PDP 100 includes (n×m) discharge cells $G_{(1,\ 1)}$ to $G_{(n,\ m)}$ formed in a matrix.

A pixel data conversion circuit 1 converts an input video signal into pixel data PD on a pixel basis, for example pixel data of six bits. Then, the resulting data is supplied to a multi-grayscale processing circuit 2, which is constituted by a line offset data generation circuit 21, an adder 22, and a less-significant bit truncation circuit 23.

When the pixel data conversion circuit 1 outputs pixel data PD corresponding to the (4N−3)th display lines [N: natural number of (¼)·n or smaller] of the PDP 100, the line offset data generation circuit 21 generates line offset data LD representing "10" (decimal numeral). Thus generated data is supplied to the adder 22. Similarly, when the pixel data conversion circuit 1 outputs pixel data PD corresponding to the (4N−2)th display lines, the line offset data generation circuit 21 generates line offset data LD representing "8" (decimal numeral) for supply to the adder 22. When the pixel data conversion circuit 1 outputs pixel data PD corresponding to the (4N−1)th display lines, the line offset data generation circuit 21 generates line offset data LD.representing "6" (decimal numeral) for supply to the adder 22. Further, when the pixel data conversion circuit 1 outputs pixel data PD corresponding to the (4N)th display lines, the line offset data generation circuit 21 generates line offset data LD representing "4" (decimal numeral) for supply to the adder 22.

To the pixel data PD provided by the pixel data conversion circuit 1, the adder 22 adds the corresponding line offset data LD. The resulting offset-added pixel data is then supplied to the less-significant bit truncation circuit 23. The less-significant bit truncation circuit 23 truncates three less-significant bits of the offset-added pixel data, and the remaining three significant bits are supplied to a driving data conversion circuit 3 as multi-grayscale pixel data MD.

The driving data conversion circuit 3 converts thus provided multi-grayscale pixel data MD into pixel driving data GD of five bits in accordance with a data conversion table shown in FIG. 4. The resulting data is then supplied to memory 4.

The memory 4 sequentially receives and stores the pixel driving data GD of five bits. Every time completing writing of pixel driving data $GD_{1,1}$ to $GD_{n,m}$ of an image frame (n lines×m columns), the memory 4 separates each of the pixel driving data $GD_{1,1}$ to $GD_{n,m}$ on a bit digit (1st to 5th bits) basis. Then, the memory 4 performs reading on a display line basis corresponding to subfields SF1 to SF4, which will be described later. The memory 4 then supplies, to a column electrode driving circuit 5, pixel driving data bits of thus read one display line (m bits) as pixel driving data bits DB1 to DB(m).

To be more specific, first in a subfield $SF1_1$, the memory 4 reads only the 1st bit of the pixel driving data $GD_{1,1}$ to $GD_{n,m}$ for every display line. Thus read results are supplied to the column electrode driving circuit 5 as the pixel driving data bits DB1 to DB(m). Then, in subfields $SF1_2$ to $SF2_1$, the memory 4 reads only the 2nd bit of the pixel driving data $GD_{1,1}$ to $GD_{n,m}$ for every display line, and thus read results are supplied to the column electrode driving circuit 5 as the pixel driving data bits DB1 to DB(m). Next, in subfields $SF2_2$ to $SF3_1$, the memory 4 reads only the 3rd bit of the pixel driving data $GD_{1,1}$ to $GD_{n,m}$ for every display line for supply to the column electrode driving circuit 5 as the pixel driving data bits DB1 to DB(m). Then, in subfields $SF3_2$ to $SF4_1$, the memory 4 reads only the 4th bit of the pixel driving data $GD_{1,1}$ to $GD_{n,m}$ for every display line for supply to the column electrode driving circuit 5 as the pixel driving data bits DB1 to DB(m). And, in subfields $SF4_2$ to $SF4_4$, the memory 4 reads only the 5th bit of the pixel driving data $GD_{1,1}$ to $GD_{n,m}$ for every display line for supply to the column electrode driving circuit 5 as the pixel driving data bits DB1 to DB(m).

Figure 5:
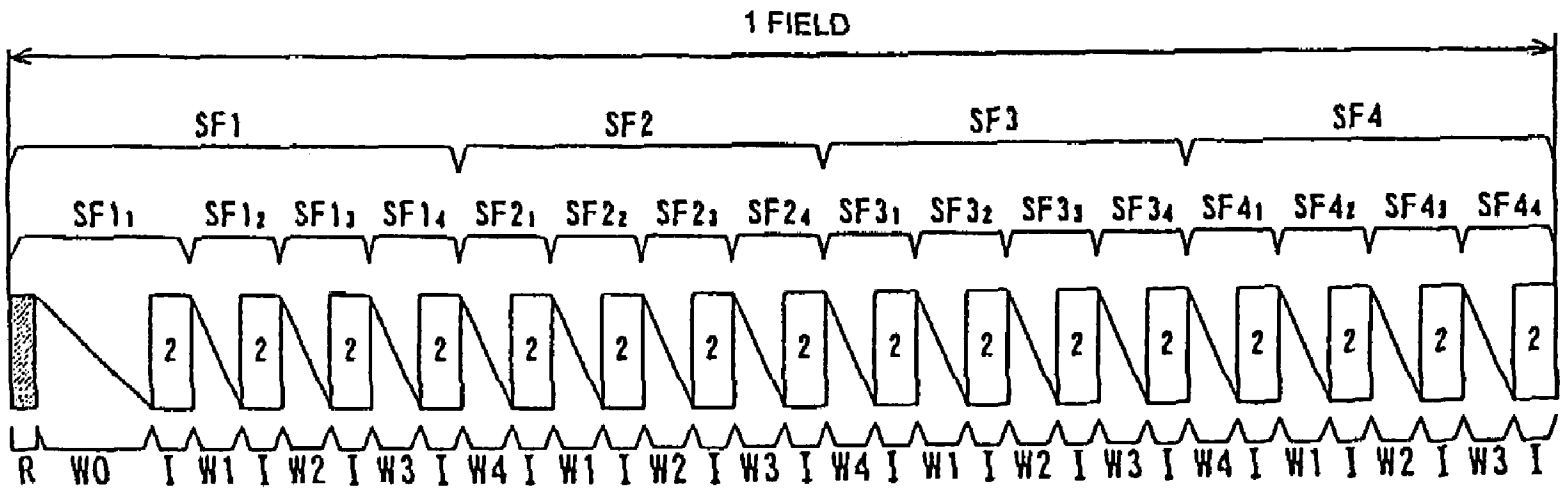
FIG. 5 is a diagram showing an exemplary light emission driving sequence when a PDP 100 is driven with a selective deletion address method adopted.

In accordance with an light emission driving sequence of FIG. 5 based on the subfield method, a driving control circuit 6 supplies various timing signals for tone-driving the PDP 100 to the column electrode driving circuit 5, a row electrode Y driving circuit 7, and a row electrode X driving circuit 8.

In the light emission driving sequence of FIG. 5, the display period of a field is divided into the subfields SF1 to SF4, and for each of the subfields, various driving processes are carried out as below. Note here that, the subfields SF1 to SF4 are constituted by, respectively, four subfields of $SF1_1$ to $SF1_4$, $SF2_1$ to $SF2_4$, $SF3_1$ to $SF3_4$, $SF4_1$ to $SF4_4$ as shown in FIG. 5.

First, in the first subfield $SF1_1$, a reset process R, an address process W0, and a sustain process I are carried out. Specifically, in the reset process R, every discharge cell of the PDP 100 is initiated to be in a lighting mode (state of predetermined wall charge being formed). In the address process W0, the discharge cells are selectively shifted to be in an extinction mode (state of wall charge being eliminated) with respect to every display line depending on the pixel driving data. And in the sustain process I, only the discharge cells in the lighting mode are discharged for light emission continuously over the period of "2".

In each of the subfields $SF2_1$, $SF3_1$, and $SF4_1$, an address process W4 and the sustain process I are carried out. Specifically, in the address process W4, the discharge cells belonging to the (4N)th display lines are selectively shifted to the extinction mode depending on the pixel driving data. In the sustain process I, only the discharge cells in the lighting mode are discharged for light emission continuously over the period of "2".

In each of the subfields $SF1_2$, $SF2_2$, $SF3_2$, and $SF4_2$, carried out are an address process W1 and the sustain process I. Specifically, in the address process W1, the discharge cells belonging to the (4N−3)th display lines are selectively shifted to the extinction mode depending on the pixel driving data. In the sustain process I, only the discharge cells in the lighting mode are discharged for light emission continuously over the period of "2".

In each of the subfields $SF1_3$, $SF2_3$, $SF3_3$, and $SF4_3$, carried out are an address process W2 and the sustain process I. Specifically, in the address process W2, the discharge cells belonging to the (4N−2)th display lines are selectively shifted to the extinction mode depending on the pixel driving data. In the sustain process I, only the discharge cells in the lighting mode are discharged for light emission continuously over the period of "2".

In each of the subfields $SF1_4$, $SF2_4$, $SF3_4$, and $SF4_4$, carried out are an address process W3 and the sustain process I. Specifically, in the address process W3, the discharge cells belonging to the (4N−1)th display lines are selectively shifted to the extinction mode depending on the pixel driving data. In the sustain process I, only the discharge cells in the lighting mode are discharged for light emission continuously over the period of "2".

Figure 6:
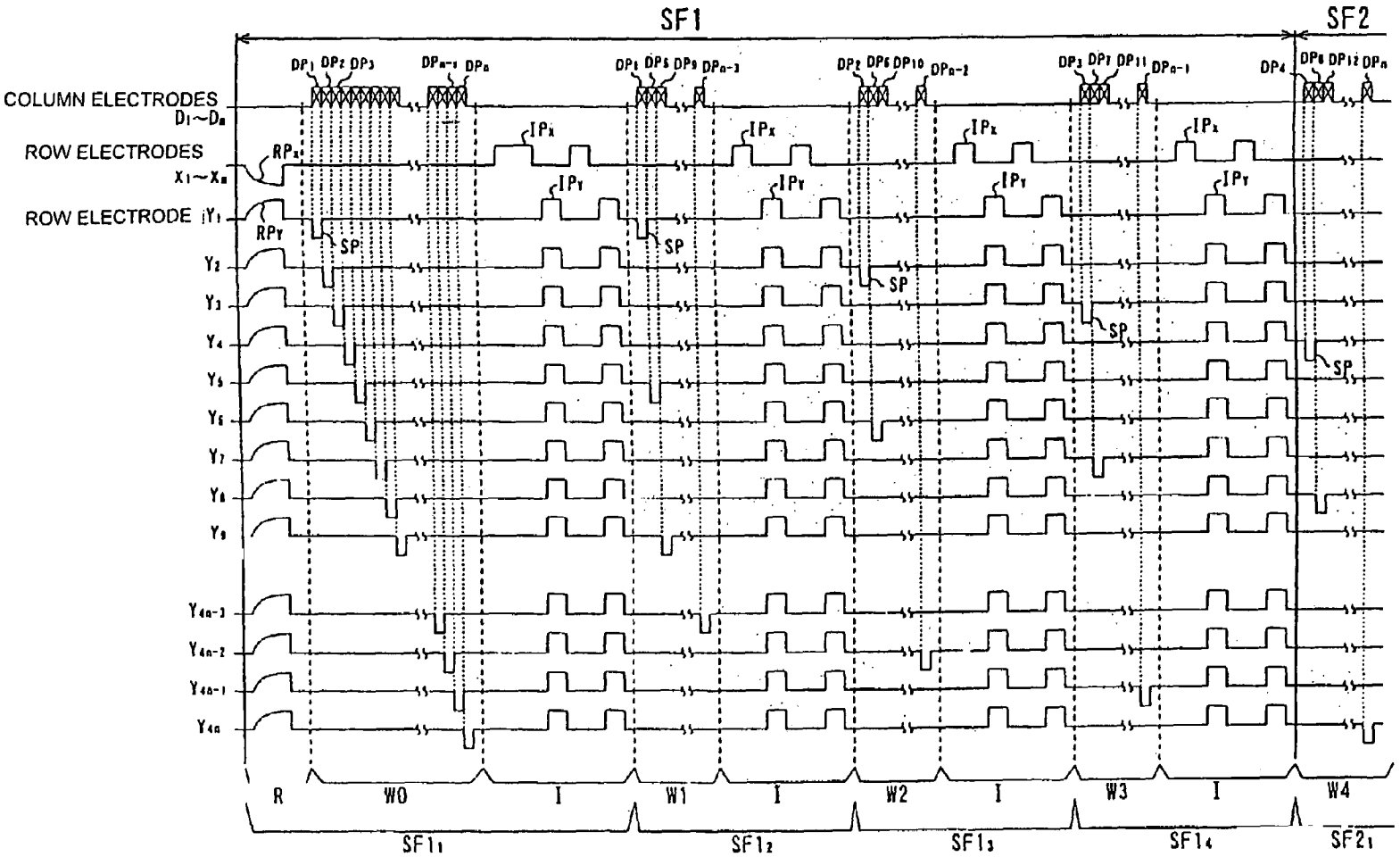
FIG. 6 is a diagram showing various driving pulses to be applied to the PDP 100 and their application timings in subfields SF0 and SF$\mathbf{1}_1$ to SF$\mathbf{1}_4$ in accordance with the light emission driving sequence of FIG. 5.

FIG. 6 is a diagram showing various driving pulses to be applied to the PDP 100, and their application timings in accordance with such an light emission driving sequence. Such application is made by the column electrode driving circuit 5, the row electrode Y driving circuit 7, and the row electrode X driving circuit 8 responding to various timing signals provided by the driving control circuit 6. Here, in the subfields $SF2_1$, $SF3_1$, and $SF4_1$, the various driving pulses to be applied to the PDP 100 and their application timings are all the same. In the subfields $SF1_2$, $SF2_2$, $SF3_2$, and $SF4_2$, the various driving pulses to be applied to the PDP 100 and their application timings are all the same. In the subfields $SF1_3$, $SF2_3$, $SF3_3$, and $SF4_3$, the various driving pulses to be applied to the PDP 100 and their application timings are all the same. Further, in the subfields $SF1_4$, $SF2_4$, $SF3_4$, and $SF4_4$, the various driving pulses to be applied to the PDP 100 and their application timings are all the same. Therefore, FIG. 6 shows only the subfield $SF1_1$ to the address process W4 in the subfield $SF2_1$.

First in the reset process R in the subfield $SF1_1$, the row electrode X driving circuit 8 generates a negative reset pulse $RP_x$ showing mild falling edge change. Thus generated pulse is applied to the row electrodes $X_1$ to $X_n$ of the PDP 100. At the same time as such a reset pulse $RP_x$, the row electrode Y driving circuit 7 generates a positive reset pulse $RP_y$ showing mild rising edge change for application to the row electrodes $Y_1$ to $Y_n$ of the PDP 100. Such simultaneous application of the reset pulses $RP_x$ and $RP_y$ responsively causes reset discharge to occur to every discharge cell of the PDP 100, resultantly forming wall charge in each of the discharge cells. In this manner, all of the discharge cells are initiated to be in the lighting mode, being emissive state (light light emission responding to sustain discharge) in the sustain process I (described below).

Next, in the address process W0 in the subfield $SF1_1$, the row electrode Y driving circuit 7 sequentially applies a negative scanning pulse SP to the row electrodes $Y_1$ to $Y_n$. During this time, the column electrode driving circuit 5 generates m pixel data pulses for a display line corresponding to the pixel driving data bits DB1 to DB(m) read from the memory 4. Then, a pixel data pulse group DP consisted of thus generated m pixel data pulses is applied to the column electrodes $D_1$, to $D_m$, respectively, in synchronization with the scanning pulse SP. That is, as shown in FIG. 6, sequentially applied to the column electrodes $D_1$ to $D_m$ are pixel data pulse groups $DP_1$ to $DP_n$ corresponding to the 1st to nth display lines of the PDP 100, respectively. Here, the pixel data pulse generated by the column electrode driving circuit 5 is high in voltage when the pixel driving data bit DB is in the logic level 1, and when in the logic level 0, the pixel data pulse will be low in voltage. At this time, erasure addressing discharge occurs only to the discharge cells locating at intersections of the display lines and the column electrodes. Here, the display lines are those having applied with the scanning pulse SP, and the column electrodes are those having applied with the pixel data pulse of high voltage. Through such erasure addressing discharge, the wall charge so far formed in the discharge cells is eliminated, and the resulting discharge cells shift into the extinction mode, being non-emissive state (light emission responding to sustain discharge) in the sustain process I (described below). On the other hand, no such erasure addressing discharge occurs to the discharge cells having applied with the scanning pulse SP and with the pixel data pulse but of low voltage, and thus the mode immediately before (lighting or extinction mode) is sustained.

That is, in the address process W0, all of the discharge cells of the PDP 100 are selectively put to cause erasure addressing discharge based on the pixel data. In this manner, the discharge cells are each set to be in either the lighting mode or the extinction mode.

Next, in the sustain process I in the subfield $SF1_1$, the row electrode X driving circuit 8 and the row electrode Y driving circuit 7 alternately apply positive sustain pulses $IP_x$ and $IP_y$ repeatedly for a predetermined number of times to the row electrodes $X_1$ to $X_n$ and $Y_1$ to $Y_n$ as shown in FIG. 6. At this time, in response to every application of the sustain pulses $IP_x$ and $IP_y$, sustain discharge occurs only to the discharge cells with the wall charge remained therein, i.e., the discharge cells set in the lighting mode. Those discharge cells sustain the light emission state resulting from such sustain discharge. To be more specific, only the discharge cells sustaining the state of the lighting mode without erasure addressing discharge occurring in the address process W0 in the subfield $SF1_1$ emit in the sustain process I over the predetermined period of "2".

Then, in the address process W1 in the subfield $SF1_2$, the row electrode Y driving circuit 7 sequentially applies a negative scanning pulse SP to any row electrode Y belonging to the (4N−3)th display lines [N:1 to (¼)·n] of the PDP 100, i.e., the row electrodes $Y_1, Y_5, Y_9, \ldots, Y_{(n-3)}$. During this time, the column electrode driving circuit 5 generates m pixel data pulses for a display line corresponding to the pixel driving data bits DB1 to DB(m) read from the memory 4. Then, the pixel data pulse group DP consisted of the resulting m pixel data pulses is applied to the column electrodes $D_1$ to $D_m$ in synchronization with the scanning pulse SP. At this time, in the subfield $SF1_2$, read from the memory 4 is the pixel driving data bit DB corresponding to the (4N−3)th display lines of the PDP 100. Accordingly, the column electrode driving circuit 5 sequentially applies the pixel data pulse groups $DP_1, DP_5, DP_9, \ldots, DP_{(n-3)}$ corresponding to the (4N−3)th display lines to the column electrodes $D_1$ to $D_m$ as shown in FIG. 6. Here, the pixel data pulse generated by the column electrode driving circuit 5 is high in voltage when the pixel driving data bit DB is in the logic level 1, and when in the logic level 0, the pixel data pulse will be low in voltage. At this time, erasure addressing discharge occurs only to the discharge cells locating at intersections of the display lines and the column electrodes. Here, the display lines are those having applied with the scanning pulse SP, and the column electrodes are those having applied with the pixel data pulse of high voltage. Through such erasure addressing discharge, the wall charge so far formed in the discharge cells is eliminated, and the resulting discharge cells shift into the extinction mode, being non-emissive state (light emission responding to sustain discharge) in the sustain process I. On the other hand, no such erasure addressing discharge occurs to the discharge cells having applied with the scanning pulse SP and with the pixel data pulse but of low voltage, and thus the mode immediately before (lighting or extinction mode) is sustained.

That is, in the address process W1, only the discharge cells belonging to the (4N−3)th display lines of the PDP 100 are selectively put to cause erasure addressing discharge based on the pixel data. In this manner, the discharge cells are each set to be in either the lighting mode or the extinction mode.

Next, in the sustain process I in the subfield $SF1_2$, the row electrode X driving circuit 8 and the row electrode Y driving circuit 7 alternately apply positive sustain pulses $IP_x$ and $IP_y$ repeatedly for a predetermined number of times to the row electrodes $X_1$ to $X_n$ and $Y_1$ to $Y_n$ as shown in FIG. 6. At this time, in response to every application of the sustain pulses $IP_x$ and $IP_y$, sustain discharge occurs only to the discharge cells with the wall charge remained therein, i.e., the discharge cells set in the lighting mode. Those discharge cells sustain the light emission state resulting from such sustain discharge. To be more specific, only the discharge cells sustaining the state of the lighting mode without erasure addressing discharge occurring in both the address processes W0 and W1 emit in the sustain process I over the predetermined.period of "2".

Then, in the address process W2 in the subfield $SF1_3$, the row electrode Y driving circuit 7 sequentially applies a negative scanning pulse SP to any row electrode Y belonging to the (4N−2)th display lines [N: natural number of (¼)·n or smaller] of the PDP 100, i.e., the row electrodes $Y_2$, $Y_6$, $Y_{10}$, . . . , $Y_{(n-2)}$. During this time, the column electrode driving circuit 5 generates m pixel data pulses for a display line corresponding to the pixel driving data bits DB1 to DB(m) read from the memory 4. Then, the pixel data pulse group DP consisted of the resulting m pixel data pulses is applied to the column electrodes $D_1$ to $D_m$ in synchronization with the scanning pulse SP. At this time, in the subfield $SF1_3$, read from the memory 4 is the pixel driving data bit DB corresponding to the (4N−2)th display lines of the PDP 100. Accordingly, the column electrode driving circuit 5 sequentially applies the pixel data pulse groups $DP_2$, $DP_6$, $DP_{10}$, . . . , $DP_{(n-2)}$ corresponding to the (4N−2)th display lines to the column electrodes $D_1$ to $D_m$ as shown in FIG. 6. Here, the pixel data pulse generated by the column electrode driving circuit 5 is high in voltage when the pixel driving data bit DB is in the logic level 1, and when in the logic level 0, the pixel data pulse will be low in voltage. At this time, erasure addressing discharge occurs only to the discharge cells locating at intersections of the display lines and the column electrodes. Here, the display lines are those having applied with the scanning pulse SP, and the column electrodes are those having applied with the pixel data pulse of high voltage. Through such erasure addressing discharge, the wall charge so far formed in the discharge cells is eliminated, and the resulting discharge cells shift into the extinction mode. On the other hand, no such erasure addressing discharge occurs to the discharge cells having applied with the scanning pulse SP and with the pixel data pulse but of low voltage, and thus the mode immediately before (lighting or extinction mode) is sustained.

That is, in the address process W2, only the discharge cells belonging to the (4N−2)th display lines of the PDP 100 are selectively put to cause erasure addressing discharge based on the pixel data. In this manner, the discharge cells are each set to be in either the lighting mode or the extinction mode.

Next, in the sustain process I in the subfield $SF1_3$, the row electrode X driving circuit 8 and the row electrode Y driving circuit 7 alternately apply positive sustain pulses $IP_x$ and $IP_y$ repeatedly for a predetermined number of times to the row electrodes $X_1$ to $X_n$ and $Y_1$ to $Y_n$ as shown in FIG. 6. At this time, in response to every application of the sustain pulses $IP_x$ and $IP_y$, sustain discharge occurs only to the discharge cells with the wall charge remained therein, i.e., the discharge cells set in the lighting mode. Those discharge cells sustain the light emission state resulting from such sustain discharge. To be more specific, only the discharge cells sustaining the state of the lighting mode without erasure addressing discharge occurring in the address processes W0, W1, and W2 emit in the sustain process I over the predetermined period of "2".

Then, in the address process W3 in the subfield $SF1_4$, the row electrode Y driving circuit 7 sequentially applies a negative scanning pulse SP to any row electrode Y belonging to the (4N−1)th display lines [N: natural number of (¼)·n or smaller] of the PDP 100, i.e., the row electrodes $Y_3$, $Y_7$, $Y_{11}$, . . . , $Y_{(n-1)}$. During this time, the column electrode driving circuit 5 generates m pixel data pulses for a display line corresponding to the pixel driving data bits DB1 to DB(m) read from the memory 4. Then, the pixel data pulse group DP consisted of the resulting m pixel data pulses is applied to the column electrodes $D_1$ to $D_m$ in synchronization with the scanning pulse SP. At this time, in the subfield $SF1_4$, read from the memory 4 is the pixel driving data bit DB corresponding to the (4N−1)th display lines of the PDP 100. Accordingly, the column electrode driving circuit 5 sequentially applies the pixel data pulse groups $DP_3$, $DP_7$, $DP_{11}$, . . . , $DP_{(n-1)}$ corresponding to the (4N−1)th display lines to the column electrodes $D_1$ to $D_m$ as shown in FIG. 6. Here, the pixel data pulse generated by the column electrode driving circuit 5 is high in voltage when the pixel driving data bit DB is in the logic level 1, and when in the logic level 0, the pixel data pulse will be low in voltage. At this time, erasure addressing discharge occurs only to the discharge cells locating at intersections of the display lines and the column electrodes. Here, the display lines are those having applied with the scanning pulse SP, and the column electrodes are those having applied with the pixel data pulse of high voltage. Through such erasure addressing discharge, the wall charge so far formed in the discharge cells is eliminated, and the resulting discharge cells shift into the extinction mode. On the other hand, no such erasure addressing discharge occurs to the discharge cells having applied with the scanning pulse SP and with the pixel data pulse but of low voltage, and thus the mode immediately before (lighting or extinction mode) is sustained.

That is, in the address process W3, only the discharge cells belonging to the (4N−1)th display lines of the PDP 100 are selectively put to cause erasure addressing discharge based on the pixel data. In this manner, the discharge cells are each set to be in either the lighting mode or the extinction mode.

Next, in the sustain process I in the subfield $SF1_4$, the row electrode X driving circuit 8 and the row electrode Y driving circuit 7 alternately apply positive sustain pulses $IP_x$ and $IP_y$ repeatedly for a predetermined number of times to the row electrodes $X_1$ to $X_n$ and $Y_1$ to $Y_n$ as shown in FIG. 6. At this time, in response to every application of the sustain pulses $IP_x$, and $IP_y$, sustain discharge occurs only to the discharge cells with the wall charge remained therein, i.e., the discharge cells set in the lighting mode. Those discharge cells sustain the light emission state resulting from such sustain discharge. To be more specific, only the discharge cells sustaining the state of the lighting mode without erasure addressing discharge occurring in the address processes W0, W1, W2, and W3 emit in the sustain process I over the predetermined period of "2".

Then, in the address process W4 in the subfield $SF2_1$, the row electrode Y driving circuit 7 sequentially applies a negative scanning pulse SP to any row electrode Y belonging to the (4N)th display lines [N: 1 to (¼)·n] of the PDP 100, i.e., the row electrodes $Y_4$, $Y_8$, $Y_{12}$, . . . , $Y_n$. During this time, the column electrode driving circuit 5 generates m pixel data pulses for a display line corresponding to the pixel driving data bits DB1 to DB(m) read from the memory 4. Then, the pixel data pulse group DP consisted of the resulting m pixel data pulses is applied to the column electrodes $D_1$ to $D_m$ in synchronization with the scanning pulse SP. At this time, in the subfield $SF2_1$, read from the memory 4 is the pixel driving data bit DB corresponding to the (4N)th display lines of the PDP 100. Accordingly, the column electrode driving circuit 5 sequentially applies the pixel data pulse groups $DP_4$, $DP_8$, $DP_{12}$, . . . , $DP_n$ corresponding to the (4N)th display lines to the column electrodes $D_1$ to $D_m$ as shown in FIG. 6. Here, the pixel data pulse generated by the column electrode driving circuit 5 is high in voltage when the pixel driving data bit DB is in the logic level 1, and when in the logic level 0, the pixel data pulse will be low in voltage. At this time, erasure addressing discharge occurs only to the discharge cells locating at intersections of the display lines and the column electrodes. Here, the display lines are those having applied with the scanning pulse SP, and the column electrodes are those having applied with the pixel data pulse of high voltage. Through such erasure addressing discharge, the wall charge so far formed in the discharge cells is eliminated, and the resulting discharge cells shift into the extinction mode. On the other hand, no such erasure addressing discharge occurs to the discharge cells having applied with the scanning pulse SP and with the pixel data pulse but of low voltage, and thus the mode immediately before (lighting or extinction mode) is sustained.

That is, in the address process W4, only the discharge cells belonging to the (4N)th display lines of the PDP 100 are selectively put to cause erasure addressing discharge based on the pixel data. In this manner, the discharge cells are each set to be in either the lighting mode or the extinction mode.

Next, in the sustain process I (not shown) in the subfield $SF2_1$, the row electrode X driving circuit 8 and the row electrode Y driving circuit 7 alternately apply positive sustain pulses $IP_x$ and $IP_y$ repeatedly for a predetermined number of times to the row electrodes $X_1$ to $X_n$ and $Y_1$ to $Y_n$. At this time, in response to every application of the sustain pulses $IP_x$ and $IP_y$, sustain discharge occurs only to the discharge cells with the wall charge remained therein, i.e., the discharge cells set in the lighting mode. Those discharge cells sustain the light emission state resulting from such sustain discharge. To be more specific, only the discharge cells sustaining the state of the lighting mode without erasure addressing discharge occurring in the address processes W0, W1, W2, W3, and W4 emit in the sustain process I over the predetermined period of "2".

By going through such driving, among the subfield groups SF1 to SF4, only the reset process R in the first subfield $SF1_1$ allows the discharge cells to shift from the extinction mode to the lighting mode. In other words, once the discharge cells are set to be in the extinction mode responding to the erasure addressing discharge occurring in each first subfield, the discharge cells are not allowed to be in the lighting mode again in the following subfields. Thus, by going through driving based on the 5 pixel driving data GD as shown in FIG. 4, the discharge cells are set to be in the lighting mode in the sequential subfields by the corresponding luminance to be represented. Then, until erasure addressing discharge occurs (indicated by black dots), sustain discharge light emission (indicated by white dots) occurs continually in the sustain process I in the respective subfields. During this time, perceived is the intermediate luminance corresponding to the total light emission duration in one field period caused by such sustain discharge light emission.

Here, with driving shown in FIGS. 5 and 6, the discharge cells belonging to four display lines vertically adjacent to one another in the screen of the PDP 100, i.e., for each of these discharge cells belonging to (4N−3)th display lines, discharge cells belonging to (4N−2)th display lines, discharge cells belonging to (4N−1)th display lines, and discharge cells.belonging to (4N)th display lines, the total light emission duration differs in each field period responding to the driving based on the pixel driving data GD.

Taking pixel driving data GD [00100] of FIG. 4 as an example, the discharge cells belonging to the (4N−3)th display lines, i.e., 1st, 5th, 9th, . . . , and (n−3)th display lines, are put to cause sustain discharge for light emission in the sustain process I of the subfields $SF1_1$, to $SF1_4$, and $SF2_1$ as indicated by white dots. The discharge cells belonging to the (4N−2)th display lines, i.e., 2nd, 6th, 10th, . . . , and (n−2)th display lines, are put to cause sustain discharge for light emission in the sustain process I of the subfields $SF1_1$ to $SF1_4$, $SF2_1$, and $SF2_2$. The discharge cells belonging to the (4N−1)th display lines, i.e., 3rd, 7th, 11th, . . . , and (n−1)th display lines, are put to cause sustain discharge for light emission in the sustain process I of the subfields $SF1_1$ to $SF1_4$, and $SF2_1$, to $SF2_3$. Further, the discharge cells belonging to the (4N)th display lines, i.e., 4th, 8th, 12th, . . . , and nth display lines, are put to cause sustain discharge for light emission in the sustain process I of the subfields $SF1_1$ to $SF1_4$, and $SF2_1$ to $SF2_4$.

During this time, assuming that the light emission duration in each sustain process I is "2", the total light emission duration in one field period caused by sustain discharge light emission occurred responding to the pixel driving data GD of [00100] will be as follows, as shown in FIG. 4, discharge cells belonging to (4N−3)th display lines: "10", discharge cells belonging to (4N−2)th display lines: "12", discharge cells belonging to (4N−1)th display lines: "14", and discharge cells belonging to (4N)th display lines: "16".

Similarly, the total light emission duration in one field period caused by sustain discharge light emission occurred responding to the pixel driving data GD of [01000] as shown in FIG. 4 will be as follows:

discharge cells belonging to (4N−3)th display lines: "2", discharge cells belonging to (4N−2)th display lines: "4", discharge cells belonging to (4N−1)th display lines: "6", and discharge cells belonging to (4N)th display lines: "8".

That is, four adjacent display lines are driven in each different manner to vary the total light emission duration on a field period basis.

Note here that, with such driving, for the purpose of equalizing the average luminance level for four discharge cells vertically adjacent to one another in the screen, the pixel data PD is added with the line offset data LD.

Specifically, first of all, added is such line offset data LD as

"10" to pixel data PD corresponding to (4N−3)th display lines,

"8" to pixel data PD corresponding to (4N−2)th display lines,

"6" to pixel data PD corresponding to (4N−1)th display lines, and

"4" to pixel data PD corresponding to (4N)th display lines.

Then, out of the addition result, three significant bits are regarded as multi-grayscale pixel data MD, which is converted into pixel driving data GD in accordance with the conversion table of FIG. 4.

Figure 7:
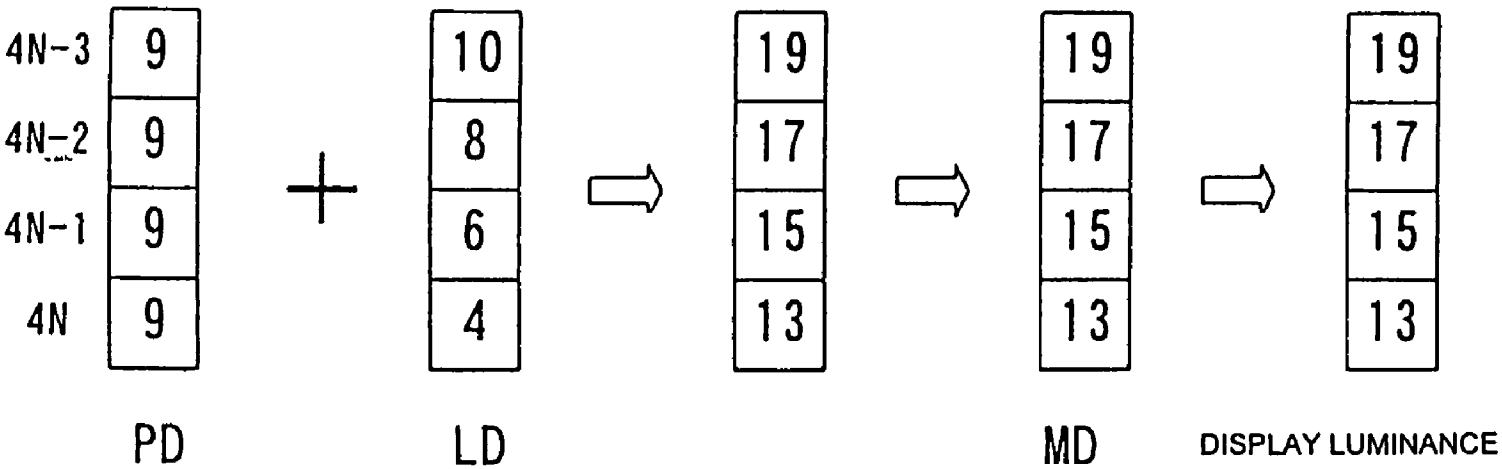
FIG. 7 is a diagram showing the operation for driving the plasma display device of FIG. 3 with the selective deletion address method adopted when pixel data PD each corresponding to four adjacent discharge cells all representing the luminance level of "9"

For example, assuming here that pixel data $PD_{(1,1)}$, $PD_{(2,1)}$, $PD_{(3,1)}$, and $PD_{(4,1)}$ corresponding, respectively, to discharge cells $G_{(1,1)}$, $G_{(2,1)}$, $G_{(3,1)}$, and $G_{(4,1)}$ vertically adjacent to one another in the screen of the PDP 100 are all six-bit data [001001] representing "9" (decimal numeral). Through addition of the line offset data LD of "10", "8", "6", and "4" as shown in FIG. 7 respectively to $PD_{(1,1)}$, $PD_{(2,1)}$, $PD_{(3,1)}$, and $PD_{(4,1)}$, derived are the addition results as six-bit data of [010011] representing "19", six-bit data of [010001] representing "17", six-bit data of [001111] representing "15", and six-bit data of [001101] representing "13".

Here, from each of the addition results, extracting three significant bits by truncating the three less-significant bits will lead to three-bit multi-grayscale pixel data $MD_{(1,\ 1)}$ of [010] representing "2", three-bit multi-grayscale pixel data $MD_{(2,\ 1)}$ of [010] representing "2", three-bit multi-grayscale pixel data $MD_{(3,\ 1)}$ of [001] representing "1", and three-bit multi-grayscale pixel data $MD_{(4,\ 1)}$ of [001] representing "1".

Accordingly, with the multi-grayscale pixel data $MD_{(1,1)}$ of [010] as such, the discharge cell $G_{(1,1)}$ belonging to the (4N−3)th display lines is put to cause sustain discharge for light emission in the sustain processes I in the subfields $SF\mathbf{1}_1$ to $SF\mathbf{1}_4$, and $SF\mathbf{2}_1$ as indicated by the white dots of FIG. 4. As a result, perceived is the light emission luminance of "10". With the multi-grayscale pixel data $MD_{(2,1)}$ of [010], the discharge cell $G_{(2,1)}$ belonging to the (4N−2)th display lines is put to cause sustain discharge for light emission in the sustain processes I in the subfields $SF\mathbf{1}_1$ to $SF\mathbf{1}_4$, $SF\mathbf{2}_1$, and $SF\mathbf{2}_2$. As a result, perceived is the light emission luminance of "12". With the multi-grayscale pixel data $MD_{(3,1)}$ of [001], the discharge cell $G_{(3,1)}$ belonging to the (4N−1)th display lines is put to cause sustain discharge for light emission in the sustain processes I in the subfields $SF\mathbf{1}_1$ to $SF\mathbf{1}_3$ as indicated by the white dots of FIG. 4. As a result, perceived is the light emission luminance of "6". Further, with the multi-grayscale pixel data $MD_{(4,1)}$ of [001], the discharge cell $G_{(4,1)}$ belonging to the (4N)th display lines is put to cause sustain discharge for light emission in the sustain processes I in the subfields $SF\mathbf{1}_1$ to $SF\mathbf{1}_4$ as indicated by the white dots of FIG. 4. As a result, perceived is the light emission luminance of "8".

As such, responding to the incoming pixel data PD representing the luminance level of "9", the four discharge cells $G_{(1,1)}$, $G_{(2,1)}$, $G_{(3,1)}$, and $G_{(4,1)}$ vertically adjacent to one another in the screen of the PDP 100 each emit representing as follows:

$G_{(1,1)}$: luminance level "10", $G_{(2,1)}$: luminance level "12", $G_{(3,1)}$: luminance level "6", and $G_{(4,1)}$: luminance level "8".

In view of these four discharge cells G as a unit, perceived is the luminance level of "9" being an average value of the luminance levels. That is, represented is the luminance of the incoming video signal (pixel data PD).

Figure 8:
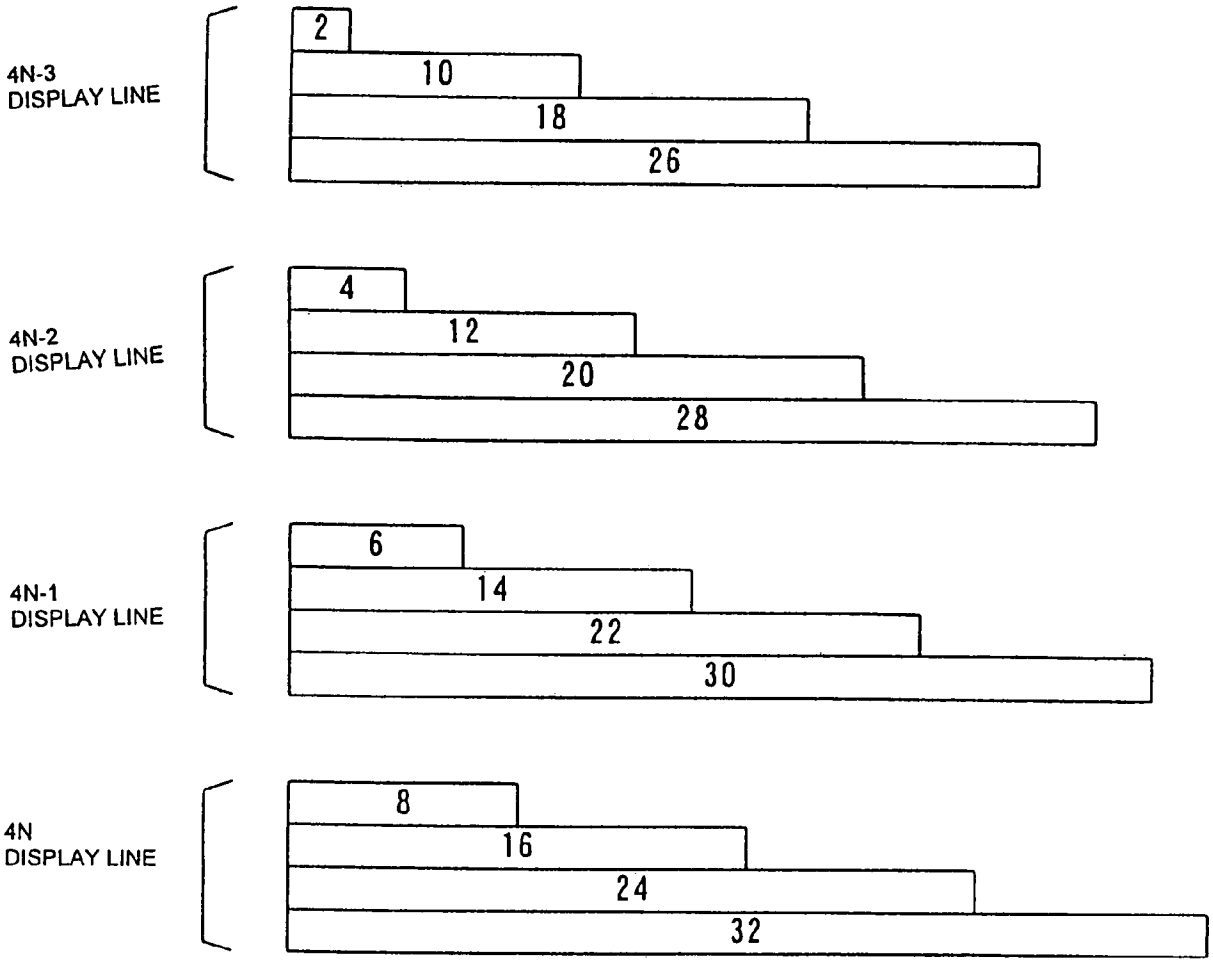
FIG. 8 is a diagram schematically showing the luminance levels covering four tones to be represented, respectively, by four discharge cells vertically adjacent to one another in a screen.
Figure 9:
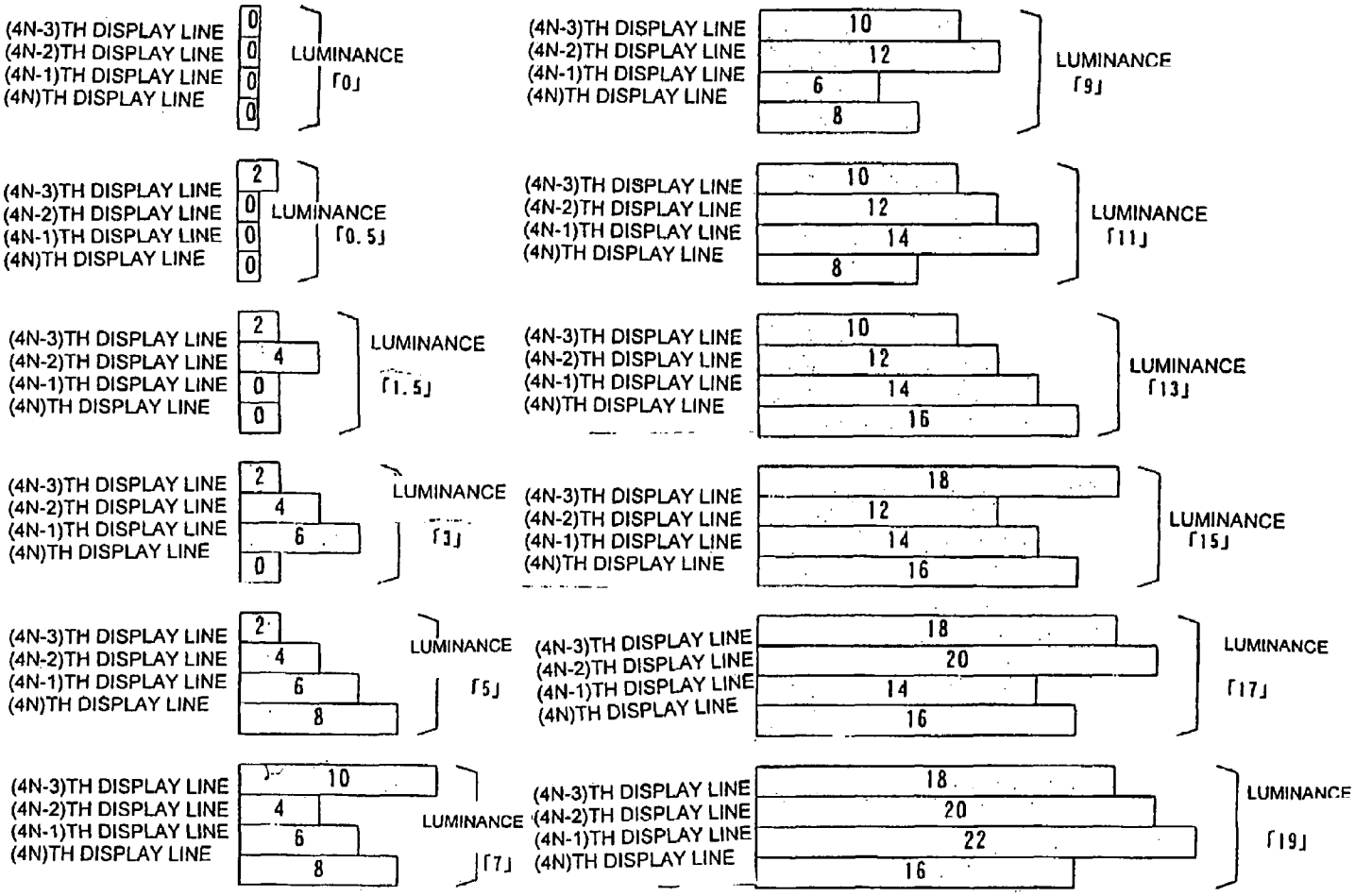
FIG. 9 is a diagram schematically showing the light emission luminance patterns of four discharge cells vertically adjacent to one another in a screen, and the luminance levels to be represented on an light emission luminance pattern basis.
Figure 10:
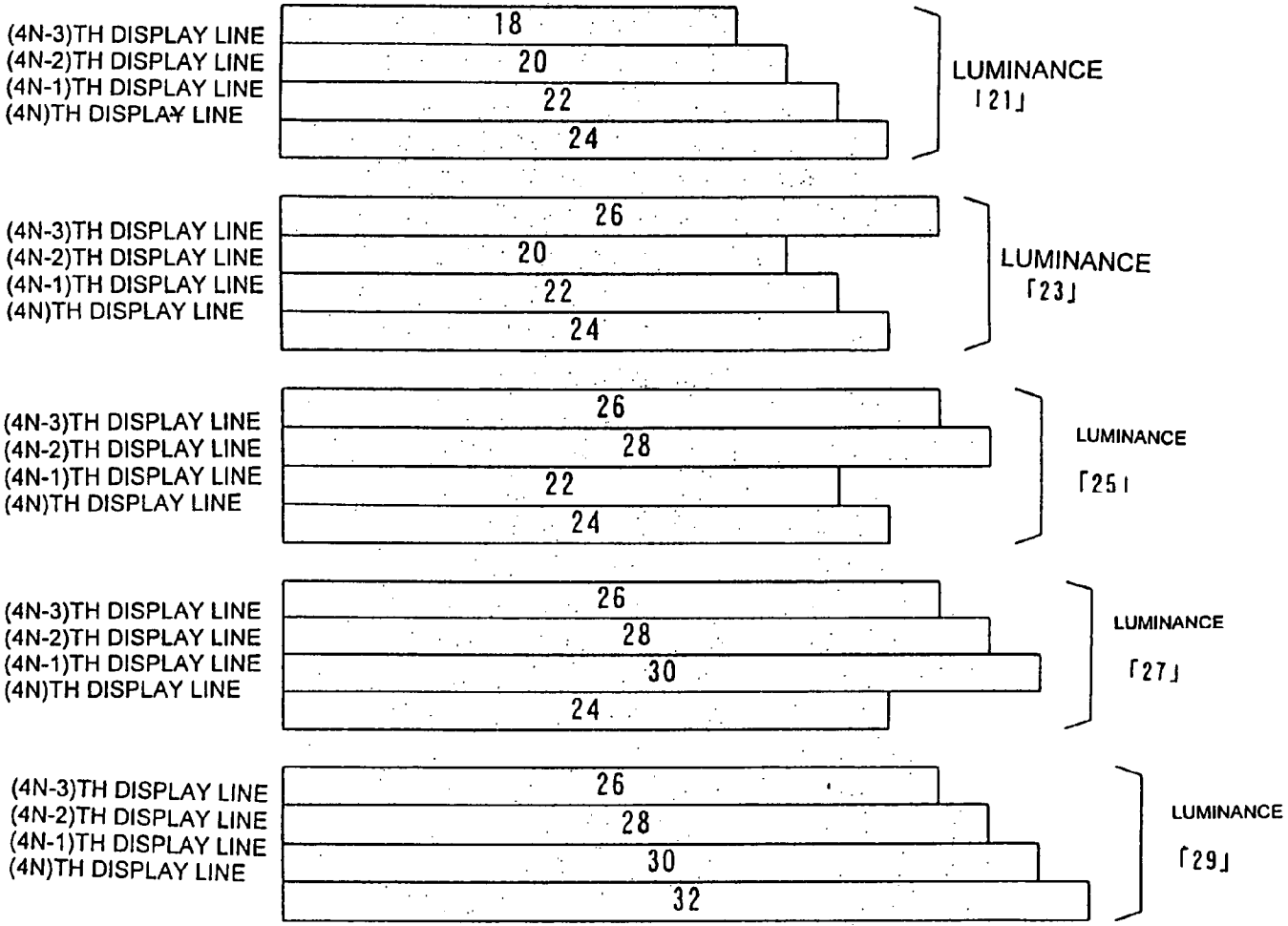
FIG. 10 is a diagram schematically showing the light emission luminance patterns of four discharge cells vertically adjacent to one another in a screen, and the luminance levels to be represented on an light emission luminance pattern basis.

As described in the foregoing, in such a plasma display device as shown in FIG. 3, for each of the (4N−3)th display lines, the (4N−2)th display lines, the (4N−1)th display lines, and the (4N)th display lines of the PDP 100, light emission driving is so applied as to represent each different four luminance levels as shown in FIG. 8. Here, in view of four discharge cells G vertically adjacent to one another in a screen as a unit, perceived are 17 intermediate luminance levels as shown in FIGS. 9 and 10 in accordance with an average value of the luminance levels represented for every discharge cell G in a single unit. At this time, the luminance levels to be represented by the vertically-adjacent four discharge cells G in a screen are all varied. Thus, even if the line offset data LD serving as the dither coefficient is added to the pixel data corresponding to each of these four discharge cells G, dither patterns can be preferably prevented from occurring.

Figure 11:
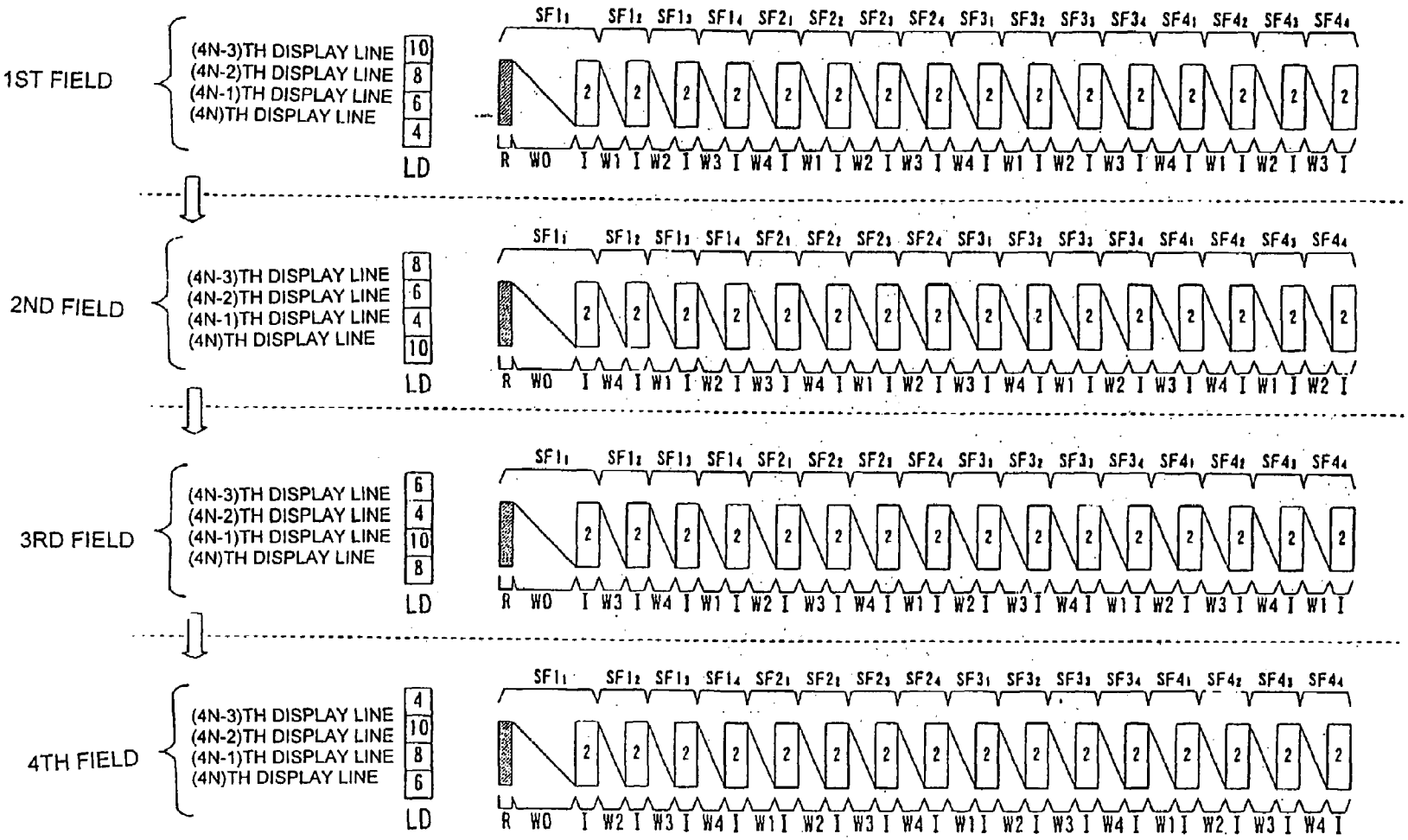
FIG. 11 is a diagram showing exemplary line offset data LD and light emission driving sequences at the time of driving the PDP 100 through change of line offset data LD and light emission driving sequences on a field basis.

In the above embodiment, the line offset data LD being "10", "8", "6", and "4" are assigned, for addition, to pixel data PD corresponding to the (4N−3)th display lines, the (4N−2)th display lines, the (4N−1)th display lines, and the (4N)th display lines. This is not surely restrictive, and such assignment may be made on a field basis as shown in FIG. 11.

That is, in the 1st field, added is the line offset data LD as follows:

"10" to pixel data PD corresponding to (4N−3)th display lines,

"8" to pixel data PD corresponding to (4N−2)th display lines,

"6" to pixel data PD corresponding to (4N−1)th display lines, and

"4" to pixel data PD corresponding to (4N)th display lines.

In the 2nd field, added is the line offset data LD as follows:

"8" to pixel data PD corresponding to (4N−3)th display lines,

"6" to pixel data PD corresponding to (4N−2)th display lines,

"4" to pixel data PD corresponding to (4N−1)th display lines, and

"10" to pixel data PD corresponding to (4N)th display lines.

In the 3rd field, added is the line offset data LD as follows:

"6" to pixel data PD corresponding to (4N−3)th display lines,

"4" to pixel data PD corresponding to (4N−2)th display lines,

"10" to pixel data PD corresponding to (4N−1)th display lines, and

"8" to pixel data PD corresponding to (4N)th display lines.

Then in the 4th field, added is the line offset data LD as follows:

"4" to pixel data PD corresponding to (4N−3)th display lines,

"10" to pixel data PD corresponding to (4N−2)th display lines,

"8" to pixel data PD corresponding to (4N−1)th display lines, and

"6" to pixel data PD corresponding to (4N)th display lines.

Further, in response to such assignment change of the line offset data LD, as shown in FIG. 11, the light emission driving sequence to be adopted is changed for the 1st to 4th fields. Specifically, in the 1st field, executed is driving in accordance with such an light emission driving sequence as shown in FIG. 5. In the 2nd to 4th fields, the address process is changed in execution order in the subfields $SF1_2$ to $SF1_4$, $SF2_1$ to $SF2_4$, $SF3_1$ to $SF3_4$, and $SF4_1$ to $SF4_4$ shown in FIG. 5.

For example, in the 2nd field, executed in the subfield $SF1_1$ is the address process W0 to every display line similarly to the light emission driving sequence shown in FIG. 5. In the subfields $SF2_1$, $SF3_1$, and $SF4_1$, executed is the address process W3 to the (4N−1)th display lines, in the subfields $SF1_2$, $SF2_2$, $SF3_2$, and $SF4_2$, executed is the address process W4 to the (4N)th display lines, in the subfields $SF1_3$, $SF2_3$, $SF3_3$, and $SF4_3$, executed is the address process W1 to the (4N−3)th display lines, and in the subfields $SF1_4$, $SF2_4$, $SF3_4$, and $SF4_4$, executed is the address process W2 to the (4N−2)th display lines.

In the 3rd field, executed in the subfield $SF1_1$ is the address process W0 to every display line similarly to the light emission driving sequence shown in FIG. 5. In the subfields $SF2_1$, $SF3_1$, and $SF4_1$, executed is the address process W2 to the (4N−2)th display lines, in the subfields $SF1_2$, $SF2_2$, $SF3_2$, and $SF4_2$, executed is the address process W3 to the (4N−1)th display lines, in the subfields $SF1_3$, $SF2_3$, $SF3_3$, and $SF4_3$, executed is the address process W4 to the (4N)th display lines, and in the subfields $SF1_4$, $SF2_4$, $SF3_4$, and $SF4_4$, executed is the address process W1 to the (4N−3)th display lines.

Also, in the 4th field, executed in the subfield $SF1_1$ is the address process W0 to every display line similarly to the light emission driving sequence shown in FIG. 5. In the subfields $SF2_1$, $SF3_1$, and $SF4_1$, executed is the address process W1 to the (4N−3)th display lines, in the subfields $SF1_2$, $SF2_2$, $SF3_2$, and $SF4_2$, executed is the address process W2 to the (4N−2)th display lines, in the subfields $SF1_3$, $SF2_3$, $SF3_3$, and $SF4_3$, executed is the address process W3 to the (4N−1)th display lines, and in the subfields $SF1_4$, $SF2_4$, $SF3_4$, and $SF4_4$, executed is the address process W4 to the (4N)th display lines.

Figure 12:
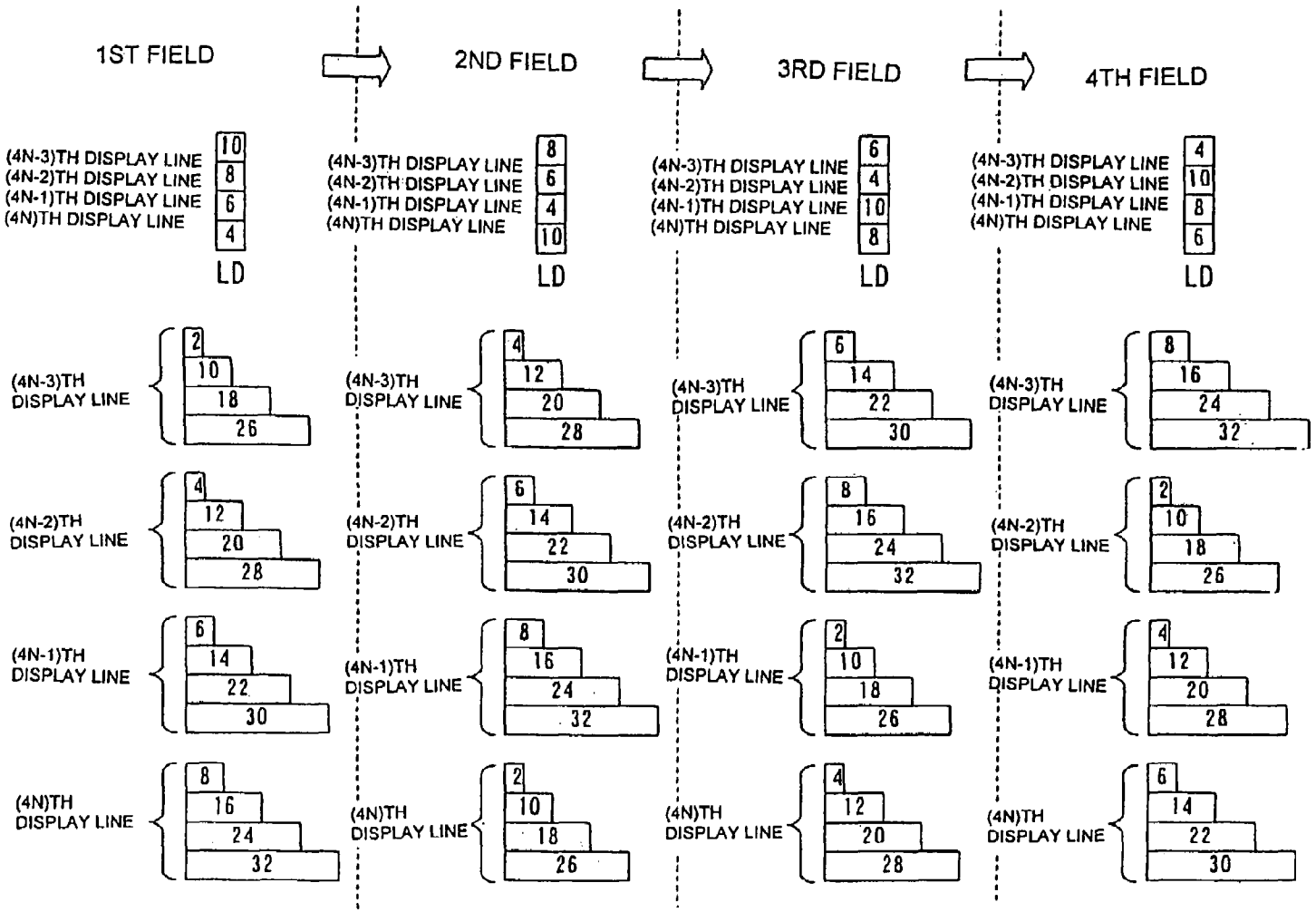
FIG. 12 is a diagram schematically showing, on a field basis, the luminance levels covering four tones to be represented, respectively, by four discharge cells vertically adjacent to one another in a screen at the time of driving shown in FIG. 11.

With such driving, the (4N−3)th display lines, the (4N−2)th display lines, the (4N−1)th display lines, and the (4N)th display lines vary in luminance levels of 4 stages on a field basis as shown in FIG. 12. Accordingly, this considerably reduces the dithering pattern from occurring.

Figure 13:
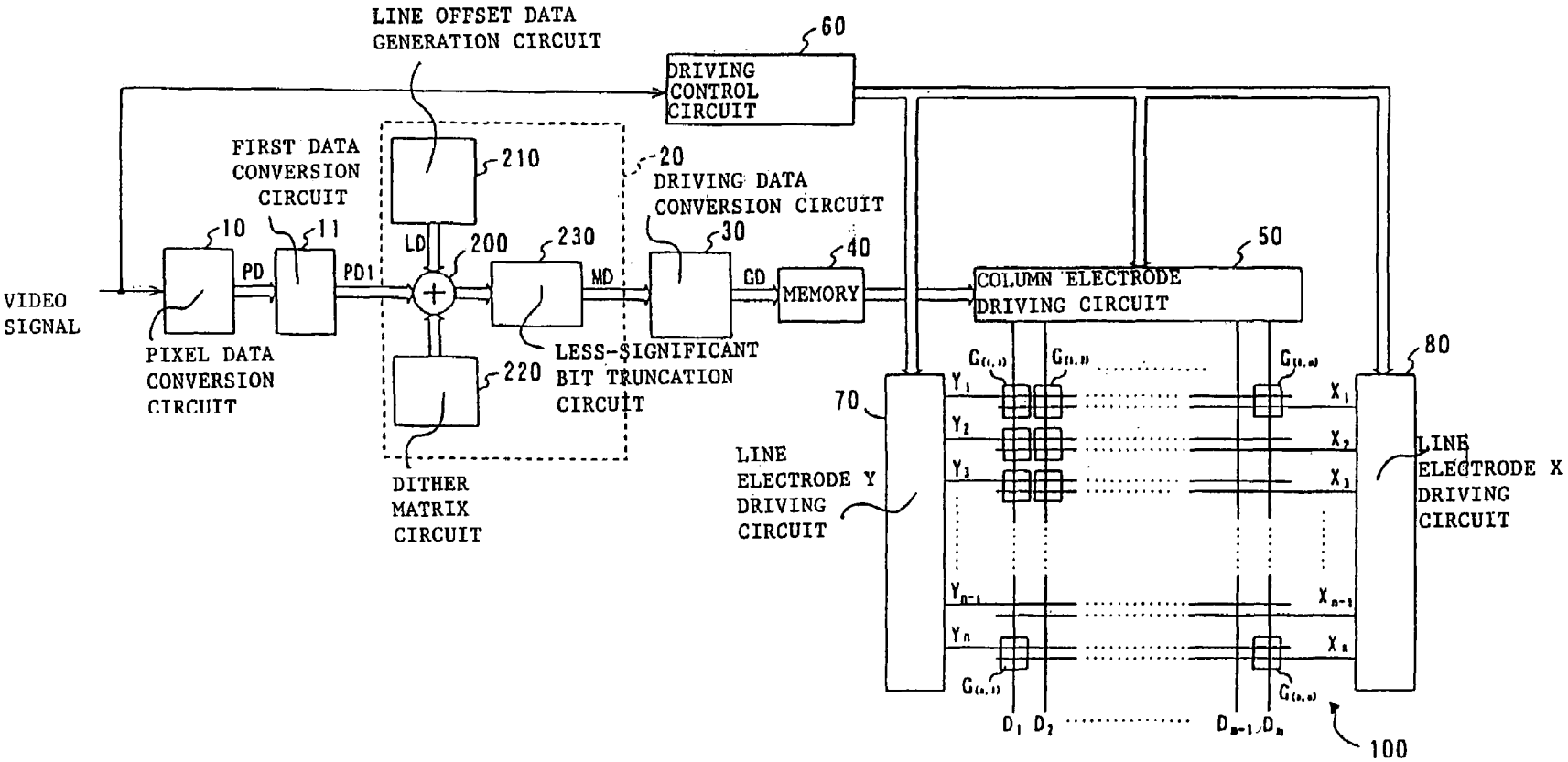
FIG. 13 is a diagram showing the structure of a plasma display device as a display device of another embodiment of the present invention.

FIG. 13 is a diagram showing the schematic structure of a plasma display device according to another embodiment of the present invention.

In FIG. 13, the PDP 100 being a plasma display panel includes a front substrate (not shown) serving as a display plane and a rear substrate (not shown) opposing to the front substrate with a discharge-gas-filled discharge space therebetween. The front substrate is formed with strip-shaped row electrodes $X_1$ to $X_n$ and $Y_1$ to $Y_n$ arranged alternately and parallel with one another. Formed on the rear substrate are strip-shaped column electrodes $D_1$ to $D_m$ intersected on the row electrodes $X_1$ to $X_n$ and $Y_1$ to $Y_n$. Herein, as to the row electrodes $X_1$ to $X_n$ and $Y_1$ to $Y_n$, each pair of row electrodes X and Y serves as a display line of the PDP 100, from 1st to nth. At an intersection part (discharge space included) of a pair of row electrode and column electrode, formed is a discharge cell G serving as a pixel. That is, the PDP 100 includes (n×m) discharge cells $G_{(1,\ 1)}$ to $G_{(n,\ m)}$ formed in a matrix.

Figure 14:
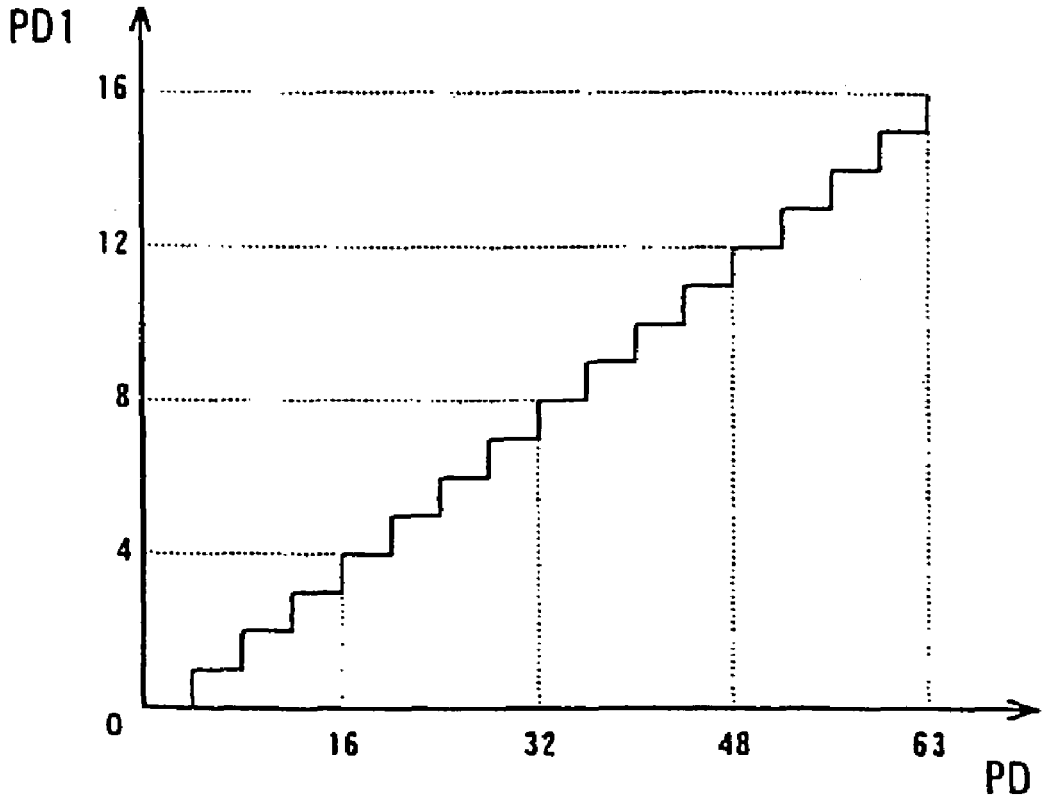
FIG. 14 is a diagram showing data conversion characteristics of a first data conversion circuit 11 of FIG. 13.

A pixel data conversion circuit 10 converts an input video signal into pixel data PD on a pixel basis, for example pixel data of six bits. Then, the resulting data is supplied to a first data conversion circuit 11, which converts the pixel data PD into first conversion pixel data PD1 of five bits in accordance with such conversion characteristics as shown in FIG. 14. The resulting data is supplied to a multi-grayscale processing circuit 20. Note here that, in FIG. 14, the pixel data PD and the first conversion pixel data PD1 are each represented by decimal numeral.

The multi-grayscale processing circuit 20 is constituted by an adder 200, a line offset data generation circuit 210, a dither matrix circuit 220, and a less-significant bit truncation circuit 230.

When the first data conversion circuit 11 outputs first conversion pixel data PD1 corresponding to the (4N−3)th display lines [N: natural number of (¼)·n or smaller] of the PDP 100, the line offset data generation circuit 210 generates line offset data LD representing "3" (decimal numeral). Thus generated data is supplied to the adder 200. Similarly, when the first data conversion circuit 11 outputs first conversion pixel data PD1 corresponding to the (4N−2)th display lines, the line offset data generation circuit 210 generates line offset data LD representing "2" (decimal numeral) for supply to the adder 200. When the first data conversion circuit 11 outputs first conversion pixel data PD1 corresponding to the (4N−1)th display lines, the line offset data generation circuit 210 generates line offset data LD representing "1" (decimal numeral) for supply to the adder 200. Further, when the first data conversion circuit 11 outputs first.conversion pixel data PD1 corresponding to the (4N)th display lines, the line offset data generation circuit 210 generates line offset data LD representing "0" (decimal numeral) for supply to the adder 200.

Figure 15:
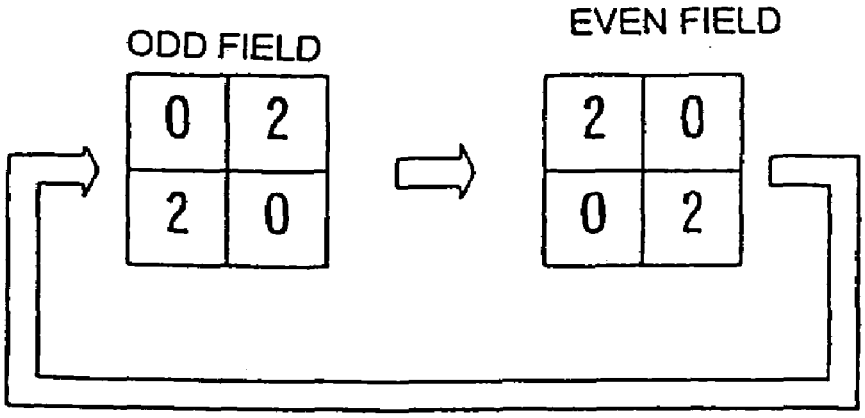
FIG. 15 is a diagram showing an exemplary dither coefficient to be occurred in a dither matrix circuit 220 of FIG. 13.

On the basis of each pixel group constituted by four pixels adjacent to one another in the vertical and lateral directions of the screen, the dither matrix circuit 220 generates a dither coefficient of "0" or "2" (decimal numeral) as shown in FIG. 15 for each pixel in the pixel group. The resulting dither coefficients are provided to the adder 200. Herein, the dither matrix circuit 220 changes such dither coefficient assignment for each pixel in the pixel group on a field basis as shown in FIG. 15.

The adder 200 adds the dither coefficient to the first conversion pixel data PD1 of five bits provided by the first data conversion circuit 11, deriving dither-added pixel data. To the dither-added pixel data, the adder 200 adds the line offset data LD for supply to the less-significant bit truncation circuit 230.

The less-significant bit truncation circuit 230 truncates two less-significant bits of the dither-added pixel data having added with the line offset data LD, and the remaining three significant bits are provided to a driving data conversion circuit 30 as multi-grayscale pixel data MD.

The driving data conversion circuit 30 converts the multi-grayscale pixel data MD into pixel driving data GD of five bits in accordance with a data conversion table shown in FIG. 16. The resulting data is supplied to memory 40.

The memory 40 sequentially receives and stores the pixel driving data GD of five bits. Every time completing writing of pixel driving data $GD_{1,1}$ to $GD_{n,m}$ of an image frame (n lines×m columns), the memory 40 separates each of the pixel driving data $GD_{1,1}$ to $GD_{n,m}$ on a bit digit (1st to 5th bits) basis. Then, the memory 40 performs reading on a display line basis corresponding to subfields SF1 to SF4, which will be described later. The memory 40 then supplies, to a column electrode driving circuit 50, the pixel driving data bits of thus read one display line (m bits) as pixel driving data bits DB1 to DB(m). To be more specific, first in a subfield $SF1_1$, the memory 40 reads only the 1st bit of the pixel driving data $GD_{1,1}$ to $GD_{n,m}$ for every display line. Thus read results are supplied to the column electrode driving circuit 50 as pixel driving data bits DB1 to DB(m). Then, in subfields $SF1_2$ to $SF2_1$, the memory 40 reads only the 2nd bit of the pixel driving data $GD_{1,1}$ to $GD_{n,m}$ for every display line, and thus read results are supplied to the column electrode driving circuit 50 as the pixel driving data bits DB1 to DB(m). Next, in subfields $SF2_2$ to $SF3_1$, the memory 40 reads only the 3rd bit of the pixel driving data $GD_{1,1}$ to $GD_{n,m}$ for every display line, and thus read results are supplied to the column electrode driving circuit 50 as the pixel driving data bits DB1 to DB(m). Then, in subfields $SF3_2$ to $SF4_1$, the memory 40 reads only the 4th bit of the pixel driving data $GD_{1,1}$, to $GD_{n,m}$ for every display line, and thus read results are supplied to the column electrode driving circuit 50 as the pixel driving data bits DB1 to DB(m). And, in subfields $SF4_2$ to $SF4_{41}$ the memory 40 reads only the 5th bit of the pixel driving data $GD_{1,1}$ to $GD_{n,m}$ for every display line, and thus read results are supplied to the column electrode driving circuit 50 as the pixel driving data bits DB1 to DB(m).

Figure 17:
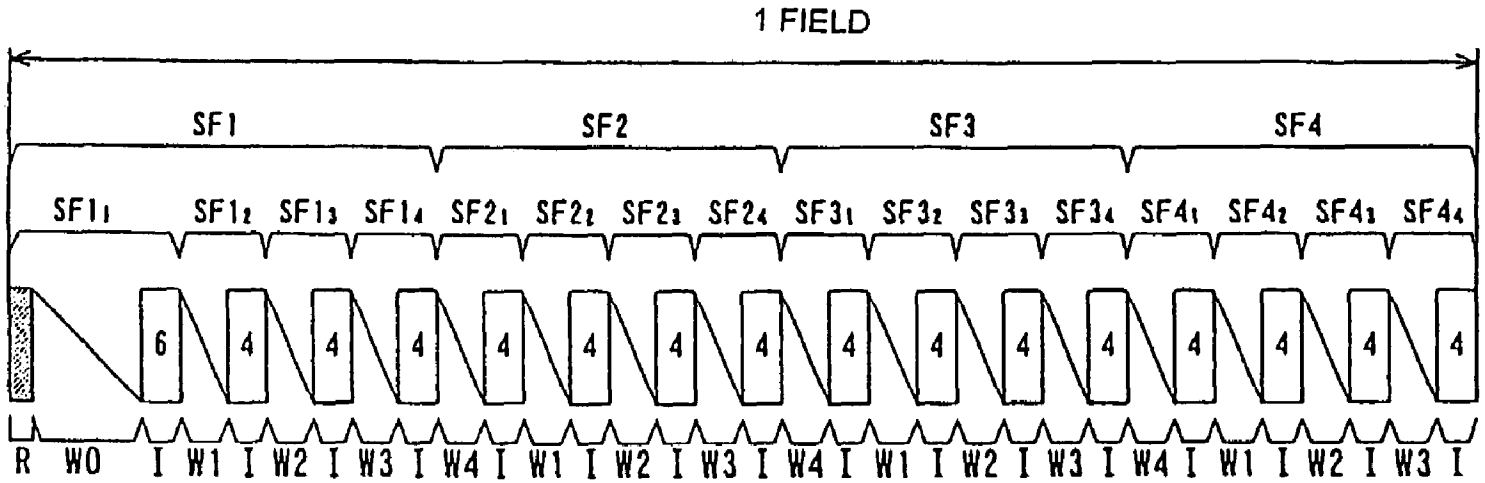
FIG. 17 is a diagram showing an exemplary light emission driving sequence at the time of driving the PDP 100 with the selective deletion address method adopted.

In accordance with such an light emission driving sequence as shown in FIG. 17 based on the subfield method, a driving control circuit 60 supplies various timing signals for tone-driving the PDP 100 to the column electrode driving circuit 50, a row electrode Y driving circuit 70, and a row electrode X driving circuit 80.

In the light emission driving sequence of FIG. 17, the display period of a field is divided into the subfields SF1 to SF4, and for each of the subfields, various driving processes as below are carried out. Note here that, the subfields SF1 to SF4 are constituted by, respectively, four subfields of $SF1_1$ to $SF1_4$, $SF2_1$ to $SF2_4$, $SF3_1$ to $SF3_4$, $SF4_1$ to $SF4_4$ as shown in FIG. 17.

First, in the first subfield $SF1_1$, a reset process R, an address process W0, and a sustain process I are carried out. Specifically, in the reset process R, every discharge cell of the PDP 100 is initiated to be in a lighting mode (state of predetermined wall charge being formed). In the address process W0, the discharge cells are selectively shifted to be in an extinction mode (state of wall charge being eliminated) with respect to every display line depending on the pixel driving data. And in the sustain process I, only the discharge cells in the lighting mode are discharged for light emission continuously over the period of "6".

In each of the subfields $SF2_1$, $SF3_1$, and $SF4_1$, an address process W4 and the sustain process I are carried out. Specifically, in the address process W4, the discharge cells belonging to the (4N)th display lines are selectively shifted to the extinction mode depending on the pixel driving data. In the sustain process I, only the discharge cells in the lighting mode are discharged for light emission continuously over the period of "4".

In each of the subfields $SF1_2$, $SF2_2$, $SF3_2$, and $SF4_2$, carried out are an address process W1 and the sustain process I. Specifically, in the address process W1, the discharge cells belonging to the (4N−3)th display lines are selectively shifted to the extinction mode depending on the pixel driving data. In the sustain process I, only the discharge cells in the lighting mode are discharged for light emission continuously over the period of "4".

In each of the subfields $SF1_3$, $SF2_3$, $SF3_3$, and $SF4_3$, carried out are an address process W2 and the sustain process I. Specifically, in the address process W2, the discharge cells belonging to the (4N−2)th display lines are selectively shifted to the extinction mode depending on the pixel driving data. In the sustain process I, only the discharge cells in the lighting mode are discharged for light emission continuously over the period of "4".

In each of the subfields $SF1_4$, $SF2_4$, $SF3_4$, and $SF4_4$, carried out are an address process W3 and the sustain process I. Specifically, in the address process W3, the discharge cells belonging to the (4N−1)th display lines are selectively shifted to the extinction mode depending on the pixel driving data. In the sustain process I, only the discharge cells in the lighting mode are discharged for light emission continuously over the period of "4".

Figure 18:
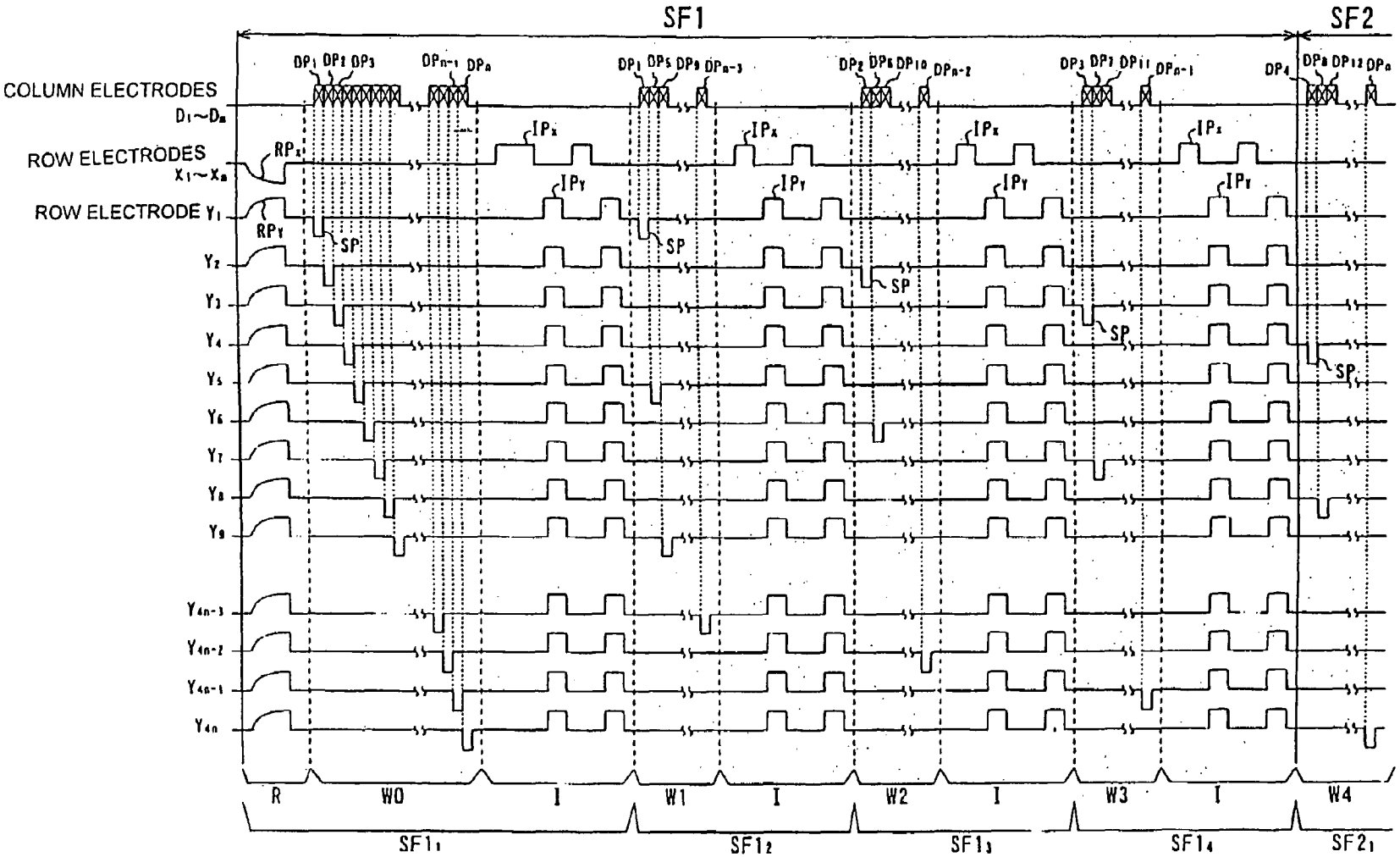
FIG. 18 is a diagram showing various driving pulses to be applied to the PDP 100 and their application timings in subfields SF0 and SF$\mathbf{1}_1$ to SF$\mathbf{1}_4$, in accordance with the light emission driving sequence of FIG. 17.

FIG. 18 is a diagram showing various driving pulses to be applied to the PDP 100, and their application timings in accordance with such an light emission driving sequence. Such application is made by the column electrode driving circuit 50, the row electrode Y driving circuit 70, and the row electrode X driving circuit 80. Here, in the subfields $SF2_1$, $SF3_1$, and $SF4_1$, the various driving pulses to be applied to the PDP 100 and their application timings are all the same. In the subfields $SF1_2$, $SF2_2$, $SF3_2$, and $SF4_2$, the various driving pulses to be applied to the PDP 100 and their application timings are all the same. In the subfields $SF1_3$, $SF2_3$, $SF3_3$, and $SF4_3$, the various driving pulses to be applied to the PDP 100 and their application timings are all the same. Further, in the subfields $SF1_4$, $SF2_4$, $SF3_4$, and $SF4_4$, the various driving pulses to be applied to the PDP 100 and their application timings are all the same. Therefore, FIG. 18 shows only the subfield $SF1_1$ to the address process W4 in the subfield $SF2_1$.

First in the reset process R in the subfield $SF1_1$, the row electrode X driving circuit 80 generates a negative reset pulse $RP_x$ showing mild falling edge change. Thus generated pulse is applied to the row electrodes $X_1$ to $X_n$ of the PDP 100. At the same time as such a reset pulse $RP_x$, the row electrode Y driving circuit 70 generates a positive reset pulse $RP_y$ showing mild rising edge change for application to the row electrodes $Y_1$ to $Y_n$ of the PDP 100. Such simultaneous application of the reset pulses $RP_x$ and $RP_y$ responsively causes reset discharge to occur to every discharge cell of the PDP 100, resultantly forming wall charge in each of the discharge cells. In this manner, all of the discharge cells are initiated to be in the lighting mode, being emissive state (light emission responding to sustain discharge) in the sustain process I (described below).

Next, in the address process W0 in the subfield $SF1_1$, the row electrode Y driving circuit 70 sequentially applies a negative scanning pulse SP to the row electrodes $Y_1$ to $Y_n$. During this time, the column electrode driving circuit 50 generates m pixel data pulses for a display line corresponding to pixel driving data bits DB1 to DB(m) read from the memory 40. Then, a pixel data pulse group DP consisted of thus generated m pixel data pulses is applied to the column electrodes $D_1$ to $D_m$, respectively, in synchronization with the scanning pulse SP. That is, as shown in FIG. 18, sequentially applied to the column electrodes $D_1$ to $D_m$ are pixel data pulse groups $DP_1$ to $DP_n$ corresponding to the 1st to nth display lines of the PDP 100, respectively. Here, the pixel data pulse generated by the column electrode driving circuit 50 is high in voltage when the pixel driving data bit DB is in the logic level 1, and when in the logic level 0, the pixel data pulse will be low in voltage. At this time, erasure addressing discharge occurs only to the discharge cells locating at intersections of the display lines and the column electrodes. Here, the display lines are those having applied with the scanning pulse SP, and the column electrodes are those having applied with the pixel data pulse of high voltage. Through such erasure addressing discharge, the wall charge so far formed in the discharge cells is eliminated, and the resulting discharge cells shift into the extinction mode, being non-emissive state (light emission responding to sustain discharge) in the sustain process I (described below). On the other hand, no such erasure addressing discharge occurs to the discharge cells having applied with the scanning pulse SP with the pixel data pulse but of low voltage, and thus the mode immediately before (lighting or extinction mode) is sustained.

That is, in the address process W0, all of the discharge cells of the PDP 100 are selectively put to cause erasure addressing discharge based on the pixel data. In this manner, the discharge cells are each set to be in either the lighting mode or the extinction mode.

Next, in the sustain process I in the subfield SF1$_1$, the row electrode X driving circuit 80 and the row electrode Y driving circuit 70 alternately apply positive sustain pulses $IP_x$ and $IP_y$ repeatedly for a predetermined number of times to the row electrodes $X_1$ to $X_n$ and $Y_1$ to $Y_n$ as shown in FIG. 18. At this time, in response to every application of the sustain pulses $IP_x$ and $IP_y$, sustain discharge occurs only to the discharge cells with the wall charge remained therein, i.e., the discharge cells set to be in the lighting mode. Those discharge cells sustain the light emission state resulting from such sustain discharge. To be more specific, only the discharge cells sustaining the state of the lighting mode without erasure addressing discharge occurring in the address process W0 in the subfield SF1$_1$ emit in the sustain process I over the predetermined period of "6".

Then, in the address process W1 in the subfield SF1$_2$, the row electrode Y driving circuit 70 sequentially applies a negative scanning pulse SP to any row electrode Y belonging to the (4N−3)th display lines [N: 1 to (¼)·n] of the PDP 100, i.e., the row electrodes $Y_1, Y_5, Y_9, \ldots, Y_{(n-3)}$. During this time, the column electrode driving circuit 50 generates m pixel data pulses for a display line corresponding to the pixel driving data bits DB1 to DB(m) read from the memory 40. Then, the pixel data pulse group DP consisted of the resulting m pixel data pulses is applied to the column electrodes $D_1$ to $D_m$ in synchronization with the scanning pulse SP. At this time, in the subfield SF1$_2$, read from the memory 40 is the pixel driving data bit DB corresponding to the (4N−3)th display lines of the PDP 100. Accordingly, the column electrode driving circuit 50 sequentially applies the pixel data pulse groups $DP_1, DP_5, DP_9, \ldots, DP_{(n-3)}$ corresponding to the (4N−3)th display lines to the column electrodes $D_1$ to $D_m$ as shown in FIG. 18. Here, the pixel data pulse generated by the column electrode driving circuit 50 is high in voltage when the pixel driving data bit DB is in the logic level 1, and when in the logic level 0, the pixel data pulse will be low in voltage. At this time, erasure addressing discharge occurs only to the discharge cells locating at intersections of the display lines and the column electrodes. Here, the display lines are those having applied with the scanning pulse SP, and the column electrodes are those having applied with the pixel data pulse of high voltage. Through such erasure addressing discharge, the wall charge so far formed in the discharge cells is eliminated, and the resulting discharge cells shift into the extinction mode, being non-emissive state (light emission responding to sustain discharge) in the sustain process I (described below). On the other hand, no such erasure addressing discharge occurs to the discharge cells having applied with the scanning pulse SP and with the pixel data pulse but of low voltage, and thus the mode immediately before (lighting or extinction mode) is sustained.

That is, in the address process W1, only the discharge cells belonging to the (4N−3)th display lines of the PDP 100 are selectively put to cause erasure addressing discharge based on the pixel data. In this manner, the discharge cells are each set to be in either the lighting mode or the extinction mode.

Next, in the sustain process I in the subfield SF1$_2$, the row electrode X driving circuit 80 and the row electrode Y driving circuit 70 alternately apply positive sustain pulses $IP_x$ and $IP_y$ repeatedly for a predetermined number of times to the row electrodes $X_t$ to $X_n$ and $Y_1$ to $Y_n$ as shown in FIG. 18. At this time, in response to every application of the sustain pulses $IP_x$ and $IP_y$, sustain discharge occurs only to the discharge cells with the wall charge remained therein, i.e., the discharge cells set in the lighting mode. Those discharge cells sustain the light emission state resulting from such sustain discharge. To be more specific, only the discharge cells sustaining the state of the lighting mode without erasure addressing discharge occurring in the address processes W0 and W1 emit in the sustain process I over the predetermined period of "4".

Then, in the address process W2 in the subfield SF1$_3$, the row electrode Y driving circuit 70 sequentially applies a negative scanning pulse SP to any row electrode Y belonging to the (4N−2)th display lines [N: 1 to (¼)·n] of the PDP 100, i.e., the row electrodes $Y_2, Y_6, Y_{10}, \ldots, Y_{(n-2)}$. During this time, the column electrode driving circuit 50 generates m pixel data pulses for a display line corresponding to the pixel driving data bits DB1 to DB(m) read from the memory 40. Then, the pixel data pulse group DP consisted of the resulting m pixel data pulses is applied to the column electrodes $D_1$ to $D_m$ in synchronization with the scanning pulse SP. At this time, in the subfield SF1$_3$, read from the memory 40 is the pixel driving data bit DB corresponding to the (4N−2)th display lines of the PDP 100. Accordingly, the column electrode driving circuit 50 sequentially applies the pixel data pulse groups $DP_2, DP_6, DP_{10}, \ldots, DP_{(n-2)}$ corresponding to the (4N−2)th display lines to the column electrodes $D_1$ to $D_m$ as shown in FIG. 18. Here, the pixel data pulse generated by the column electrode driving circuit 50 is high in voltage when the pixel driving data bit DB is in the logic level 1, and when in the logic level 0, the pixel data pulse will be low in voltage. At this time, erasure addressing discharge occurs only to the discharge cells locating at intersections of the display lines and the column electrodes. Here, the display lines are those having applied with the scanning pulse SP, and the column electrodes are those having applied with the pixel data pulse of high voltage. Through such erasure addressing discharge, the wall charge so far formed in the discharge cells is eliminated, and the resulting discharge cells shift into the extinction mode. On the other hand, no such erasure addressing discharge occurs to the discharge cells having applied with the scanning pulse SP and with the pixel data pulse but of low voltage, and thus the mode immediately before (lighting or extinction mode) is sustained.

That is, in the address process W2, only the discharge cells belonging to the (4N−2)th display lines of the PDP 100 are selectively put to cause erasure addressing discharge based on the pixel data. In this manner, the discharge cells are each set to be in either the lighting mode or the extinction mode.

Next, in the sustain process I in the subfield SF1$_3$, the row electrode X driving circuit 80 and the row electrode Y driving circuit 70 alternately apply positive sustain pulses $IP_x$ and $IP_y$ repeatedly for a predetermined number of times to the row electrodes $X_1$ to $X_n$ and $Y_1$ to $Y_n$ as shown in FIG. 18. At this time, in response to every application of the sustain pulses $IP_x$ and $IP_y$, sustain discharge occurs only to the discharge cells with the wall charge remained therein, i.e., the discharge cells set in the lighting mode. Those discharge cells sustain the light emission state resulting from such sustain discharge. To be more specific, only the discharge cells sustaining the state of the lighting mode without erasure addressing discharge occurring in the address processes W0, W1, and W2 emit in the sustain process I over the predetermined period of "4".

Then, in the address process W3 in the subfield SF1$_4$, the row electrode Y driving circuit 70 sequentially applies a negative scanning pulse SP to any row electrode Y belonging to the (4N−1)th display lines [N: 1 to (¼)·n] of the PDP 100, i.e., the row electrodes $Y_3$, $Y_7$, $Y_{11}$, . . . , $Y_{(n-1)}$. During this time, the column electrode driving circuit 50 generates m pixel data pulses for a display line corresponding to the pixel driving data bits DB1 to DB(m) read from the memory 40. Then, the pixel data pulse group DP consisted of the resulting m pixel data pulses is applied to the column electrodes $D_1$ to $D_m$ in synchronization with the scanning pulse SP. At this time, in the subfield SF1$_4$, read from the memory 40 is the pixel driving data bit DB corresponding to the (4N−1)th display lines of the PDP 100. Accordingly, the column electrode driving circuit 50 sequentially applies the pixel data pulse groups $DP_3$, $DP_7$, $DP_{11}$, . . . , $DP_{(n-1)}$ corresponding to the (4N−1)th display lines to the column electrodes $D_1$ to $D_m$ in as shown in FIG. 18. Here, the pixel data pulse generated by the column electrode driving circuit 50 is high in voltage when the pixel driving data bit DB is in the logic level 1, and when in the logic level 0, the pixel data pulse will be low in voltage. At this time, erasure addressing discharge occurs only to the discharge cells locating at intersections of the display lines and the column electrodes. Here, the display lines are those having applied with the scanning pulse SP, and the column electrodes are those having applied with the pixel data pulse of high voltage. Through such erasure addressing discharge, the wall charge so far formed in the discharge cells is eliminated, and the resulting discharge cells shift into the extinction mode. On the other hand, no such erasure addressing discharge occurs to the discharge cells having applied with the scanning pulse SP and with the pixel data pulse but of low voltage, and thus the mode immediately before (lighting or extinction mode) is sustained.

That is, in the address process W3, only the discharge cells belonging to the (4N−1)th display lines of the PDP 100 are selectively put to cause erasure addressing discharge based on the pixel data. In this manner, the discharge cells are each set to be in either the lighting mode or the extinction mode.

Next, in the sustain process I in the subfield SF1$_4$, the row electrode X driving circuit 80 and the row electrode Y driving circuit 70 alternately apply positive sustain pulses $IP_x$ and $IP_y$ repeatedly for a predetermined number of times to the row electrodes $X_1$ to $X_n$ and $Y_1$ to $Y_n$ as shown in FIG. 18. At this time, in response to every application of the sustain pulses $IP_x$ and $IP_y$, sustain discharge occurs only to the discharge cells with the wall charge remained therein, i.e., the discharge cells set in the lighting mode. Those discharge cells sustain the light emission state resulting from such sustain discharge. To be more specific, only the discharge cells sustaining the state of the lighting mode without erasure addressing discharge occurring in the address processes W0, W1, W2, and W3 emit in the sustain process I over the predetermined period of "4".

Then, in the address process W4 in the subfield SF2$_1$, the row electrode Y driving circuit 70 sequentially applies a negative scanning pulse SP to any row electrode Y belonging to the (4N)th display lines [N: 1 to (¼)·n] of the PDP 100, i.e., the row electrodes $Y_4$, $Y_8$, $Y_{12}$, . . . , $Y_n$. During this time, the column electrode driving circuit 50 generates m pixel data pulses for a display line corresponding to the pixel driving data bits DB1 to DB(m) read from the memory 40. Then, the pixel data pulse group DP consisted of the resulting m pixel data pulses is applied to the column electrodes $D_1$ to $D_m$ in synchronization with the scanning pulse SP. At this time, in the subfield SF2$_1$, read from the memory 40 is the pixel driving data bit DB corresponding to the (4N)th display lines of the PDP 100. Accordingly, the column electrode driving circuit 50 sequentially applies the pixel data pulse groups $DP_4$, $DP_8$, $DP_{12}$, . . . , $DP_n$ corresponding to the (4N)th display lines to the column electrodes $D_1$ to $D_m$ as shown in FIG. 18. Here, the pixel data pulse generated by the column electrode driving circuit 50 is high in voltage when the pixel driving data bit DB is in the logic level 1, and when in the logic level 0, the pixel data pulse will be low in voltage. At this time, erasure addressing discharge occurs only to the discharge cells locating at intersections of the display lines and the column electrodes. Here, the display lines are those having applied with the scanning pulse SP, and the column electrodes are those having applied with the pixel data pulse of high voltage. Through such erasure addressing discharge, the wall charge so far formed in the discharge cells is eliminated, and the resulting discharge cells shift into the extinction mode. On the other hand, no such erasure addressing discharge occurs to the discharge cells having applied with the scanning pulse SP and with the pixel data pulse but of low voltage, and thus the mode immediately before (lighting or extinction mode) is sustained.

That is, in the address process W4, only the discharge cells belonging to the (4N)th display lines of the PDP 100 are selectively put to cause erasure addressing discharge based on the pixel data. In this manner, the discharge cells are each set to be in either the lighting mode or the extinction mode.

Next, in the sustain process I (not shown) in the subfield SF2$_1$, the row electrode X driving circuit 80 and the row electrode Y driving circuit 70 alternately apply positive sustain pulses $IP_x$ and $IP_y$ repeatedly for a predetermined number of times to the row.electrodes $X_1$ to $X_n$ and $Y_1$ to $Y_n$. At this time, in response to every application of the sustain pulses $IP_x$ and $IP_y$, sustain discharge occurs only to the discharge cells with the wall charge remained therein, i.e., the discharge cells set in the lighting mode. Those discharge cells sustain the light emission state resulting from such sustain discharge. To be more specific, only the discharge cells sustaining the state of the lighting mode without erasure addressing discharge occurring in the address processes W0, W1, W2, W3, and W4 emit in the sustain process I over the predetermined period of "4".

By going through such driving, among the subfields SF1 to SF4, only the reset process R in the first subfield SF1 allows the discharge cells to shift from the extinction mode to the lighting mode. In other words, once the discharge cells are set to be in the extinction mode responding to the erasure addressing discharge occurring in each first subfield, the discharge cells are not allowed to be in the lighting mode again in the following subfields. Thus, by going through driving based on 5 pixel driving data GD as shown in FIG. 16, the discharge cells are set to be in the lighting mode in the sequential subfields by the corresponding luminance to be represented. Then, until erasure addressing discharge occurs (indicated by black dots), sustain discharge light emission (indicated by white dots) occurs continually in the sustain process I in the respective subfields. During this time, perceived is the intermediate luminance corresponding to the total light emission duration in one field period caused by such sustain discharge light emission.

Here, with driving shown in FIGS. 17 and 18, the discharge cells belonging to four display lines vertically adjacent to one another in the screen of the PDP 100, i.e., for each of these discharge cells belonging to (4N−3)th display lines, discharge cells belonging to (4N−2)th display lines, discharge cells belonging to (4N−1)th display lines, and discharge cells belonging to (4N)th display lines, the total light emission duration differs in each field period responding to the driving according to the pixel driving data GD.

Taking pixel driving data GD of [00100] of FIG. 16 as an example, the discharge cells belonging to the (4N−3)th display lines, i.e., 1st, 5th, 9th, . . . , and (n−3)th display lines, are put to cause sustain discharge for light emission in the sustain processes I of the subfields $SF1_1$ to $SF1_4$, and $SF2_1$ as indicated by white dots. The discharge cells belonging to the (4N−2)th display lines, i.e., 2nd, 6th, 10 th, . . . , and (n−2)th display lines, are put to cause sustain discharge for light emission in the sustain processes I of the subfields $SF1_1$ to $SF1_4$, $SF2_1$, and $SF2_2$. The discharge cells belonging to the (4N−1)th display lines, i.e., 3rd, 7th, 11th, . . . , and (n−1)th display lines, are put to cause sustain discharge for light emission in the sustain processes I of the subfields $SF1_1$ to $SF1_4$, and $SF2_1$ to $SF2_3$. Further, the discharge cells belonging to the (4N)th display lines, i.e., 4th, 8th, 12th, . . . , and nth display lines, are put to cause sustain discharge for light emission in the sustain processes I of the subfields $SF1_1$ to $SF1_4$, and $SF2_1$ to $SF2_4$.

Therefore, assuming that the light emission duration in the sustain processes I of the subfield $SF1_1$ is "6", and the light emission duration in the sustain processes I of other subfields is "4", the total light emission duration in one field period caused by sustain discharge light emission occurred responding to the pixel driving data GD of [00100] will be as follows, as shown in FIG. 16, discharge cells belonging to (4N−3)th display lines: "22", discharge cells belonging to (4N−2)th display lines: "26", discharge cells belonging to (4N−1)th display lines: "30", and discharge cells belonging to (4N)th display lines: "34".

Similarly, the total light emission duration in one field period caused by sustain discharge light emission occurred responding to the pixel driving data GD of [01000] will be as follows, as shown in FIG. 16, discharge cells belonging to (4N−3)th display lines: "6", discharge cells belonging to (4N−2)th display lines: "1", discharge cells belonging to (4N−1)th display lines: "14", and discharge cells belonging to (4N)th display lines: "18".

That is, four adjacent display lines are driven in each different manner to vary the total light emission duration on a field period basis.

Note here that, with such driving, for the purpose of equalizing the average luminance level for four discharge cells vertically adjacent to one another in the screen, dither-added pixel data derived by adding a dither coefficient to the pixel data PD is added with the line offset data LD.

Figure 19:
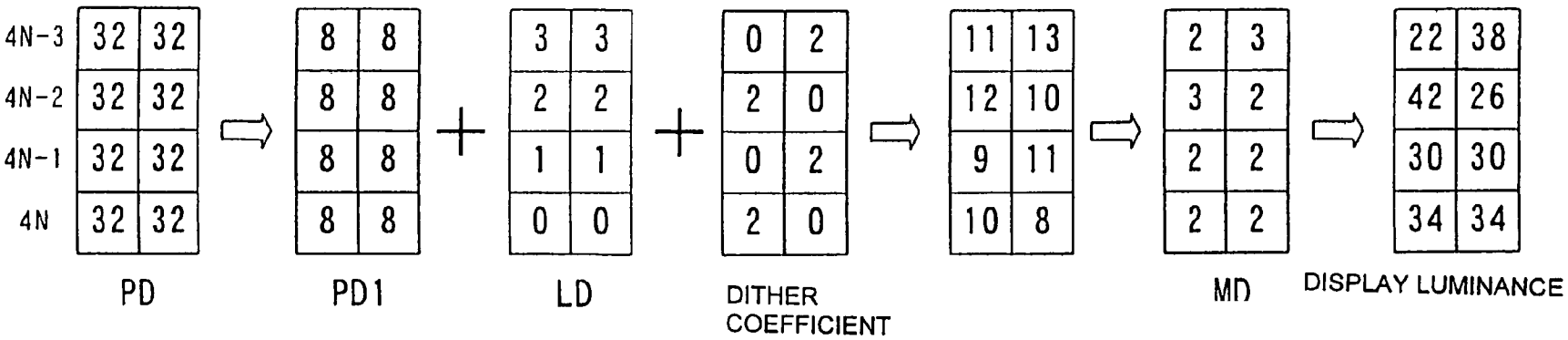
FIG. 19 is a diagram showing the operation for driving the plasma display device of FIG. 13 with the selective deletion address method adopted when pixel data PD each corresponding to eight adjacent discharge cells all representing the luminance level of "32"

For example, assuming here that pixel data PD corresponding, respectively, to discharge cells $G_{(1,1)}$, $G_{(2,1)}$, $G_{(3,1)}$, and $G_{(4,1)}$ vertically adjacent to one another in the screen of the PDP 100, and discharge cells $G_{(1,2)}$, $G_{(2,2)}$, $G_{(3,2)}$, $G_{(4,2)}$ locating thereright all are six-bit data representing "32" (decimal numeral) as shown in FIG. 19. First, the pixel data PD representing "32" is converted into first conversion pixel data PD1 of five bits representing "8" by the first data conversion circuit 11 with such conversion characteristics as shown in FIG. 14. Next, through addition of a dither coefficient of "0" or "2", and the line offset data LD of "3", "2", "1", and "0" as shown in FIG. 19 respectively to the first conversion pixel data PD1 corresponding to the discharge cells $G_{(1,1)}$, $G_{(2,1)}$, $G_{(3,1)}$, $G_{(4,1)}$, $G_{(1,2)}$, $G_{(2,2)}$, $G_{(3,2)}$, and $G_{(4,2)}$, derived are the addition results as dither-added pixel data of [010011] representing "11", dither-added pixel data of [01100] representing "12", dither-added pixel data of [01001] representing "9", dither-added pixel data of [01010] representing "10", dither-added pixel data of [01101] representing "13", dither-added pixel data of [01010] representing "10", dither-added pixel data of [01011] representing "11", and dither-added pixel data of [01000] representing "8".

Here, from each of the resulting dither-added pixel data, extracting three significant bits by truncating two less-significant bits will lead to multi-grayscale pixel data $MD_{(1,1)}$ of [010] representing "2", multi-grayscale pixel data $MD_{(2,1)}$ of [011] representing "3", multi-grayscale pixel data $MD_{(3,1)}$ of [010] representing "2", multi-grayscale pixel data $MD_{(4,1)}$ of [010] representing "2", multi-grayscale pixel data $MD_{(1,2)}$ of [011] representing "3", multi-grayscale pixel data $MD_{(2,2)}$ of [010] representing "2", multi-grayscale pixel data $MD_{(3,2)}$ of [010] representing "2", multi-grayscale pixel data $MD_{(4,2)}$ of [010] representing "2", corresponding to the discharge cells $G_{(1,1)}$, $G_{(2,1)}$, $G_{(3,1)}$, $G_{(4,1)}$, $G_{(1,2)}$, $G_{(2,2)}$, $G_{(3,2)}$, and $G_{(4,2)}$ as shown in FIG. 12.

Accordingly, with the multi-grayscale pixel data $MD_{(1,1)}$ of [010] as such, the discharge cell $G_{(1,1)}$ belonging to the (4N−3)th display lines is put to cause sustain discharge for light emission in the sustain processes I in the subfields $SF1_1$ to $SF1_4$, and $SF2_1$ as indicated by the white dot of FIG. 16. As a result, perceived is the light emission luminance of "22". With the multi-grayscale pixel data $MD_{(2,1)}$ of [011], the discharge cell $G_{(2,1)}$ belonging to the (4N−2)th display lines is put to cause sustain discharge for light emission in the sustain processes I in the subfields $SF1_1$ to $SF1_4$, $SF2_1$ to $SF2_4$, $SF3_1$ and $SF3_2$. As a result, perceived is the light emission luminance of "42". With the multi-grayscale pixel data $MD_{(3,1)}$ of [001], the discharge cell $G_{(3,1)}$ belonging to the (4N−1)th display lines is put to cause sustain discharge for light emission in the sustain processes I in the subfields $SF1_1$ to $SF1_4$, and $SF2_1$ to $SF2_3$ as indicated by the white dot of FIG. 16. As a result, perceived is the light emission luminance of "30". Further, with the multi-grayscale pixel data $MD_{(4,1)}$ of [010], the discharge cell $G_{(4,1)}$ belonging to the (4N)th display lines is put to cause sustain discharge for light emission in the sustain processes I in the subfields $SF1_1$ to $SF1_4$, and $SF2_1$ to $SF2_4$ as indicated by the white dot of FIG. 16. As a result, perceived is the light emission luminance of "34".

Further, with the multi-grayscale pixel data $MD_{(1,2)}$ of [011], the discharge cell $G_{(1,2)}$ belonging to the (4N−3)th display lines is put to cause sustain discharge for light emission in the sustain processes I in the subfields $SF1_1$ to $SF1_4$, $SF2_1$ to $SF2_4$ and $SF3_1$ as indicated by the white dot of FIG. 16. As a result, perceived is the light emission luminance of "38". With the multi-grayscale pixel data $MD_{(2,2)}$ of [010], the discharge cell $G_{(2,2)}$ belonging to the (4N−2)th display lines is put to cause sustain discharge for light emission in the sustain processes I in the subfields $SF_1$ to $SF1_4$, and $SF2_1$ to $SF2_4$. As a result, perceived is the light emission luminance of "26". With the multi-grayscale pixel data $MD_{(3,2)}$ of [010], the discharge cell $G_{(3,2)}$ belonging to the (4N−1)th display lines is put to cause sustain discharge for light emission in the sustain processes I in the subfields $SF_1$, to $SF1_4$, and $SF2_1$ to $SF2_3$ as indicated by the white dot of FIG. 16. As a result, perceived is the light emission luminance of "30". Further, with the multi-grayscale pixel data $MD_{(4,2)}$ of [010], the discharge cell $G_{(4,2)}$ belonging to the (4N)th display lines is put to cause sustain discharge for light emission in the sustain processes I in the subfields $SF1_1$ to $SF1_4$, $SF2_1$ to $SF2_4$ and as indicated by the white dot of FIG. 16. As a result, perceived is the light emission luminance of "34".

As such, responding to the incoming pixel data PD representing the luminance level of "32", discharge cells $G_{(1,1)}$, $G_{(2,1)}$, $G_{(3,1)}$, $G_{(4,1)}$, $G_{(1,2)}$, $G_{(2,2)}$, $G_{(3,2)}$, and $G_{(4,2)}$ vertically adjacent to one another in the screen of the PDP 100 each emit representing as follows:

$G_{(1,1)}$: luminance level "22",
$G_{(2,1)}$: luminance level "42",
$G_{(3,1)}$: luminance level "30",
$G_{(4,1)}$: luminance level "34",
$G_{(1,2)}$: luminance level "38",
$G_{(2,2)}$: luminance level "26",
$G_{(3,2)}$: luminance level "30", and
$G_{(4,2)}$: luminance level "34".

In view of these eight discharge cells G as a unit, perceived is the luminance level of "32" being an average value of the luminance levels. That is, represented is the luminance of the incoming video signal (pixel data PD).

Figure 20:
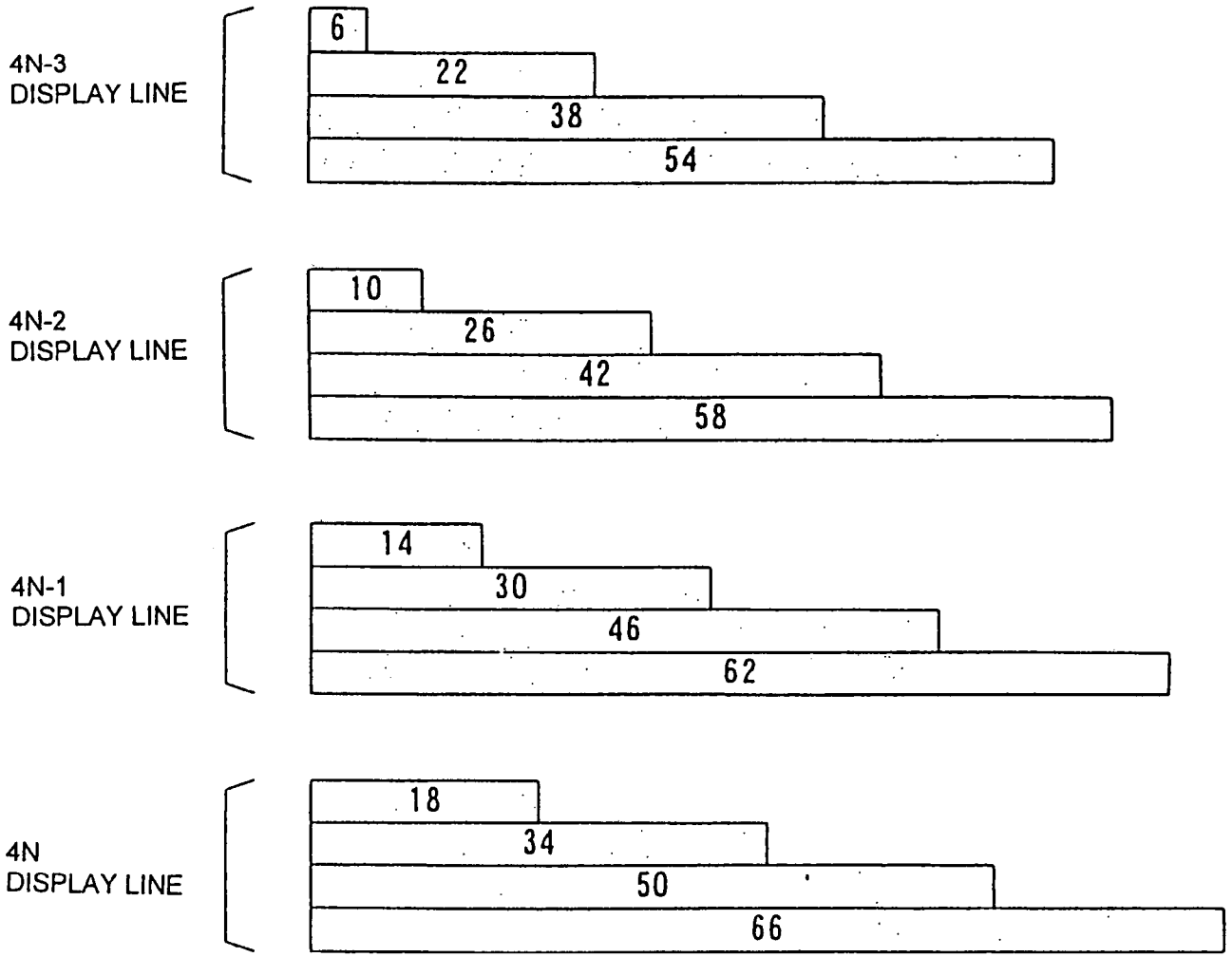
FIG. 20 is a diagram schematically showing the luminance levels covering four tones to be represented, respectively, by four discharge cells vertically adjacent to one another in a screen in the plasma display device of FIG. 13.
Figure 21:
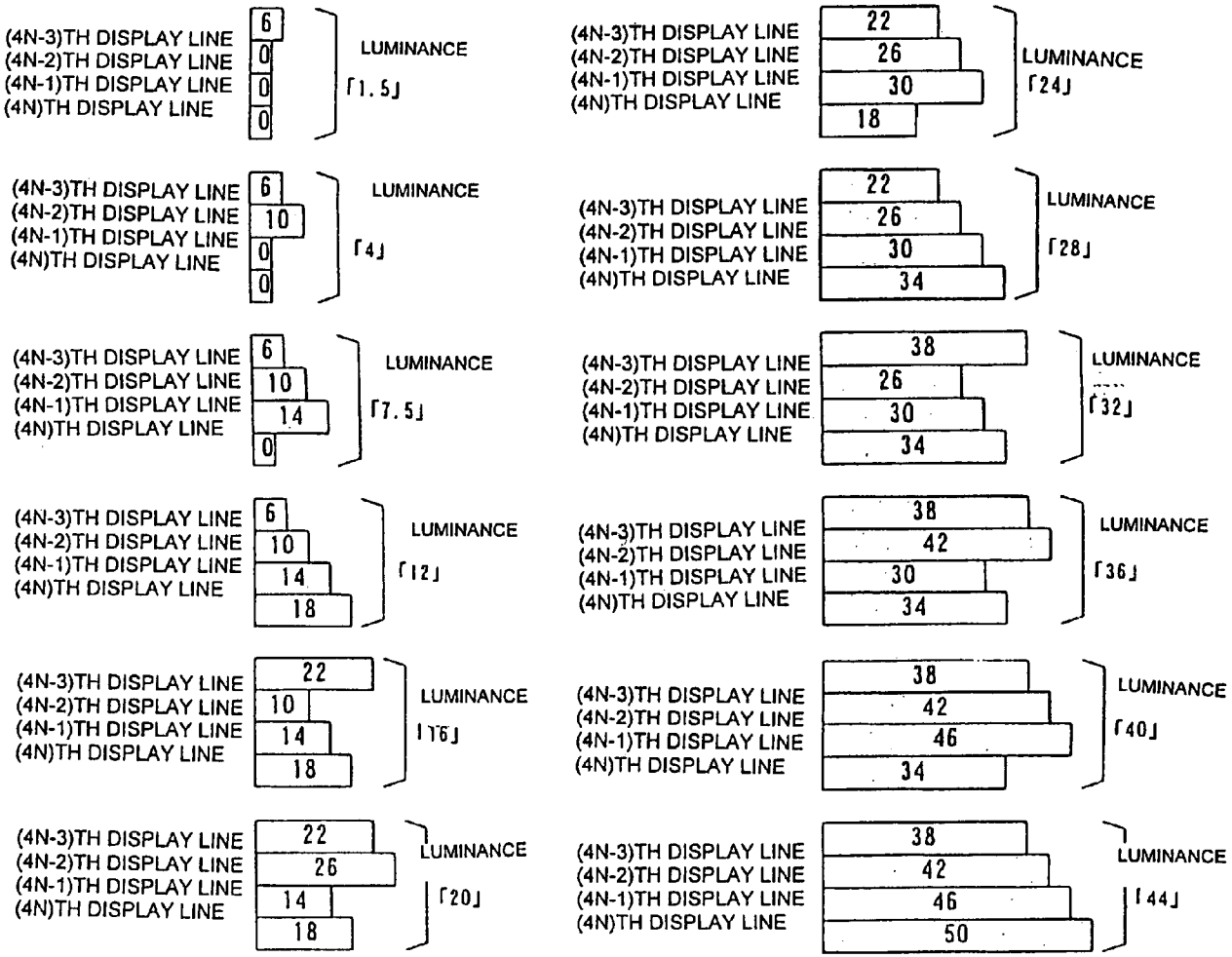
FIG. 21 is a diagram schematically showing the light emission luminance patterns of four discharge cells in the plasma display device of FIG. 13, and the luminance levels to be represented on an light emission luminance pattern basis.
Figure 22:
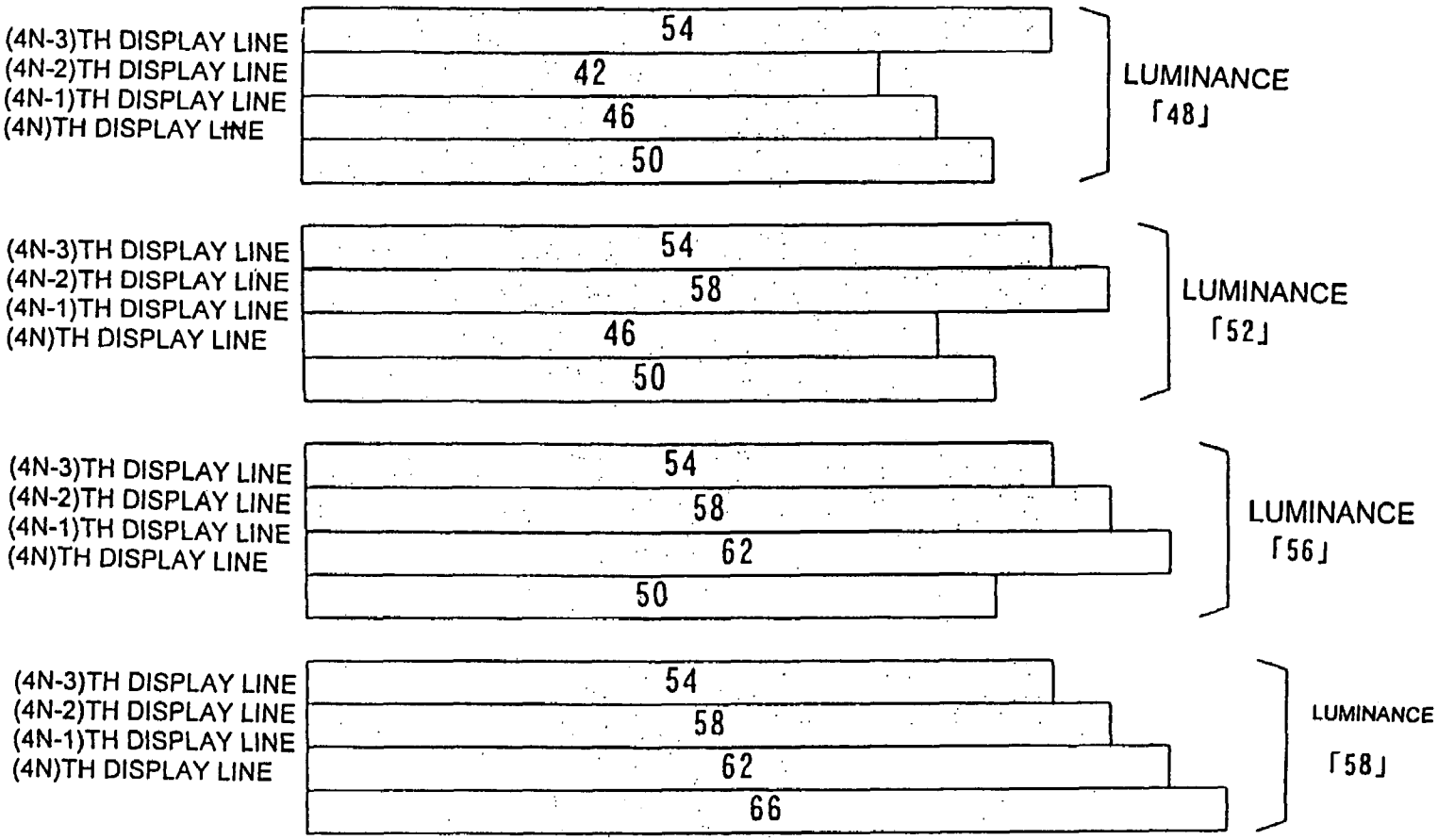
FIG. 22 is a diagram schematically showing the light emission luminance patterns of four discharge cells in the plasma display device of FIG. 13, and the luminance levels to be represented on an light emission luminance pattern basis.

As described in the foregoing, in such a plasma display device as shown in FIG. 13, for each of the (4N−3)th display lines, the (4N−2)th display lines, the (4N−1)th display lines, and the (4N)th display lines of the PDP 100, light emission driving is so applied as to represent each different four luminance levels as shown in FIG. 20. Here, in view of four discharge cells G vertically adjacent to one another in a screen as a unit, perceived is 17 intermediate luminance levels (luminance level 0 is not shown) as shown in FIGS. 21 and 22 in accordance with an average value of the luminance levels represented for every discharge cell G in a single unit. At this time, the pixel data each corresponding to four discharge cells G vertically adjacent to one another in a screen is added with the line offset data LD, and addition of a dither coefficient shown in FIG. 15 is made on the basis of pixel data by 2-line×2-column. In such a manner, dither patterns can be prevented from occurring in a more preferable manner.

Note here that, with driving by the plasma display device shown in FIG. 13, adopted is a so-called selective deletion address method in which the wall discharge is previously formed in every discharge cell, and selectively deleted according to the pixel data. This. is not surely restrictive, and a selective writing address method is also applicable in which the wall charge is.selectively formed in the discharge cell according to the pixel data.

Figure 23:
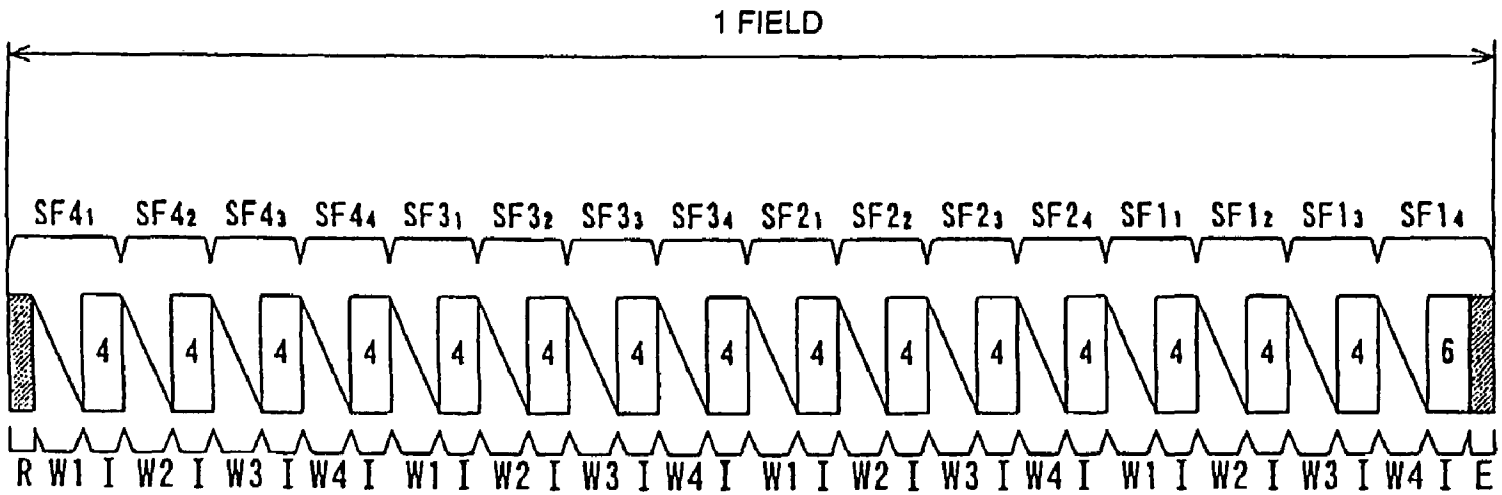
FIG. 23 is a diagram showing an exemplary light emission driving sequence at the time of driving the PDP 100 with a selective writing address method adopted.

FIG. 23 is a diagram showing an exemplary light emission driving sequence to be adopted for driving the plasma display device of FIG. 13 based on such a selective writing address method.

In the light emission driving sequence of FIG. 23, the display period of a field is divided into four subfield groups SF4 to SF1, and for each of the subfields, various driving processes as below are carried out. Note here that, the subfield groups SF4 to SF1 are constituted by, respectively, four subfields of $SF4_1$ to $SF4_4$, $SF3_1$ to $SF3_4$, $SF2_1$ to $SF2_4$, and $SF_1$, to $SF1_4$ as shown in FIG. 23.

In each of the subfields $SF4_1$, $SF3_1$, $SF2_1$, and $SF1_1$, an address process W1 and a sustain process I are carried out. Specifically, in the address process W1, the discharge cells belonging to the (4N−3)th display lines are selectively shifted to be in a lighting mode depending on the pixel driving data. In the sustain process I, only the discharge cells in the lighting mode are discharged for light emission continuously over the period of "4". In each of the subfields $SF4_2$, $SF3_2$, $SF2_2$, and $SF1_2$, an address process W2 and the sustain process I are carried out. Specifically, in the address process W2, the discharge cells belonging to the (4N−2)th display lines are selectively shifted to the lighting mode depending on the pixel driving data. In the sustain process I, only the discharge cells in the lighting mode are discharged for light emission continuously over the period of "4". In each of the subfields $SF4_3$, $SF3_3$, $SF2_3$, and $SF1_3$ carried out are an address process W3 and the sustain process I. Specifically, in the address process W3, the discharge cells belonging to the (4N−1)th display lines are selectively shifted to the lighting process depending on the pixel driving data. In the sustain process I, only the discharge cells in the lighting mode are discharged for light emission continuously over the period of "4". In each of the subfields $SF4_4$, $SF3_4$, and $SF2_4$, carried out are an address process W4 and the sustain process I. Specifically, in the address process W4, the discharge cells belonging to the (4N)th display lines are selectively shifted to the lighting mode depending on the pixel driving data. In the sustain process I, only the discharge cells in the lighting mode are discharged for light emission continuously over the period of "4". In the last subfield SF14, carried out are an address process W4, the sustain process I, and a deletion process E. Specifically, in the address process W4, the discharge cells belonging to the (4N)th display lines are selectively shifted to the lighting mode depending on the pixel driving data. In the sustain process I, only the discharge cells in the lighting mode are discharged for light emission continuously over the period of "6". And in the deletion process E, every discharge cell is shifted to be in the extinction mode. Note here that, prior to the address process W1, only in the first subfield $SF4_1$, the reset process R is carried out for initiating every discharge cell G to be in the extinction mode.

At this time, in the reset process R in the first subfield $SF4_1$ of FIG. 23, reset discharge occurs to every discharge cell of the PDP 100, resultantly eliminating wall charge remained in each of the discharge cells. In this manner, all of the discharge cells are initiated to be in the extinction mode, being non-emissive state (light emission responding to sustain discharge) in the sustain process I.

Next, in the address process W1 in the subfields $SF4_1$, $SF3_1$, $SF2_1$, and $SF_1$, of FIG. 23, the row electrode Y driving circuit 70 sequentially applies a negative scanning pulse SP to the row electrodes Y belonging to the (4N−3)th display lines of the PDP 100, i.e., row electrodes $Y_1$, $Y_5$, $Y_9$, . . . , $Y_{(n-3)}$. During this time, the column electrode driving circuit 50 generates m pixel data pulses for a display line corresponding to pixel driving data bits DB1 to DB(m) read from the memory 40. Then, a pixel data pulse group DP consisted of thus generated m pixel data pulses is applied to the column electrodes $D_1$ to $D_m$, respectively, in synchronization with the scanning pulse SP. At this time, writing addressing discharge occurs only to the discharge cells locating at intersections of the display lines and the column electrodes. Here, the display lines are those having applied with the scanning pulse SP, and the column electrodes are those having applied with the pixel data pulse of high voltage. Through such writing addressing discharge, the wall charge is formed in the discharge cells, and the resulting discharge cells shift into the lighting mode, being emissive state (light emission responding to sustain discharge) in the sustain process I. On the other hand, no such writing addressing discharge occurs to the discharge cells having applied with the scanning pulse SP and with the pixel data pulse but of low voltage, and thus the mode immediately before (lighting or extinction mode) is sustained.

That is, in the address process W1, only the discharge cells belonging to the (4N−3)th display lines of the PDP 100 are selectively put to cause writing addressing discharge based on the pixel data. In this manner, the discharge cells belonging to the (4N−3)th display lines are each set to be in either the lighting mode or the extinction mode.

Next, in the address process W2 in the subfield SF4$_2$, SF3$_2$, SF2$_2$, and SF1$_2$ of FIG. 23, the row electrode Y driving circuit 70 sequentially applies a negative scanning pulse SP to the row electrodes Y belonging to the (4N−2)th display lines of the PDP 100, i.e., row electrodes $Y_2$, $Y_6$, $Y_{10}$, . . . , $Y_{(n-2)}$. During this time, the column electrode driving circuit 50 generates m pixel data pulses for a display line corresponding to pixel driving data bits DB1 to DB(m) read from the memory 40. Then, a pixel data pulse group DP consisted of thus generated m pixel data pulses is applied to the column electrodes $D_1$ to $D_m$, respectively, in synchronization with the scanning pulse SP. At this time, writing addressing discharge occurs only to the discharge cells locating at intersections of the display lines and the column electrodes. Here, the display lines are those having applied with the scanning pulse SP, and the column electrodes are those having applied with the pixel data pulse of high voltage. Through such writing addressing discharge, the wall charge is formed in the discharge cells, and the resulting discharge cells shift into the lighting mode, being emissive state (light emission responding to sustain discharge) in the sustain process I. On the other hand, no such writing addressing discharge occurs to the discharge cells having applied with the scanning pulse SP and with the pixel data pulse but of low voltage, and thus the mode immediately before (lighting or extinction mode) is sustained.

That is, in the address process W2, only the discharge cells belonging to the (4N−2)th display lines of the PDP 100 are selectively put to cause writing addressing discharge based on the pixel data. In this manner, the discharge cells belonging to the (4N−2)th display lines are each set to be in either the lighting mode or the extinction mode.

Then, in the address process W3 in the subfield SF4$_3$, SF3$_3$, SF2$_3$, and SF1$_3$ of FIG. 23, the row electrode Y driving circuit 70 sequentially applies a negative scanning pulse SP to the row electrodes Y belonging to the (4N−1)th display lines of the PDP 100, i.e., row electrodes $Y_3$, $Y_7$, $Y_{11}$, . . . , $Y_{(n-1)}$. During this time, the column electrode driving circuit 50 generates m pixel data pulses for a display line corresponding to pixel driving data bits DB1 to DB(m) read from the memory 40. Then, a pixel data pulse group DP consisted of thus. generated m pixel data pulses is applied to the column electrodes $D_1$ to $D_m$, respectively, in synchronization with the scanning pulse SP. At this time, writing addressing discharge occurs only to the discharge cells locating at intersections of the display lines and the column electrodes. Here, the display lines are those having applied with the scanning pulse SP, and the column electrodes are those having applied with the pixel data pulse of high voltage. Through such writing addressing discharge, the wall charge is formed in the discharge cells, and the resulting discharge cells shift into the lighting mode, being emissive state (light emission responding to sustain discharge) in the sustain process I. On the other hand, no such writing addressing discharge occurs to the discharge cells having applied with the scanning pulse SP and with the pixel data pulse but of low voltage, and thus the mode immediately before (lighting or extinction mode) is sustained.

That is, in the address process W3, only the discharge cells belonging to the (4N−1)th display lines of the PDP 100 are selectively put to cause writing addressing discharge based on the pixel data. In this manner, the discharge cells belonging to the (4N−1)th display lines are each set to be in either the lighting mode or the extinction mode.

Then, in the address process W4 in the subfield SF4$_4$, SF3$_4$, SF2$_4$, and SF1$_4$ of FIG. 23, the row electrode Y driving circuit 70 sequentially applies a negative scanning pulse SP to the row electrodes Y belonging to the (4N)th display lines of the PDP 100, i.e., row electrodes $Y_4$, $Y_8$, $Y_{12}$, . . . , $Y_n$. During this time, the column electrode driving circuit 50 generates m pixel data pulses for a display line corresponding to pixel driving data bits DB1 to DB(m) read from the memory 40. Then, a pixel data pulse group DP consisted of thus generated m pixel data pulses is applied to the column electrodes $D_1$ to $D_m$, respectively, in synchronization with the scanning pulse SP. At this time, writing addressing discharge occurs only to the discharge cells locating at intersections of the display lines and the column electrodes. Here, the display lines are those having applied with the scanning pulse SP, and the column electrodes are those having applied with the pixel data pulse of high voltage. Through such writing addressing discharge, the wall charge is formed in the discharge cells, and the resulting discharge cells shift into the lighting mode, being emissive state (light emission responding to sustain discharge) in the sustain process I. On the other hand, no such writing addressing discharge occurs to the discharge cells having applied with the scanning pulse SP and with the pixel data pulse but of low voltage, and thus the mode immediately before (lighting or extinction mode) is sustained.

That is, in the address process W4, only the discharge cells belonging to the (4N)th display lines of the PDP 100 are selectively put to cause writing addressing discharge based on the pixel data. In this manner, the discharge cells belonging to the (4N)th display lines are each set to be in either the lighting mode or the extinction mode.

Then in the sustain process I to be executed immediately after each of the address processes W1 to W4, the row electrode X driving circuit 80 and the row electrode Y driving circuit 70 alternately apply positive sustain pulses $IP_x$ and $IP_y$ repeatedly for a predetermined number of times to the row electrodes $X_1$ to $X_n$ and $Y_1$ to $Y_n$ of the PDP 100. At this time, in response to every application of the sustain pulses $IP_x$ and $IP_y$, sustain discharge occurs only to the discharge cells with the wall charge remained therein, i.e., the discharge cells set in the lighting mode. The light emission state as a result of sustain discharge is kept over the period of "4" (period of "6" in the sustain process I of the subfield SF4$_4$).

Here, in a case of adopting such an light emission driving sequence as shown in FIG. 23, the driving data conversion circuit 30 converts the multi-grayscale pixel data MD into pixel driving data GD of four bits in accordance with a data conversion table shown in FIG. 24.

With such pixel driving data GD, as shown in FIG. 24, writing addressing discharge (indicated by double circles) is put to cause only in the address process W in each first subfield of the subfields SF4$_1$ to SF4$_4$, SF3$_1$ to SF3$_4$, SF2$_1$ to $SF2_4$, and $SF1_1$ to $SF1_4$. At this time, only in the reset process R at the first and the deletion process E at the last, the discharge cells can be shifted from the lighting mode to the extinction mode in one field. Accordingly, sustain discharge light emission continuously occurs (indicated by white dots) in the sustain process I of each subfield existing in the duration before the deletion process E in the last subfield $SF1_4$ but after writing addressing discharge occurs in the subfields SF indicated by double circles in FIG. 24. At this time, similarly to driving based on the selective deletion address method described in the above, perceived is the intermediate luminance corresponding to the total light emission duration in one field period responding to sustain discharge light emission.

Here, also with driving under the selective writing address method as described above, the discharge cells belonging to four display lines vertically adjacent to one another in the screen of the PDP 100, i.e., for each of these discharge cells belonging to (4N−3)th display lines,
discharge cells belonging to (4N−2)th display lines,
discharge cells belonging to (4N−1)th display lines, and
discharge cells belonging to (4N)th display lines, the total light emission duration differs in each field period responding to the driving according to the pixel driving data GD.

Taking pixel driving data GD of [0100] of FIG. 24 as an example, the discharge cells belonging to the (4N−3)th display lines are put to cause sustain discharge for light emission in the sustain processes I of the subfields $SF3_1$ to $SF3_4$, $SF2_1$ to $SF2_4$, and $SF1_1$ to $SF1_4$ as indicated by white dots. The discharge cells belonging to the (4N−2)th display lines are put to cause sustain discharge for light emission in the sustain processes I of the subfields $SF3_2$ to $SF3_4$, $SF2_1$ and $SF2_4$, and $SF1_1$ to $SF1_4$. The discharge cells belonging to the (4N−1)th display lines are put to cause sustain discharge for light emission in the sustain processes I of the subfields $SF3_3$, $SF3_4$, $SF2_1$ to $SF2_4$, and $SF1_1$ to $SF1_4$. Further, the discharge cells belonging to the (4N)th display lines are put to cause sustain discharge for light emission in the sustain processes I of the subfields $SF3_4$, $SF2_1$ to $SF2_4$, and $SF1_1$ to $SF1_4$.

Thus, as shown in FIG. 23, assuming that the light emission duration in the sustain process I of the subfield $SF1_4$ is "6", and the light emission duration in the sustain process I in other subfields is "4", the total light emission duration in one field period caused by sustain discharge light emission occurred responding to the pixel driving data GD of [0100] will be as follows:

discharge cells belonging to (4N−3)th display lines: "50"
discharge cells belonging to (4N−2)th display lines: "46"
discharge cells belonging to (4N−1)th display lines: "42"
discharge cells belonging to (4N)th display lines: "38".

Note here that, with such driving, for the purpose of equalizing the average luminance level for four discharge cells vertically adjacent to one another in the screen, the dither-added pixel data is added with the line offset data LD.

Figure 25:
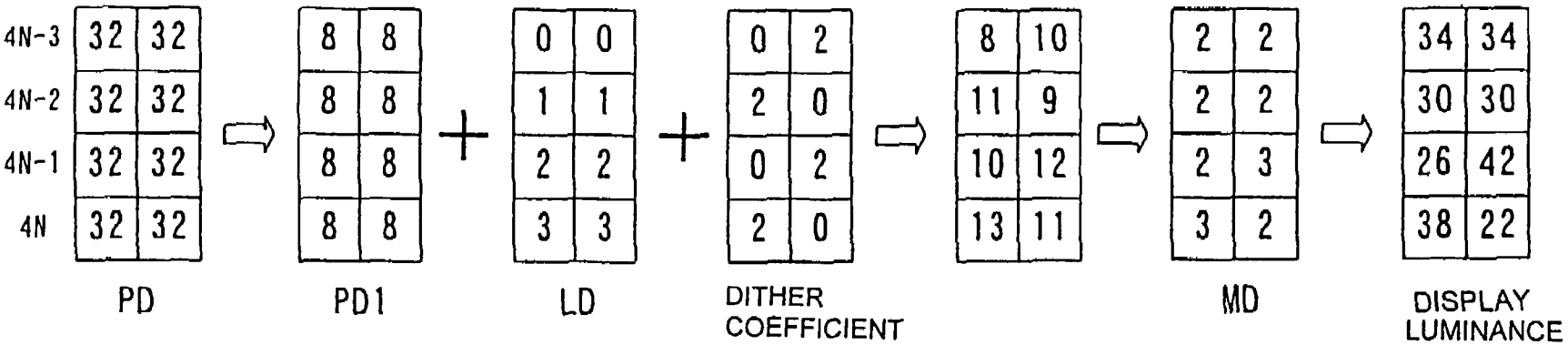
FIG. 25 is a diagram showing the operation for driving the plasma display device of FIG. 13 with the selective writing address method adopted when pixel data PD each corresponding to eight adjacent discharge cells all representing the luminance level of "32"

For example, assuming here is that pixel data PD corresponding, respectively, to discharge cells $G_{(1,1)}$, $G_{(2,1)}$, $G_{(3,1)}$, $G_{(4,1)}$ vertically adjacent to one another in the screen of the PDP 100, and discharge cells $G_{(1,2)}$, $G_{(2,2)}$, $G_{(3,2)}$, $G_{(4,2)}$ locating thereright all are six-bit data representing "32" (decimal numeral) as shown in FIG. 25. First, the pixel data PD representing "32" is converted into the first conversion pixel data PD1 of five bits representing "8" by the first data conversion circuit 11 with such conversion characteristics as shown in FIG. 14. Next, through addition of a dither coefficient of "0" or "2", and the line offset data LD of "0", "1", "2", and "3 as shown in FIG. 19 respectively to the first conversion pixel data PD1 corresponding to the discharge cells $G_{(1,1)}$, $G_{(2,1)}$, $G_{(3,1)}$, $G_{(4,1)}$, $G_{(1,2)}$, $G_{(2,2)}$, $G_{(3,2)}$, and $G_{(4,2)}$, derived are the addition results as dither-added pixel data of [01000] representing "8",
dither-added pixel data of [01011] representing "11",
dither-added pixel data of [01010] representing "10",
dither-added pixel data of [01101] representing "13",
dither-added pixel data of [01010] representing "10",
dither-added pixel data of [01001] representing "9",
dither-added pixel data of [01100] representing "12", and
dither-added pixel data of [01011] representing "11".

Here, from each of the resulting dither-added pixel data, extracting three significant bits by truncating two less-significant bits will lead to multi-grayscale pixel data $MD_{(1,1)}$ of [010] representing "2",
multi-grayscale pixel data $MD_{(2,1)}$ of [010] representing "2",
multi-grayscale pixel data $MD_{(3,1)}$ of [010] representing "2",
multi-grayscale pixel data $MD_{(4,1)}$ of [011] representing "3",
multi-grayscale pixel data $MD_{(1,2)}$ of [010] representing "2",
multi-grayscale pixel data $MD_{(2,2)}$ of [010] representing "2",
multi-grayscale pixel data $MD_{(3,2)}$ of [011] representing "3", and
multi-grayscale pixel data $MD_{(4,2)}$ of [010] representing "2", corresponding to the discharge cells $G_{(1,1)}$, $G_{(2,1)}$, $G_{(3,1)}$, $G_{(4,1)}$, $G_{(1,2)}$, $G_{(2,2)}$, $G_{(3,2)}$, and $G_{(4,2)}$ as shown in FIG. 25.

Accordingly, with the multi-grayscale pixel data $MD_{(1,1)}$ of [010] as such, the discharge cell $G_{(1,1)}$ belonging to the (4N−3)th display lines is caused to emit with the luminance of "34" as shown in FIG. 24. With the multi-grayscale pixel data $MD_{(2,1)}$ of [010] as such, the discharge cell $G_{(2,1)}$ belonging to the (4N−2)th display lines is caused to emit with the luminance of "30" as shown in FIG. 24. With the multi-grayscale pixel data $MD_{(3,1)}$ of [010] as such, the discharge cell $G_{(3,1)}$ belonging to the (4N−1)th display lines is caused to emit with the luminance of "26" as shown in FIG. 24. With the multi-grayscale pixel data $MD_{(4,1)}$ of [011] as such, the discharge cell $G_{(4,1)}$ belonging to the (4N)th display lines is caused to emit with the luminance of "38" as shown in FIG. 24. With the multi-grayscale pixel data $MD_{(1,2)}$ of [010] as such, the discharge cell $G_{(1,2)}$ belonging to the (4N−3)th display lines is caused to emit with the luminance of "34" as shown in FIG. 24. With the multi-grayscale pixel data $MD_{(2,2)}$ of [010] as such, the discharge cell $G_{(2,2)}$ belonging to the (4N−2)th display lines is caused to emit with the luminance of "30" as shown in. FIG. 24. With the multi-grayscale pixel data $MD_{(3,2)}$ of [011] as such, the discharge cell $G_{(3,2)}$ belonging to the (4N−1)th display lines is caused to emit with the luminance of "42" as shown in FIG. 24. Further, with the multi-grayscale pixel data $MD_{(4,2)}$ of [010] as such, the discharge cell $G_{(4,2)}$ belonging to the (4N)th display lines is caused to emit with the luminance of "22" as shown in FIG. 24.

As such, responding to the incoming pixel data PD representing the luminance level of "32", discharge cells $G_{(1,1)}$, $G_{(2,1)}$, $G_{(3,1)}$, $G_{(4,1)}$, $G_{(1,2)}$, $G_{(2,2)}$, $G_{(3,2)}$, and $G_{(4,2)}$ adjacent to one another in the screen of the PDP 100 each emit representing as follows:

$G_{(1,1)}$: luminance level "34",
$G_{(2,1)}$: luminance level "30",
$G_{(3,1)}$: luminance level "26",
$G_{(4,1)}$: luminance level "38", $G_{(1,2)}$: luminance level "34", $G_{(2,2)}$: luminance level "30", $G_{(3,2)}$: luminance level "42", and $G_{(4,2)}$: luminance level "22".

In view of these eight discharge cells G as a unit, perceived is the luminance level of "32" being an average value of the luminance levels. That is, represented is the luminance of the incoming video signal (pixel data PD).

As such, also in a case of adopting the selective writing address method, as shown in FIGS. 21 and 22, 17 intermediate luminance levels (luminance level 0 is not shown) can be represented. In this case, the line offset data LD is added to the pixel data corresponding to each of the vertically-adjacent four discharge cells in the screen, and a dither coefficient is added to the pixel data on a 2-line by 2-column basis as shown in FIG. 15. In such a manner, dither patterns can be suppressed in a more preferable manner.

Figure 26:
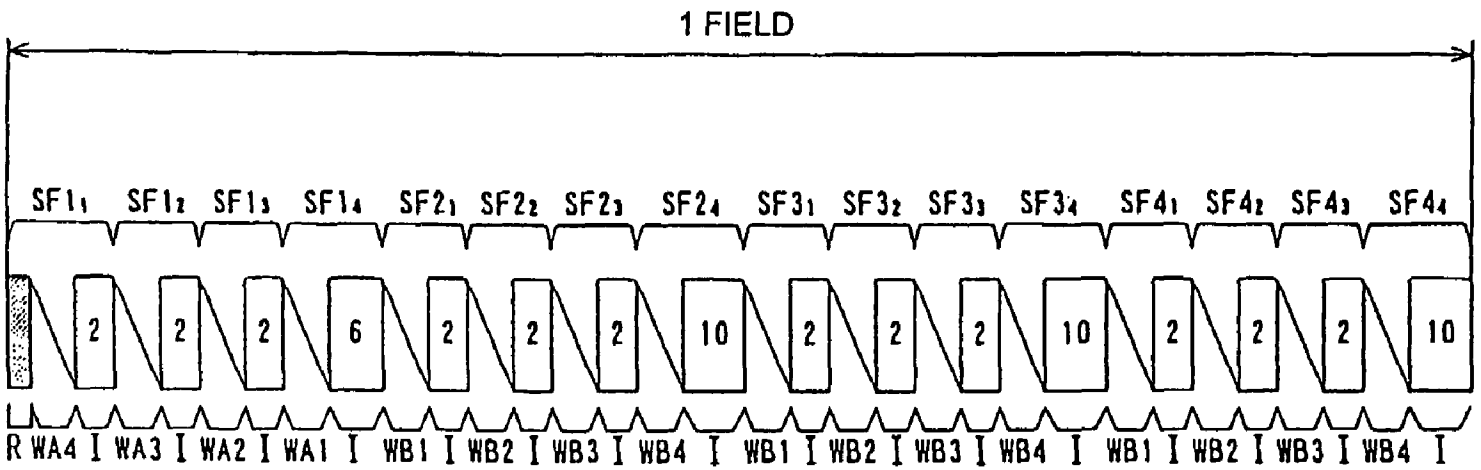
FIG. 26 is a diagram showing an exemplary light emission driving sequence at the time of driving the PDP 100 with the selective writing address method and the selective deletion address method combined.

Alternatively, to drive the PDP 100 in such a plasma display device as shown in FIG. 13, an light emission driving sequence of FIG. 26 may be adopted.

In the light emission driving sequence of FIG. 26, the display period of a field is divided into subfield groups SF1 to SF4, and for each of the subfields, various driving processes as below are carried out. Note here that, the subfield groups SF1 to SF4 are constituted by, respectively, four subfields of $SF1_1$ to $SF1_4$, $SF2_1$ to $SF2_4$, $SF3_1$ to $SF3_4$, and $SF4_1$ to $SF4_4$. At this time, in the subfield group SF1, driving is applied based on the selective writing address method as described in the foregoing, and in the subfield groups SF2 to SF4, driving is applied based on the selective deletion address method.

First in the subfield $SF1_1$, carried out are a reset process R, an address process WA4, and a sustain process I. Specifically, in the reset process R, every discharge cell in the PDP 100 is initiated to be in an extinction mode (state of wall charge being deleted). In the address process WA4, the discharge cells belonging to the (4N)th display lines are selectively put to cause writing addressing discharge to shift those in a lighting mode depending on the pixel driving data. In the sustain process I, only the discharge cells in the lighting mode are discharged for light emission continuously over the period of "2". In the subfield $SF1_2$, an address process WA3 and the sustain process I are carried out. Specifically, in the address process WA3, the discharge cells belonging to the (4N−1)th display lines are selectively put to cause writing addressing discharge to shift those to the lighting mode depending on the pixel driving data. In the sustain process I, only the discharge cells in the lighting mode are discharged for light emission continuously over the period of "2". In the subfield $SF1_3$, carried out are an address process WA2 and the sustain process I. Specifically, in the address process WA2, the discharge cells belonging to the (4N−2)th display lines are selectively put to cause writing addressing discharge to shift those to the lighting mode depending on the pixel driving data. In the sustain process I, only the discharge cells in the lighting mode are discharged for light emission continuously over the period of "2". In the subfield $SF1_4$, carried out are an address process WA1 and the sustain process I. Specifically, in the address process WA1, the discharge cells belonging to the (4N−3)th display lines are selectively put to cause writing addressing discharge to shift those to the lighting mode depending on the pixel driving data. In the sustain process I, only the discharge cells in the lighting mode are discharged for light emission continuously over the period of "6".

In each of the subfields $SF2_1$, $SF3_1$, and $SF4_1$, carried out are an address process WB1 and the sustain process I. Specifically, in the address process WB1, the discharge cells belonging to the (4N−3)th display lines are selectively put to cause erasure addressing discharge to shift those to the extinction mode depending on the pixel driving data. In the sustain process I, only the discharge cells in the lighting mode are discharged for light emission continuously over the period of "2". In each of the subfields $SF2_2$, $SF3_2$, and $SF4_2$, an address process WB2 and the sustain process I are carried out. Specifically, in the address process WB2, the discharge cells belonging to the (4N−2)th display lines are selectively put to cause erasure addressing discharge to shift those to the extinction mode depending on the pixel driving data. In the sustain process I, only the discharge cells in the lighting mode are discharged for light emission continuously over the period of "2". In each of the subfields $SF2_3$, $SF3_3$, and $SF4_3$, carried out are an address process WB3 and the sustain process I. Specifically, in the address process WB3, the discharge cells belonging to the (4N−1)th display lines are selectively caused to erasure addressing discharge to shift those to the extinction mode depending on the pixel driving data. In the sustain process I, only the discharge cells in the lighting mode are discharged for light emission continuously over the period of "2". In each of the subfields $SF2_4$, $SF3_4$, and $SF4_4$, carried out are an address process WB4 and the sustain process I. Specifically, in the address process WB4, the discharge cells belonging to the (4N)th display lines are selectively put to cause erasure addressing discharge to shift those to the extinction mode depending on the pixel driving data. In the sustain process I, only the discharge cells in the lighting mode are discharged for light emission continuously over the period of "10".

Here, in a case of adopting such an light emission driving sequence as shown in FIG. 26, the driving data conversion circuit 30 converts the multi-grayscale pixel data MD into pixel driving data GD of four bits in accordance with a data conversion table shown in FIG. 27. In accordance with the pixel driving data GD, such light emission driving is applied as shown in FIG. 27 in a field display period.

With driving shown in FIG. 27, writing addressing discharge is occurred in each first subfield (indicated by double circles), and thereafter, sustain discharge light emission occurs (indicated by white dots) in the sustain processes I of the subfields SF existing before erasure addressing discharge occurs (indicated by black dots). At this time, with pixel driving data GD of [000000] representing the lowest luminance, no writing addressing discharge for setting the discharge cells into the lighting mode occurs over a field display period. Thus, no discharge cell is put to cause sustain discharge for light emission over a field display period, representing the luminance of "0". Further, with the pixel driving data GD of [1100], [1010]. [1001], or [1000] representing higher luminance than [0000], only in the address process WA of subfield $SF1_4$ for discharge cells belonging to (4N−3)th display lines, subfield $SF1_3$ for discharge charge cells belonging to (4N−2)th display lines, subfield $SF1_2$ for discharge cells belonging to (4N−1)th display lines, and subfield $SF1_1$ for discharge cells belonging to (4N)th display lines, writing addressing discharge (indicated by double circles) occurs, and a setting is made for the lighting mode. Accordingly, sustain discharge light emission continuously occurs (indicated by white dots) in the sustain processes I of the subfields existing in the duration before erasure addressing discharge (indicated by black dots) occurs in the address processes WB of the 1st subfields after the subfield $SF2_1$.

Thus, the pixel driving data GD of [1100] emits representing luminance level "6" for discharge cells belonging to (4N−3)th display lines, luminance level "10" for discharge cells belonging to (4N−2)th display lines, luminance level "14" for discharge cells belonging to (4N−1)th display lines, and luminance level "18" for discharge cells belonging to (4N)th display lines.

The pixel driving data GD of [1010] emits representing luminance level "22" for discharge cells belonging to (4N−3)th display lines, luminance level "26" for discharge cells belonging to (4N−2)th display lines, luminance level "30" for discharge cells belonging to (4N−1)th display lines, and luminance level "34" for discharge cells belonging to (4N)th display lines.

The pixel driving data GD of [1001] emits representing luminance level "38" for discharge cells belonging to (4N−3)th display lines, luminance level "42" for discharge cells belonging to (4N−2)th display lines, luminance level "46" for discharge cells belonging to (4N−1)th display lines, and luminance level "50" for discharge cells belonging to (4N)th display lines.

The pixel driving data GD of [1000] emits representing luminance level "54" for discharge cells belonging to (4N−3)th display lines, luminance level "56" for discharge cells belonging to (4N−2)th display lines, luminance level "58" for discharge cells belonging to (4N−1)th display lines, and luminance level "60" for discharge cells belonging to (4N)th display lines.

As is known from the above, with such driving as shown in FIGS. 26 and 27, light emission driving is done for representing each different four luminance levels for, respectively, the (4N−3)th display lines, the (4N−2)th display lines, (4N−1)th display lines, and the (4N)th display lines of the PDP 100. In view of four discharge cells G vertically adjacent in the screen as a unit, represented are 17 intermediate luminance levels as shown in FIGS. 21 and 22 in accordance with an average value of the luminance levels represented for every discharge cell G in a single unit. In this case, the line offset data LD is added to the pixel data corresponding to each of vertically-adjacent four discharge cells in the screen, and a dither coefficient is added to the pixel data on a 2-line by 2-column basis as shown in FIG. 15, successfully suppressing a dither pattern in a more preferable manner.

In the above embodiment, applied is such driving as varying the luminance level to be represented for four display lines vertically adjacent to one another in the screen of the PDP 100. This is not surely restrictive, and alternately the luminance level may be differed from one another in eight display lines.

Figure 28:
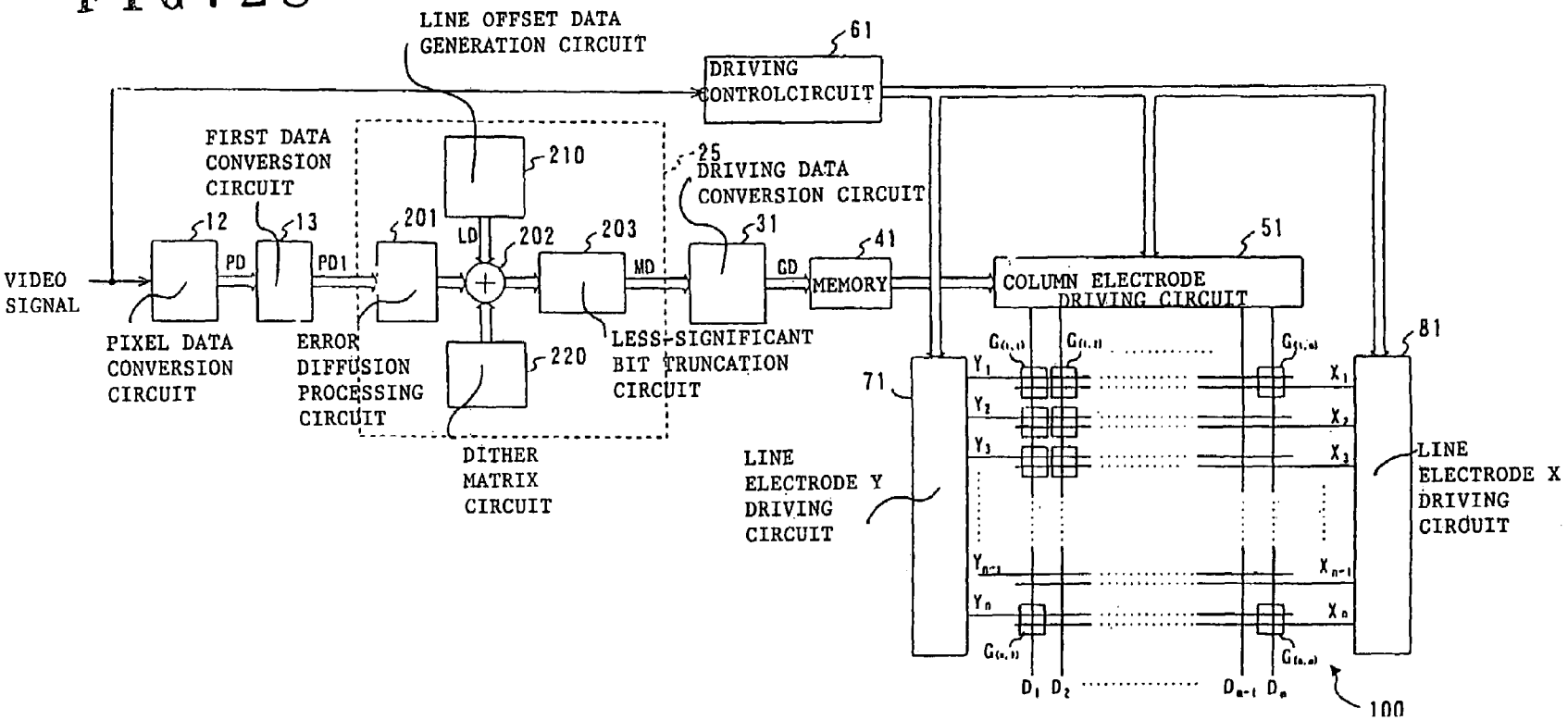
FIG. 28 is a diagram showing the structure of a plasma display device as a display device of another embodiment of the present invention.

FIG. 28 is a diagram showing the structure of the plasma display device driving as such.

In FIG. 28, the PDP 100 being a plasma display panel includes a front substrate (not shown) serving as a display plane and a rear substrate (not shown) opposing to the front substrate with a discharge-gas-filled discharge space therebetween. The front substrate is formed with strip-shaped row electrodes $X_1$ to $X_n$ and $Y_1$ to $Y_n$ arranged alternately and parallel with one another. Formed on the rear substrate are strip-shaped column electrodes $D_1$ to $D_m$ intersected on the row electrodes $X_1$ to $X_n$ and $Y_1$ to $Y_n$. Herein, as to the row electrodes $X_1$ to $X_n$ and $Y_1$ to $Y_n$, each pair of row electrodes X and Y serves as a display line of the PDP 100, from 1st to nth. At an intersection part (discharge space included) of a pair of row electrodes and column electrode, formed is a discharge cell G serving as a pixel. That is, the PDP 100 includes (n×m) discharge cells $G_{(1,\ 1)}$ to $G_{(n,\ m)}$ formed in a matrix.

Figures 29, 30:
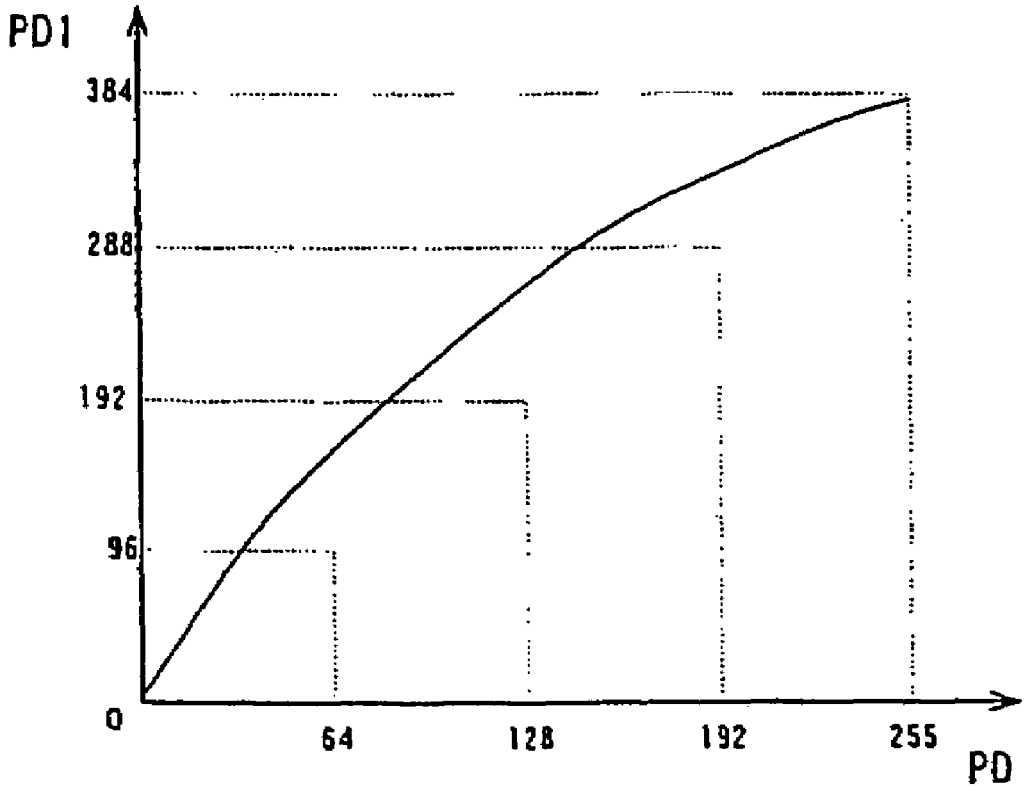
FIG. 29 is a diagram showing data conversion characteristics of a first data conversion circuit 13 of FIG. 28.
FIG. 30 is a diagram showing exemplary offset data LD each corresponding to eight discharge lines vertically adjacent to one another in a screen.

A pixel data conversion circuit 12 converts an input video signal into pixel data PD on a pixel basis, for example pixel data of eight bits. Then, the resulting data is supplied to a first data conversion circuit 13, which converts the pixel data PD of eight bits into first conversion pixel data PD1 of nine bits in accordance with such conversion characteristics as shown in FIG. 29. The resulting data is supplied to a multi-grayscale processing circuit 25.

The multi-grayscale processing circuit 25 is constituted by an error diffusion processing circuit 201, an adder 202, a less-significant bit truncation circuit 203, a line offset data generation circuit 211, and a dither matrix circuit 220.

The error diffusion processing circuit 201 regards seven significant bits of the first conversion pixel data PD1 as display data, and the remaining two less-significant bits as error data. Then, the error data of the first conversion pixel data PD1 derived for each pixel in a close range is assigned weights and added together, and the result derived as such is reflected to the display data. Through such an operation, as to one original pixel, the luminance of the two less-significant bits is represented in a pseudo manner by other pixels therearound, enabling representation of luminance tone equivalent to the first conversion pixel data PD1 of nine significant bits using display data of only seven bits. The error diffusion processing circuit 201 provides, to the adder 202, the resulting error-diffused pixel data of seven bits derived by such an error diffusion process.

When the error diffusion processing circuit 201 outputs error-diffused pixel data corresponding to the (8N−7)th display lines[N: natural number of (1/8)·n or smaller] of the PDP 100 as shown in FIG. 30, the line offset data generation circuit 211 generates line offset data LD representing "0". Thus generated data is then supplied to the adder 202. Similarly, when the error diffusion processing circuit 201 outputs error-diffused pixel data corresponding to the (8N−6)th display lines, the line offset data generation circuit 211 generates line offset data LD representing "4" for supply to the adder 202. When the error diffusion processing circuit 201 outputs error-diffused pixel data corresponding to the (8N−5)th display lines, the line offset data generation circuit 211 generates line offset data LD representing "8" for supply to the adder 202. When the error diffusion processing circuit 201 outputs error-diffused pixel data corresponding to the (8N−4)th display lines, the line offset data generation circuit 211 generates line offset data LD representing "12" for supply to the adder 202. When the error diffusion processing circuit 201 outputs error-diffused pixel data corresponding to the (8N−3)th display lines, the line offset data generation circuit 211 generates line offset data LD representing "16" for supply to the adder 202. When the error diffusion processing circuit 201 outputs error-diffused pixel data corresponding to the (8N−2)th display lines, the line offset data generation circuit 211 generates line offset data LD representing "20" for supply to the adder 202. When the error diffusion processing circuit 201 outputs error-diffused pixel data corresponding to the (8N−1)th display lines, the line offset data generation circuit 211 generates line offset data LD representing "24" for supply to the adder 202. Further, when the error diffusion processing circuit 201 outputs error-diffused pixel data corresponding to the (8N)th display lines, the line offset data generation circuit 211 generates line offset data LD representing "28" for supply to the adder 202.

On the basis of each pixel group constituted by four pixels adjacent to one another in the vertical and lateral directions of the screen, the dither matrix circuit 220 generates a dither coefficient of "0" or "2" (decimal numeral) as shown in FIG. 15 for each pixel in the pixel group. The resulting dither coefficients are provided to the adder 202. Herein, the dither matrix circuit 220 changes such dither coefficient assignment on a field basis as shown in FIG. 15.

The adder 202 adds the dither coefficients to the first conversion pixel data PD1 provided by the error diffusion processing circuit 201, deriving dither-added pixel data. To the dither-added pixel data, the adder 202 adds the line offset data LD for supply to the less-significant bit truncation circuit 203.

The less-significant bit truncation circuit 203 truncates three less-significant bits of the dither-added pixel data having added with the line offset data LD, and the remaining four significant bits are provided to the driving data conversion circuit 31 as multi-grayscale pixel data MD.

The driving data conversion circuit 31 converts the multi-grayscale pixel data MD of four bits into pixel driving data GD of thirteen bits for supply to memory 41.

Here, in the pixel driving data GD of thirteen bits, only one bit is in the logic level 1, and other bits are all in the logic level 0. At this time, the bit order corresponding to the luminance level represented by the multi-grayscale pixel data MD will be in the logic level 1.

Figure 31:
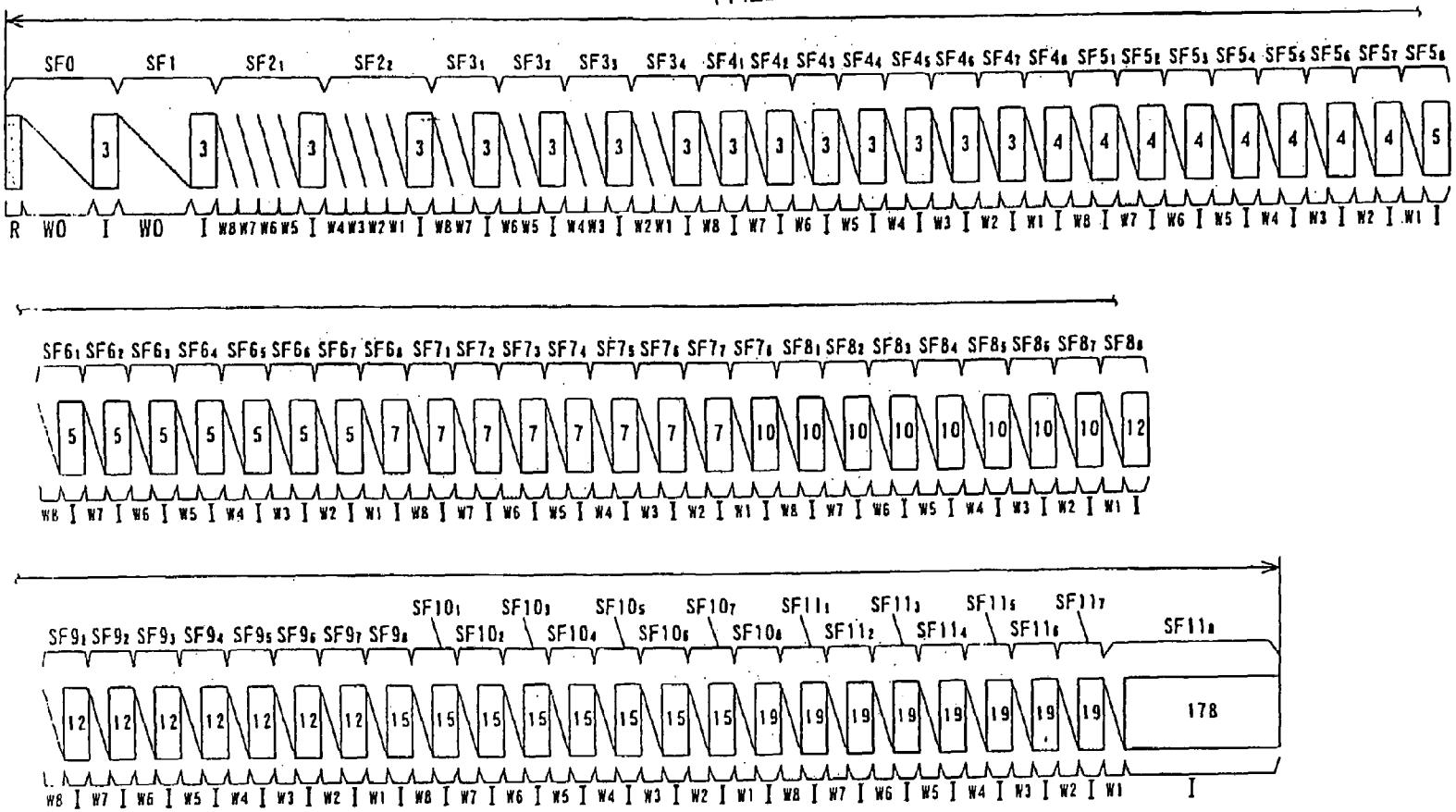
FIG. 31 is a diagram showing an exemplary light emission driving sequence at the time of driving the PDP 100 of FIG. 28 based on the selective deletion address method.

The memory 41 sequentially receives and stores the pixel driving data GD of thirteen bits. Every time completing writing of pixel driving data $GD_{1,1}$ to $GD_{n,m}$ of an image frame (n lines×m columns) basis, the memory 41 separates each. of the pixel driving data $GD_{1,1}$ to $GD_{n,m}$ on a bit digit (1st to 13th bits). Then, the memory 41 performs reading on a display line basis corresponding to subfield SF0 and SF1, and subfield groups SF2 to SF11 as shown in FIG. 31. The memory 41 then supplies, to a column electrode driving circuit 51, the pixel driving data bits of thus read display line (m pieces) as pixel driving data bits DB1 to DB(m). To be more specific, first in the subfield SF0, the memory 41 reads only the 1st bit of the pixel driving data $GD_{1,1}$ to $GD_{n,m}$ for every display line. Thus read results are supplied to the column electrode driving circuit 51 as the pixel driving data bits DB1 to DB(m). Then, in the subfield SF1, the memory 41 reads only the 2nd bit of the pixel driving data $GD_{1,1}$ to $GD_{n,m}$ for every display line, and thus read results are supplied to the column electrode driving circuit 51 as the pixel driving data bits DB1 to DB(m). Next, in the subfield group SF2, the memory 41 reads only the 3rd bit of the pixel driving data $GD_{1,1}$ to $GD_{n,m}$ for every display line, and thus read results are supplied to the column electrode driving circuit 51 as the pixel driving data bits DB1 to DB(m). Thereafter, in a similar manner, the memory 41 performs reading on a display line basis while establishing a correspondence, respectively, between the four to twelve bits of the pixel driving data $GD_{1,1}$ to $GD_{n,m}$ and the subfield groups SF3 to SF11. Thus read results are then supplied to the column electrode driving circuit 51 as the pixel driving data bits DB1 to DB(m).

In accordance with such an light emission driving sequence as shown in FIG. 31, a driving control circuit 61 supplies various timing signals for tone-driving the PDP 100 to the column electrode driving circuit 51, a row electrode Y driving circuit 71, and a row electrode X driving circuit 81.

In the light emission driving sequence of FIG. 31, the display period of a field is divided into the subfields SF0, SF1, and the subfield groups SF2 to SF11, and for each of the subfields, various driving processes as below are carried out.

First, in the subfield SF0 shown in FIG. 31, a reset process R, an address process W0, and a sustain process I are carried out. Specifically, in the reset process R, every discharge cell of the PDP 100 is initiated to be in a lighting mode. In the address process W0, the discharge cells are selectively shifted to be in an extinction mode depending on the pixel driving data. And in the sustain process I, only the discharge cells in the lighting mode are discharged for light emission continuously over the period of "3". In the subfield SF1, carried out are the address process W0 and the sustain process I. Specifically, in the address process W0, the discharge cells are selectively shifted to the extinction mode depending on the pixel driving data. In the sustain process I, only the discharge cells in the lighting mode are discharged for light emission continuously over the period of "3".

In the subfield $SF2_1$, sequentially carried out are address processes W8 to W5, and the sustain process I for discharging for light emission continuously only the discharge cells in the lighting mode over the period of "3". Specifically, in the address process W8, the discharge cells belonging to the (8N)th display lines [N: natural number of (⅛)·n or smaller] of the PDP 100 are selectively shifted to the extinction mode. In the address process W7, the discharge cells belonging to the (8N−1)th display lines are selectively shifted to the extinction mode. In the address process W6, the discharge cells belonging to the (8N−2)th display lines are selectively shifted to the extinction mode. And in the address process W5, the discharge cells belonging to the (8N−3)th display lines are selectively shifted to the extinction mode.

In the subfield $SF2_2$, sequentially carried out are address processes W4 to W1, and the sustain process I for discharging for light emission only the discharge cells in the lighting mode over the period of "3". Specifically, in the address process W4, the discharge cells belonging to the (8N−4)th display lines [N: 1 to (⅛)·n] of the PDP 100 are selectively shifted to the extinction mode. In the address process W3, the discharge cells belonging to the (8N−5)th display lines are selectively shifted to the extinction mode. In the address process W2, the discharge cells belonging to the (8N−6)th display lines are selectively shifted to the extinction mode. In the address process W1, the discharge cells belonging to the (8N−7)th display lines are selectively shifted to the extinction mode.

In the subfield $SF3_1$, sequentially carried out are the address processes W8 and W7, and the sustain process I. Specifically, in the address process W8, the discharge cells belonging to the (8N)th display lines are selectively shifted to the extinction mode. In the address process W7, the discharge cells belonging to the (8N−1)th display lines are selectively shifted to the extinction mode. In the sustain process I, only the discharge cells in the lighting mode are discharged for light emission continuously over the period of "3".

In the subfield $SF3_2$, sequentially carried out are the address processes W6 and W5, and the sustain process I.

Specifically, in the address process W6, the discharge cells belonging to the (8N−2)th display lines are selectively shifted to the extinction mode. In the address process W5, the discharge cells belonging to the (8N−3)th display lines are selectively shifted to the extinction mode. In the sustain process I, only the discharge cells in the lighting mode are discharged for light emission continuously over the period of "3".

In the subfield $SF3_3$, sequentially carried out are the address processes W4 and W3, and the sustain process I. Specifically, in the address process W4, the discharge cells belonging to the (8N−4)th display lines are selectively shifted to the extinction mode. In the address process W3, the discharge cells belonging to the (8N−5)th display lines are selectively shifted to the extinction mode. In the sustain process I, only the discharge cells in the lighting mode are discharged for light emission continuously over the period of "3".

In the subfield $SF3_4$, sequentially carried out are the address processes W2 and W1, and the sustain process I. Specifically, in the address process W2, the discharge cells belonging to the (8N−6)th display lines are selectively shifted to the extinction mode. In the address process W1, the discharge cells belonging to the (8N−7)th display lines are selectively shifted to the extinction mode. In the sustain process I, only the discharge cells in the lighting mode are discharged for light emission continuously over the period of "3".

In each of the subfields $SF4_1$, $SF5_1$, $SF6_1$, $SF7_1$, $SF8_1$, $SF9_1$, $SF10_1$, and $SF11_1$, carried out are the address process W8 for selectively shifting to the extinction mode the discharge cells belonging to the (8N)th display lines, and the sustain process I. In each of the subfields $SF4_2$, $SF5_2$, $SF6_2$, $SF7_2$, $SF8_2$, $SF9_2$, $SF10_2$, and $SF11_2$, carried out are the address process W7 for selectively shifting to the extinction mode the discharge cells belonging to the (8N−1)th display lines, and the sustain process I. In each of the subfields $SF4_3$, $SF5_3$, $SF6_3$, $SF7_3$, $SF8_3$, $SF9_3$, $SF10_3$, and $SF11_3$, carried out are the address process W6 for selectively shifting to the extinction mode the discharge cells belonging to the (8N−2)th display lines, and the sustain process I. In each of the subfields $SF4_4$, $SF5_4$, $SF6_4$, $SF7_4$, $SF8_4$, $SF9_4$, $SF10_4$, and $SF11_4$, carried out are the address process W5 for selectively shifting to the extinction mode the discharge cells belonging to the (8N−3)th display lines, and the sustain process I. In each of the subfields $SF4_5$, $SF5_5$, $SF6_5$, $SF7_5$, $SF8_5$, $SF9_5$, $SF10_5$, and $SF11_5$, carried out are the address process W4 for selectively shifting to the extinction mode the discharge cells belonging to the (8N−4)th display lines, and the sustain process I. In each of the subfields $SF4_6$, $SF5_6$, $SF6_6$, $SF7_6$, $SF8_6$, $SF9_6$, $SF10_6$, and $SF11_6$, carried out are the address process W3 for selectively shifting to the extinction mode the discharge cells belonging to the (8N−5)th display lines, and the sustain process I. In each of the subfields $SF4_7$, $SF5_7$, $SF6_7$, $SF7_7$, $SF8_7$, $SF9_7$, $SF10_7$, and $SF11_7$, carried out are the address process W2 for selectively shifting to the extinction mode the discharge cells belonging to the (8N−6)th display lines, and the sustain process I. In each of the subfields $SF4_8$, $SF5_8$, $SF6_8$, $SF7_8$, $SF8_8$, $SF9_8$, $SF10_8$, and $SF11_8$, carried out are the address process W1 for selectively shifting to the extinction mode the discharge cells belonging to the (8N−7)th display lines, and the sustain process I.

Note here that, only the discharge cells in the lighting mode are discharged for light emission continuously over the period of "3" in the sustain process I in the subfield group $SF4_1$ to $SF4_7$, and over the period of "4" in the sustain processes I in the subfield group $SF4_8$ to $SF5_7$. In the sustain processes I in the subfield group $SF5_8$ to $SF6_7$, only the discharge cells in the lighting mode are discharged for light emission continuously over the period of "5", and in the sustain processes I in the subfield group $SF6_8$ to $SF7_7$, over the period of "7". In the sustain processes I in the subfield group $SF7_8$ to $SF8_7$, only the discharge cells in the lighting mode are discharged for light emission continuously over the period of "10", and in the sustain processes I in the subfield group $SF8_8$ to $SF9_7$, over the period of "12". In the sustain processes I in the subfield group $SF9_8$ to $SF10_7$, only the discharge cells in the lighting mode are discharged for light emission continuously over the period of "15", and in the sustain processes I in the subfield group $SF10_8$ to $SF11_7$, over the period of "19".

In the last subfield $SF11_8$, carried out is only the sustain process I for continuously discharging for light emission only the discharge cells in the lighting mode over a period of "178".

More specifically, the ratio among light emission periods each assigned to the subfields SF0 and SF1, and the subfield groups SF1 to SF11 is

[3:3:6:12:25:33:42:59:82:99:124:311], showing nonlinear characteristics.

With such driving, assuming that the discharge cells are set to be in the extinction mode only in the address process W8 of the subfield $SF4_1$, the discharge cells belonging to the (8N)th display lines are each put to cause sustain discharge light emission in the sustain processes I in the subfields SF0, SF1, $SF21_1$, $SF2_2$, and $SF3_1$ to $SF3_4$. In this manner, the discharge cells belonging to the (8N)th display lines emit with the luminance level of "24". Further, assuming that the discharge cells are set to be in the extinction mode only in the address process W7 of the subfield $SF4_{21}$ the discharge cells belonging to the (8N−1)th display lines are each put to cause sustain discharge light emission in the sustain processes I in the subfields SF0, SF1, $SF2_1$, $SF2_2$, $SF3_1$ to $SF3_4$, and $SF4_1$. In this manner, the discharge cells belonging to the (8N−1)th display lines emit with the luminance level of "27".

Assuming that the discharge cells are set to be in the extinction mode only in the address process W6 of the subfield $SF4_{31}$ the discharge cells belonging to the (8N−2)th display lines are each put to cause sustain discharge light emission in the sustain processes I in the subfields SF0, SF1, $SF2_1$, $SF2_2$, $SF3_1$ to $SF3_4$, and $SF4_1$ to $SF4_2$. In this manner, the discharge cells belonging to the (8N−2)th display lines emit with the luminance level of "30".

Assuming that the discharge cells are set to be in the extinction mode only in the address process W5 of the subfield $SF4_{41}$ the discharge cells belonging to the (8N−3)th display lines are each put to cause sustain discharge light emission in the sustain processes I in the subfields SF0, SF1, $SF2_1$, $SF2_2$, $SF3_1$ to $SF3_4$, and $SF4_1$ to $SF4_3$. In this manner, the discharge cells belonging to the (8N−3)th display lines emit with the luminance level of "33".

Assuming that the discharge cells are set to be in the extinction mode only in the address process W4 of the subfield $SF4_5$, the discharge cells belonging to the (8N−4)th display lines are each put to cause sustain discharge light emission in the sustain processes I in the subfields SF0, SF1, $SF2_1$, $SF2_2$, $SF3_1$ to $SF3_4$, and $SF4_1$ to $SF4_4$. In this manner, the discharge cells belonging to the (8N−4)th display lines emit with the luminance level of "36".

Assuming that the discharge cells are set to be in the extinction mode only in the address process W3 of the subfield $SF4_6$, the discharge cells belonging to the (8N−5)th display lines are each put to cause sustain discharge light emission in the sustain processes I in the subfields SF0, SF1, $SF2_1$, $SF2_2$, $SF3_1$ to $SF3_4$, and $SF4_1$ to $SF4_5$. In this manner, the discharge cells belonging to the (8N−5)th display lines emit with the luminance level of "39".

Assuming that the discharge cells are set to be in the extinction mode only in the address process W2 of the subfield $SF4_7$, the discharge cells belonging to the (8N−6)th display lines are each put to cause sustain discharge light emission in the sustain processes I in the subfields SF0, SF1, $SF2_1$, $SF2_2$, $SF3_1$ to $SF3_4$, and $SF4_1$ to $SF4_6$. In this manner, the discharge cells belonging to the (8N−6)th display lines emit with the luminance level of "42".

Further, assuming that the discharge cells are set to be in the extinction mode only in the address process W1 of the subfield $SF4_8$, the discharge cells belonging to the (8N−7)th display lines are each put to cause sustain discharge light emission in the sustain processes I in the subfields SF0, SF1, $SF2_1$, $SF2_2$, $SF3_1$ to $SF3_4$, and $SF4_1$ to $SF4_7$. In this manner, the discharge cells belonging to the (8N−7)th display lines emit with the luminance level of "45".

As such, according to the light emission driving sequence of FIG. 31, each of eight display lines adjacent to one another is driven with each different luminance level to be represented.

In detail, to pixel data corresponding to such display line,groups, of the PDP 100, as display line group constituted by [M·(k−1)+1)]th display lines, display line group constituted by [M·(k−1)+2)]th display lines, display line group constituted by [M·(k−1)+3)]th display lines,

.

.

.

display line group constituted by [M·(k−1)+M)]th display lines (where M is a natural number, k is a natural number of n/M or smaller), each different line offset value is added to derive multi-grayscale pixel data.

In other words, the display line groups constituted by [M·(k−1)+1l)]th display lines (where M is a natural number, k is a natural number of n/M or smaller, 1 is a natural number of M or smaller), each of which has a different line offset value are respectively added to derive multi-grayscale pixel data.

Then, M subfields out of a plurality of subfields composing a field are respectively assigned to M display lines described above, and light emission driving is sequentially effected with respect to each display line group. Thus luminance levels to be represented for the adjacent M display lines are made different.

Figure 32:
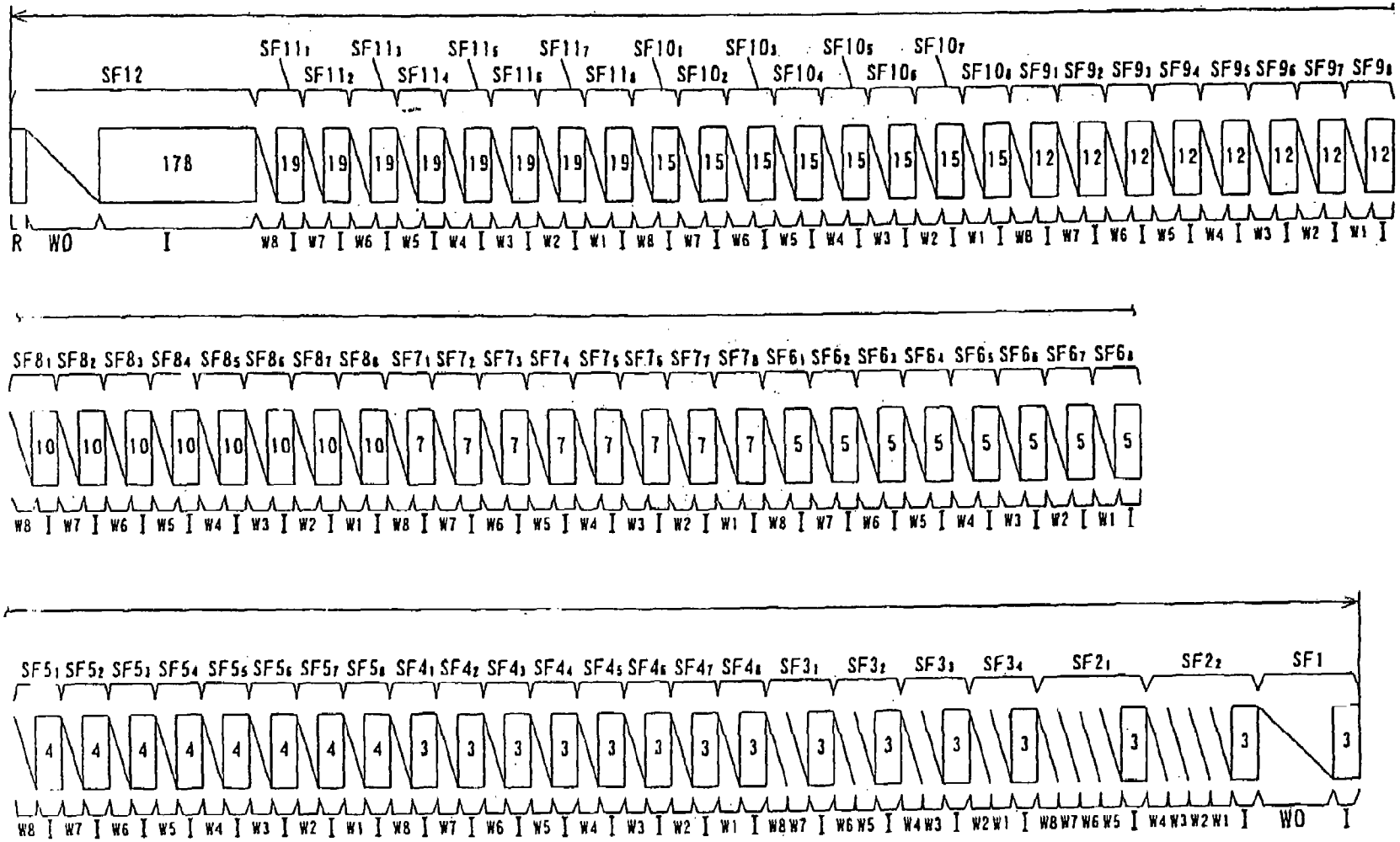
FIG. 32 is a diagram showing an exemplary light emission driving sequence at the time of driving the PDP 100 of FIG. 28 based on the selective writing address method.

Note here that FIG. 31 shows an light emission driving sequence based on the selective deletion address method. Instead of FIG. 31, adopting such an light emission driving sequence as shown in FIG. 32 will do to apply to the selective writing address method. Further, in FIG. 32, the address process W0 and the sustain process I of SF12 may be divided as $SF11_1$ to $SF11_8$.

This application is based on Japanese Patent Appication No. 2003-42810 which is herein incorporation by reference.

What is claimed is:

1. A display panel drive for tone-driving, responding to pixel data based on a video signal, a display panel in which a field display period of the video signal is constituted by a plurality of subfields, and pixel cells each carrying a pixel for n (where n is a natural number) display lines are arranged, the display panel drive comprising:

a multi-grayscale component for deriving multi-grayscale pixel data by adding each different offset value to the pixel data corresponding to a display line group including [M·(k−1)+1]th display lines (where M is a natural number, and k is a natural number of n/M or smaller) of the display panel, a display line group including [M·(k−1)+2]th display lines thereof, a display line group including [M·(k−1)+3]th display lines thereof, . . . , a display line group including [M·(k−1)+M]th display lines thereof; and an address component for dividing at least one of said plurality of subfields into M subsubfields, and in said subsubfields, respectively, performing a lighting mode setting or an extinction mode setting to each of the pixel cells for a different one of the display line groups, based on the multi-grayscale pixel data with respect to each of the pixel cells belonging to the corresponding display line group in said M subsubfields, and a light emission sustaining component for weighting said display line groups with different brightness values, respectively.

2. The display panel drive according to claim 1, wherein the address component changes the display line groups on a field basis of the video signal for the setting in the M subfields.

3. The display panel drive according to claim 1, wherein the multi-grayscale component further comprises dither addition component for generating a dither coefficient in a corresponding manner to any adjacent pixel position in a pixel cell group of i-line by j-column, and adding the result to the pixel data.

4. The display panel drive according to claim 3, wherein the dither addition component changes, on a field basis of the video signal, the dither coefficient derived in the corresponding manner to the pixel position in the pixel cell group.

5. The display panel drive according to claim 1, wherein said sustain component causes only the pixel cells in the lighting mode in each of the subfields to emit light over a light emission period assigned to the corresponding subfield, wherein a ratio among the light emission periods of the subfields is non-linear.

6. The display panel drive according to claim 5, wherein the subfield having assigned with the shorter light emission period in one field display period is arranged toward the front.

7. The display panel drive according to claim 5, further comprising reset component for setting all of the pixel cells to the lighting mode in the subfield locating in the field front, wherein the address component selectively shifts, to the extinction mode, the pixel cells in any one of the subfields in the subfields depending on the multi-grayscale pixel data.

8. The display panel drive according to claim 5, wherein the subfield having assigned with the longer light emission duration in one field display period is arranged nearer to a head of the subfields.

9. The display panel drive according to claim 5, further comprising reset component for setting all of the pixel cells to the extinction mode in the subfield locating in the field front, wherein the address component selectively shifts, to the lighting mode, the pixel cells in any one of the subfields in the subfields depending on the multi-grayscale pixel data.

10. The display panel drive according to claim 1, wherein the subfield having assigned with the shorter light emission period in one field display period is arranged toward the front.

11. The display panel drive according to claim 10, further comprising reset component for setting all of the pixel cells to the lighting mode in the subfield locating in the field front, wherein the address component selectively shifts, to the extinction mode, the pixel cells in any one of the subfields in the subfields depending on the multi-grayscale pixel data.

12. The display panel drive according to claim 1, further comprising reset component for setting all of the pixel cells to the lighting mode in the subfield locating in the field front, wherein the address component selectively shifts, to the extinction mode, the pixel cells in any one of the subfields in the subfields depending on the multi-grayscale pixel data.

13. The display panel drive according to claim 1, wherein the subfield having assigned with the longer light emission duration in one field display period is arranged nearer to a head of the subfields.

14. The display panel drive according to claim 13, further comprising reset component for setting all of the pixel cells to the extinction mode in the subfield locating in the field front, wherein the address component selectively shifts, to the lighting mode, the pixel cells in any one of the subfields in the subfields depending on the multi-grayscale pixel data.

15. The display panel drive according to claim 1, further comprising reset component for setting all of the pixel cells to the extinction mode in the subfield locating in the field front, wherein the address component selectively shifts, to the lighting mode, the pixel cells in any one of the subfields in the subfields depending on the multi-grayscale pixel data.

16. A display panel drive for tone-driving, responding to pixel data based on a video signal, a display panel in which pixel cells each carrying a pixel for a plurality of display lines are arranged, the display panel drive comprising:

a multi-grayscale component for deriving multi-grayscale pixel data by adding each different offset value to the pixel data each corresponding to a display group including [M·(k−1)+1]th display lines (where M is a natural number and K is a natural number of n/M or smaller) of the display panel, a display line group including [M·(k−1)+2]th display lines thereof, a display line group including [M·(k−1)+3]th display lines thereof, . . . and a display line group including [M·(k−1)+M]th display lines thereof; and a light emission driving component for emitting the pixel cells depending on the multi-grayscale pixel data by assigning a different weighting in intensity to each of the display line groups; and wherein the light emission driving component includes:

an address component for performing, based on the multi-grayscale pixel data, a lighting mode setting or an extinction mode setting with respect to each of the pixel cells on a display line group basis; and a sustain component for emitting only the pixel cells in the lighting mode over a predetermined period every time the setting to the display line groups is done.

17. The display panel drive according to claim 16, wherein the address component changes an execution order of the setting to the display line groups on a field basis of the video signal.

18. The display panel drive according to claim 16, wherein the multi-grayscale component further comprises dither addition component for generating a dither coefficient in a corresponding manner to any adjacent pixel position in a pixel cell group of i-line by j-column, and adding the result to the pixel data.

19. The display panel drive according to claim 18, wherein the dither addition component changes, on a field basis of the video signal, the dither coefficient derived in the corresponding manner to the pixel.

* * * * *

UNITED STATES PATENT AND TRADEMARK OFFICE

CERTIFICATE OF CORRECTION

PATENT NO. : 7,345,682 B2
APPLICATION NO. : 10/781722
DATED : March 18, 2008
INVENTOR(S) : Hirofumi Honda, Tetsuya Shigeta and Tetsuro Nagakubo It is certified that error appears in the above-identified patent and that said Letters Patent is hereby corrected as shown below:

Col. 41, line 32, claim 16: after “display” insert --line--.

Signed and Sealed this

Twenty-first Day of October, 2008

JON W. DUDAS
*Director of the United States Patent and Trademark Office*